US005785441A

United States Patent [19]

Kobayashi et al.

[11] Patent Number: 5,785,441

[45] Date of Patent: Jul. 28, 1998

[54] INK JET PRINTER HAVING PAPER SUPPORTS AND GUIDES

[75] Inventors: Yoichi Kobayashi; Takashi Akahane; Tsuyoshi Tomii; Masaki Shimomura; Koichiro Yokoyama; Toshikazu Kotaka; Kazutoshi Kashiwabara; Takuya Yasue, all of Nagano, Japan

[73] Assignee: Seiko Epson Corporation, Tokyo, Japan

[21] Appl. No.: 597,749

[22] Filed: Feb. 7, 1996

[30] Foreign Application Priority Data

| | | | |
|---|---|---|---|
| Feb. 7, 1995 | [JP] | Japan | 7-042433 |
| Feb. 7, 1995 | [JP] | Japan | 7-042434 |
| Feb. 7, 1995 | [JP] | Japan | 7-042435 |
| Feb. 20, 1995 | [JP] | Japan | 7-054987 |

[51] Int. Cl.[6] ..... B41J 13/10

[52] U.S. Cl. ..... 400/633; 400/603.1; 400/633.2

[58] Field of Search ..... 400/630, 633, 400/600.4, 601, 603, 603.1, 633.2

[56] References Cited

U.S. PATENT DOCUMENTS

| | | | |
|---|---|---|---|
| 3,311,371 | 3/1967 | Zeuthen | 271/59 |
| 4,500,023 | 2/1985 | Akazawa | 400/633 |
| 5,199,806 | 4/1993 | Fujioka et al. | 400/616 |
| 5,299,875 | 4/1994 | Hock et al. | 400/625 |
| 5,356,231 | 10/1994 | Nakamura et al. | 400/636 |
| 5,483,888 | 1/1996 | Greive | 101/232 |

FOREIGN PATENT DOCUMENTS

| | | |
|---|---|---|
| 622224 | 11/1994 | European Pat. Off. . |
| 638 498 | 2/1995 | European Pat. Off. . |
| 3941315 | 12/1989 | Germany . |
| 4330798 | 9/1993 | Germany . |
| 4330798 | 3/1994 | Germany . |
| 19504430 | 2/1995 | Germany . |
| 195 04 430 | 8/1995 | Germany . |
| 19548910 | 12/1995 | Germany . |
| 195 48 910 | 6/1996 | Germany . |
| 62-83977 | 10/1985 | Japan . |
| 63-222875 | 3/1987 | Japan . |
| 62-83977 | 4/1987 | Japan . |
| 62-222875 | 9/1988 | Japan . |
| 4-341848 | 11/1992 | Japan . |
| 6-91861 | 4/1994 | Japan . |
| 1 597 412 | 9/1981 | United Kingdom . |

*Primary Examiner*—John S. Hilten
*Attorney, Agent, or Firm*—Stroock & Stroock & Lavan LLP

[57] ABSTRACT

A paper discharge section for a printer having a printer body includes first and second support portions mounted on the printer body. At least one of the support portions is slidable towards and away from the other support portion. A paper pushing down portion is mounted on the printer body and positioned intermediate the support portions. The first support portion can rotate between at least a first position at which the first support portion supports a first bottom side portion of the sheet of paper and at least a second position in which the first support portion does not support the first bottom side portion of a sheet of paper. A slidable edge guide for guiding a first side edge of a sheet of paper is provided and slidable towards the other edge guide. A linkage mechanism links the slidable edge guide to the first support portion to cause the first edge guide and first support portion to slide together.

20 Claims, 33 Drawing Sheets

INK JET PRINTER HAVING PAPER SUPPORTS AND GUIDES

BACKGROUND OF THE INVENTION

The present invention relates to ink jet printers, and, in particular, to an improved ink jet printer constructed to more accurately and reliably discharge paper including discharging the paper without causing ink to smear on the discharged sheets of paper.

Reference is first made to FIGS. 32–34 which depict a conventional printer described in U.S. Pat. No. 5,299,875. This printer includes a printer body, generally indicated at 401. A paper feed tray 402 for receiving and setting a paper P which is delivered for printing, is positioned at a rear portion of body 401. A pair of support portions 403 and 404 and an edge separator 405 are positioned at a front portion of body 401. A pair of recesses 406 and 407 are provided in body 401 to receive support portion 403 and 404, respectively, during non-use and storage of the printer. An ink jet head (not shown) is positioned within body 401. Paper P is supplied to body 401 from paper feed tray 402. As shown in FIG. 34, after paper P is printed upon by the inkjet head, the paper is discharged while the side edges of paper P are guided and supported by support portions 403 and 404 and the central portion of paper P is guided and supported by edge separator 405. Supporting portion 404 is constructed to be slidable in the paperwidth direction (arrow b, FIG. 33) so as to be adjustable to correspond to the width of the paper P being printed upon. Furthermore, during storage of the printer when not in use, supporting portion 404 is constructed to face recess 406 and capable of rotation in the direction of arrow a (to the right of the paperwidth direction). Likewise, supporting portion 403 is constructed to face recess 407 and is capable of rotation.

In another type of conventional printer (not shown), an edge guide assembly may be provided to guide the edges of a paper set in a paper feed apparatus. The edge guides, which must be manually positioned, may be permitted to slide in the paper widthwise direction upon a shaft, for example, in order to be set to correspond to the width of a paper being fed into the printer.

Reference is now made to FIG. 35 which depicts a conventional ink jet printer, generally indicated as 500, described in Japanese Unexamined Patent Publication 341848/1992. Printer 500 includes a printing section, generally indicated at 501, which itself includes an ink jet head 502 and a paper guide member 506 spaced apart from ink jet head 502. Paper guide member 506 has a guide surface **506*a* which contacts the bottom surface of paper P and guides paper P through printing section 501. Printer 500 also includes paper feed rollers 504*a*, 504*b* which rotate as indicated by arrows z1, z2 respectively in FIG. 35, thereby feeding a sheet of paper P therebetween to printing section 501. Ink jet head 502 (hereinafter "head 502") discharges ink while moving reciprocally in a direction perpendicular to the paper surface of FIG. 35 and prints on the surface of paper P fed as it is fed to printing section 501 by paper feed rollers 504*a*, 504*b*. The width A represents the printing region within which head 502 prints on printer P. A pair of paper discharge rollers 505*a* and 505*b* are rotatably mounted in printer 500 and guide paper P out of printing section 501** so as to be discharged.

One common problem with the conventional ink jet printers described above which generally print by discharging ink on a paper and which further require continuous sheets to be continuously printed upon and discharged through the printing section is that there is insufficient time to permit the ink to dry on a previous sheet of paper before the next sheet of paper is discharged thereupon. Without any means to sufficiently separate each successive sheet of paper before the previous page dries, the next paper is discharged and slidably contacts the printed surface of the previous printed paper. Therefore, there is a high likelihood that the ink on the printed surface of the previous printed paper will smear.

One ink jet printer construction that has attempted to solve this problem is described in Japanese Unexamined Patent Publication 91861/1994, a perspective view of a paper discharge portion, generally indicated at 690, of the ink jet printer being depicted in FIGS. 36–39. Discharge portion 690 includes a frame 670 which includes thereon a pair of integrally formed supporting portions **691*a* and 691*b* which respectively guide and support from below each side portion of a paper P which has been previously printed upon (on an upper surface thereof) by means of a printing head (not shown) and is being discharged therefrom. Supporting portions 691*a* and 691*b* may be thin, integrally formed and not movable rib-like members, having their respective upper surfaces 691*a*', 691*b*' inclined upwards in the paper discharging direction. A transport section 680 includes a plurality of discharging rollers 682 for discharging paper P and eventually will be discharged onto a discharge plate 660 which may be rotatably mounted with respect to discharge frame 670**.

An arm, generally indicated at 693, is rotatably mounted on a frame (not shown). Arm 693 includes a pushing-down portion 692, rotatably supported thereon and constructed of a notched roller (thin plate shaped star wheel). Pushing down portion 692 pushes down on the central portion of the paper P being discharged from discharged section 690.

The paper discharge operation of this conventional type of printer will now be described. Paper P is printed upon in the print section (not shown) and passes into discharge portion 690. At this time each side of paper P is guided upwardly by upper surfaces **691*a*', 691*b*' of respective supporting portions 691*a* and 691*b*. At the same time, although the central portion of paper P attempts to push pushing-down portion 692 upwardly while also rotating arm 693 upwardly, the central portion of the paper will gradually fall below pushing-down portion 692 and is urged downwardly due to the weight of pushing-down portion 692 and arm 693 against the central portion of paper P. Thus, as paper P is discharged it is forcibly urged into a concave shape as viewed in the discharging direction. This type of concave shape may also be achieved without a pushing down portion since the weight of the paper itself may cause the concavity thereof. Nonetheless, as paper P is forcibly urged into this concave shape, the paper will stiffen and will move along in the discharging direction as if it were floating. Because of this, as more particularly depicted in FIG. 37**, the time until discharged paper P slidably contacts a printed surface P1*f* of paper P1 (previously printed, discharged, and stacked on a paper discharge tray 660) will be delayed. This method of delaying the subsequent sheet of paper from contacting the previously discharged sheet allows sufficient time for the ink to dry on printed paper P1 before contact with paper P takes place.

FIG. 38 illustrates paper P after being further discharged from discharge portion 690, and having its trailing edge P*b* pass transport section 680. At this time, and without discharge rollers 682 acting on paper P, paper P loses its transporting force in the discharge direction. However, the rear portion P*c* of paper P is maintained in its concave state by the remaining force of pushing-down portion 692 upon the central portion of rear portion P*c* of paper P and the remaining action of support portions 691*a*, 691*b* upon the sides of paper P.

As shown in FIG. 39, when a subsequent sheet of paper P2 enters transport section 680, its leading edge P2*a* will then pass transport section 680. When leading edge P2*a* contacts trailing edge P*b* of the preceding paper P, discharge portion 690 and does not press against preceding paper P. The force applied by discharge portion 690 against preceding paper P ceases by the time it contacts subsequent paper P2. Preceding paper P is stacked on the earlier printed paper P1 (FIG. 37), and therefore the time until paper P2 contacts printed paper P1 is further delayed.

Referring once again to the ink jet printer depicted in FIGS. 32–34, when setting paper of different sizes in paper feed tray 402, it is necessary for the user to slide supporting portion 404 in the direction of arrow b (FIG. 33) to match the width of the paper set therein. However, supporting portion 404 is constructed to rotate only in the paperwidth direction (the sliding direction). Therefore, in the case of carelessness by the user, for example, support portion 404 may be slid by the user without first observing for the presence of obstructions in the sliding direction. In this way, force applied to support portion 404 in a direction in which there is no rotatability, because of an obstruction, for example, will cause damage to the printer and/or supporting portion. For example, if the previously described edge separator 405 is replaced with the aforementioned pushing-down portion, this pushing-down portion may become the above-mentioned obstruction, and there is an increased possibility that the construction of a printer that utilizes both the support portions 403, 404 and which attempts to reduce ink smearing by incorporating a pushing-down portion 692, will result in damage to the support portion 404 by the possible carelessness of the user when rotating support portions 403, 404.

Moreover, in printers having an edge guide it is necessary for the user to slide the edge guide to match the width of the paper when setting paper of a different size in the paper feeder. Accordingly, if it was desired to use both an edge guide and support portions, when setting paper of a different size in a paper feeder apparatus, the user must not only separately slide the edge guide, but also must slide a support portion to match the width of the paper. This multi-setting requirement is complicated and undesirable.

In particular, in the case where a paper feeder apparatus in which paper is set and a discharge portion in which paper is discharged are spaced apart and provided in different planes with respect to each other, and therefore a guide which may be set to guide the paper in the paper tray and a discharge portion are positioned far apart from each other, when setting paper of different sizes in the paper feeder apparatus, even if the user does not forget to slide the edge guide to match the width of the paper, the user may carelessly forget to slide the support portion in the discharge section. If the support portion is not slid to the proper position, a correct discharge operation will not be achieved and ink will smear on the previously discharged paper.

Still further, in an ink jet printer of the type depicted in FIG. 35, if paper P is warped into a concave shape, the leading edge of paper P might enter the space S between head 502 and discharge rollers 505*a*, 505*b*. If the leading edge of the warped sheet of paper enters space S, the section of the paper having already been printed upon may contact head 502, thereby smudging the not yet dried ink. Moreover, if the leading edge of the warped paper cannot be properly guided towards discharge rollers 505*a*, 505*b*, the leading edge of paper P will become jammed in space S thereby causing a paper jam condition.

Still further, in an ink jet printer having a paper discharge configuration of the type depicted in FIGS. 36–40 which is capable of printing on paper of different sizes and where paper of different sizes can be discharged, it is desirable that at least one supporting portion, 691*a* or 691*b* be capable of sliding so as to be adjustable to match the width of paper P delivered for printing. However, the sliding of the supporting portion requires a complicated and undesirable printer construction and operation.

On the other hand, as previously described, a type of printer is known where an edge guide for guiding the side of a paper is provided in the paper supply portion. As this edge guide is slid by the user to match the width of a paper when paper of a different size is set in the paper supply portion, if the sliding of this edge guide is linked to the sliding operation of the supporting portion, there is the benefit of reducing the inconvenience of having to slide the supporting portion each time. However, the conventional linking assemblies that attempt to link the sliding of the edge guide to the sliding operation of the supporting portion have the following problems. That is, there are types of paper which require support on both sides thereof by a supporting portion on each side of the paper. There are also types of paper, such as thick paper such as postcards and envelopes, which do not require support on each side thereof. For example, normal types of paper such as A4 and B5 require the support on both sides of the sheet by a pair of supporting portions. By supporting both sides of the sheet, a fairly reliable discharge operation is obtained. However, when using paper such as postcards or small envelopes with comparatively narrow widths, as shown in FIG. 40, both sides of the sheet are supported by supporting portions 691*a* and 691*b*. However, since the paper is stiff and will not necessarily bend into a concave shape, a stable abutting operation (pushing out operation) where the trailing edge P*b*' of a previous paper P' is urged by the leading edge P2*a*' of a following paper P2' is not obtained. The result is that the stacking position of discharged paper P1' is disordered and the order in which the papers lie when discharged is upset as depicted in FIG. 40.

Accordingly, a printer that overcomes the aforementioned disadvantages and limitations, readily discharges paper and readily supports and guides the paper is desired.

SUMMARY OF THE INVENTION

An ink jet printer includes a pair of supporting portions supporting from below both side portions of a paper being discharged which has been printed on a top surface by means of a printing section having an inkjet head, and a pushing-down portion pushing the middle of the paper in a downward direction; at least one of the supporting portions being constructed to be slidable along the paper width and constructed so as to be rotatable in either of a first and second direction along the width of the paper.

In a preferred embodiment printer has a paper feeder apparatus including an edge guide for guiding the edges of a paper. The edge guide is slidable to match the width of a paper delivered for printing. A linking mechanism links the slidable edge guide and slidable supporting portion so that they slide in unison. The slidable supporting portion is rotatably mounted to be rotated between the supporting position for supporting the paper and at least one non supporting position in which the supporting portion does not support the paper. Further, when the slidable supporting portion is slid past the pushing-down portion towards the second supporting portion, the slidable supporting portion is retained in a non-supporting position by rotating the slidable portion where the slidable portion abuts the pushing-down portion. A spring biases the supporting portion towards the supporting position, and a retaining portion retains the supporting portion in a non-supporting position against the biasing force from the spring.

In another preferred embodiment, the printer includes a printer body and a print section therein, a paper feeder apparatus operatively mounted to said printer body and including a first edge guide for guiding a first side edge of a sheet of paper and a second edge guide spaced from said first edge guide for guiding a second side edge of a sheet of paper, at least one of said first and second edge guides being a slidable edge guide and slidable towards and away from the other edge guide. The printer may further include a paper discharge section having first and second support portions located in a different plane from the paper feeder apparatus. The first support portion supports a first bottom side portion of a sheet of paper discharged from said printer body and the second support portion supports a second bottom side portion of a sheet of paper, and where at least the first support portion is slidable towards and away from the second support portion and a linkage mechanism for linking said slidable edge guide to the first support portion so the slidable edge guide and the first support portion slide together.

In another embodiment, the paper discharging portion is mounted on the printer body in a different plane than the paper feed apparatus. The linking mechanism includes a linkage rod having a first pinion provided on the supporting portion side, and a second pinion provided on the edge guide side, and a first rack mounted on the supporting portion and engaging with said first pinion and a second rack mounted on said paper feed apparatus engaging with said second pinion. Moreover, it is desirable that said supporting portion of one side is constructed capable of rotation in both left and right directions in the direction of the paper width. It is also desirable for the supporting portion to have the advantage of a support position, supporting from below a side portion of a paper, and a non-supporting position where, by means of being rotated from the supporting position in either a right or left direction in the paper width direction, the side portions of the paper are not supported. Further, the paper discharge portion has a pushing-down portion, pushing a central portion of said paper in a downward direction. When the slidable supporting portion is slid past the pushing-down portion towards the other supporting portion, the slidable supporting portion is retained in a non-supporting position by means of rotating after abutting the pushing-down portion.

In a further exemplary embodiment, an ink jet printer includes a printing section printing by discharging ink on the surface of a fed paper, and a pair of paper discharge rollers for discharging a paper printed by the printing section disposed downstream of the printing section in a paper feeding direction. A guide roller is disposed in a gap between the printing section and pair of discharge rollers which, in the case where the paper is warped, guides the paper towards the pair of discharge rollers. This invention is particularly effective in cases where the paper is supplied to the printing section passing through a curved paper feed path.

In another exemplary embodiment the ink jet printer comprises an edge guide guiding the edge of a paper and slidable to match the width of a paper supplied to a printer body, a printing section and a pair of supporting portions capable of supporting from below both side portions of a discharged paper printed on an upper surface by the printing section. At least one supporting portion is slidable in a direction along the paper width. A linking mechanism links the sliding supporting portion and the sliding edge guide only within a range required for the support of both paper side portions. It is preferable that the linking mechanism include a connecting mechanism for connecting the edge guide and support portion and a release mechanism for releasing the connection between the edge guide and supporting portion made by the connecting mechanism at a time when the slidable supporting portion approaches a region where support of both side portions of a paper is not required from a region where support of both side portions of a paper is required, and permitting connection of the edge guide and supporting portion by the connecting means when the edge guide moves from a region where support of both side portions of a paper is not required to a region where support of both side portions of a paper is required.

In yet another preferred embodiment of the invention, a printer, which may be an ink jet printer by way of example, includes a printer body and a printing section including a print head for printing on a top surface of a sheet of paper and a regulating member mounted in said printer body for supporting a bottom surface of a sheet of paper. The regulating member has at least a portion thereof in facing relationship with the printing section and includes a paper support member extending therefrom. The paper support member has a substantially rhomboidal shape in the elevational view which assists in maintaining the integrity of a forward paper feed operation and a reverse paper feed operation.

In still another embodiment, the printer may include a printer body and a paper feed roller shaft rotatably mounted therein, first and second support portions mounted in said printer body for supporting respective first and second bottom side portions of a sheet of paper discharged from said print body. At least the first support portion is slidable towards and away from the second support portion and adapted to rotate between a first position for supporting a first bottom side portion of a sheet of paper and at least a second position in which said support portion does not support a first bottom side portion of a sheet of paper. Also provided in this embodiment is an automatic return mechanism for causing the first support portion to rotate from said second position to said first position.

Accordingly, it is an object of the present invention to provide an improved printer that can more reliably discharge paper.

Another object of the present invention is to provide an improved printer which can discharge paper without the ink on previous sheets of paper being smeared.

Still another object of the present invention is to provide an ink jet printer which can include slidable support portions for accommodating and supporting the bottom surface of varying paper sizes.

Yet another object of the present invention is to provide an ink jet printer which will properly and reliably discharge paper even in cases where the paper is warped.

Still another object of the present invention is to provide an ink jet printer that includes an easy and reliable paper setting operation.

Yet another object of the present invention is to provide an ink jet printer that includes at least one supporting portion and an edge guide in which the sliding operation to properly guide and support the paper is simple.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings in which.

DESCRIPTION OF THE PREFERRED EMBODIMENTS

Figure 1:
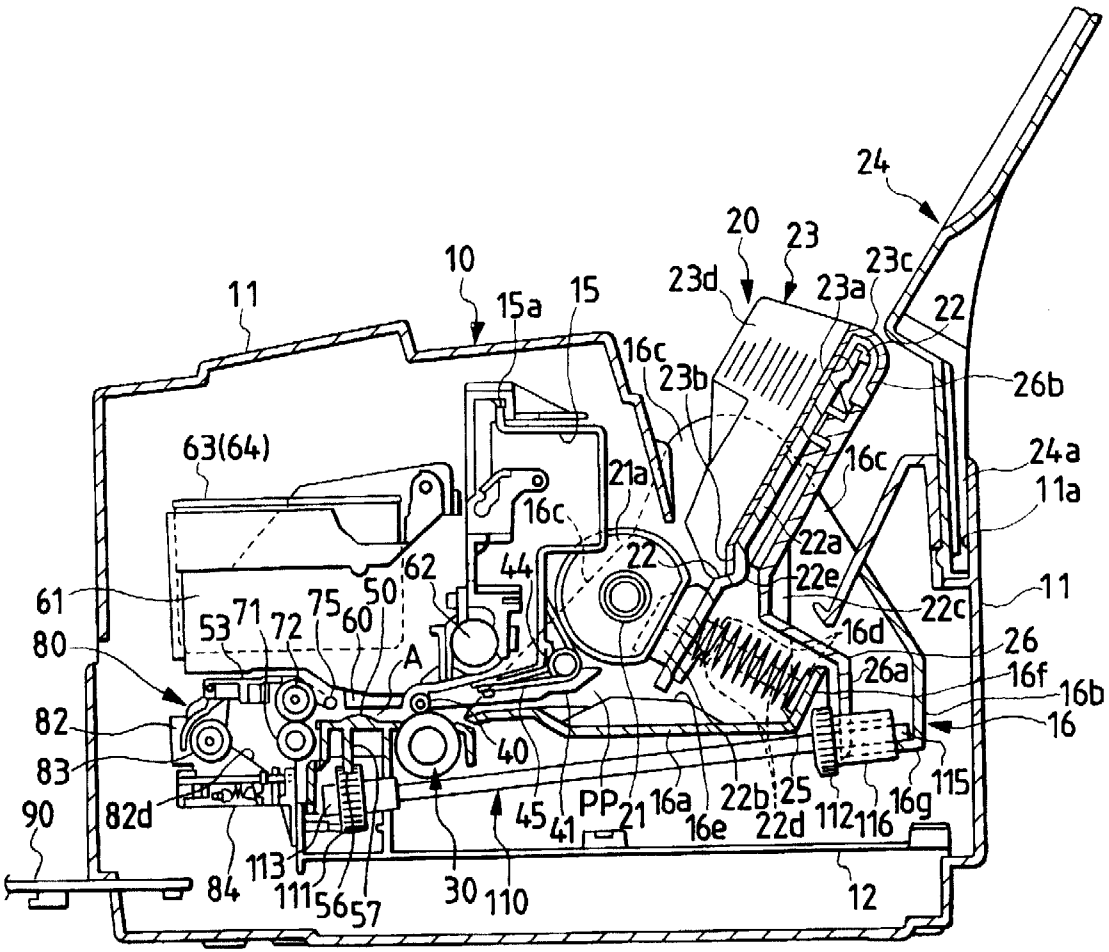
FIG. 1 is a sectional view of an ink jet printer constructed in accordance with a first embodiment of the present invention.
Figure 2:
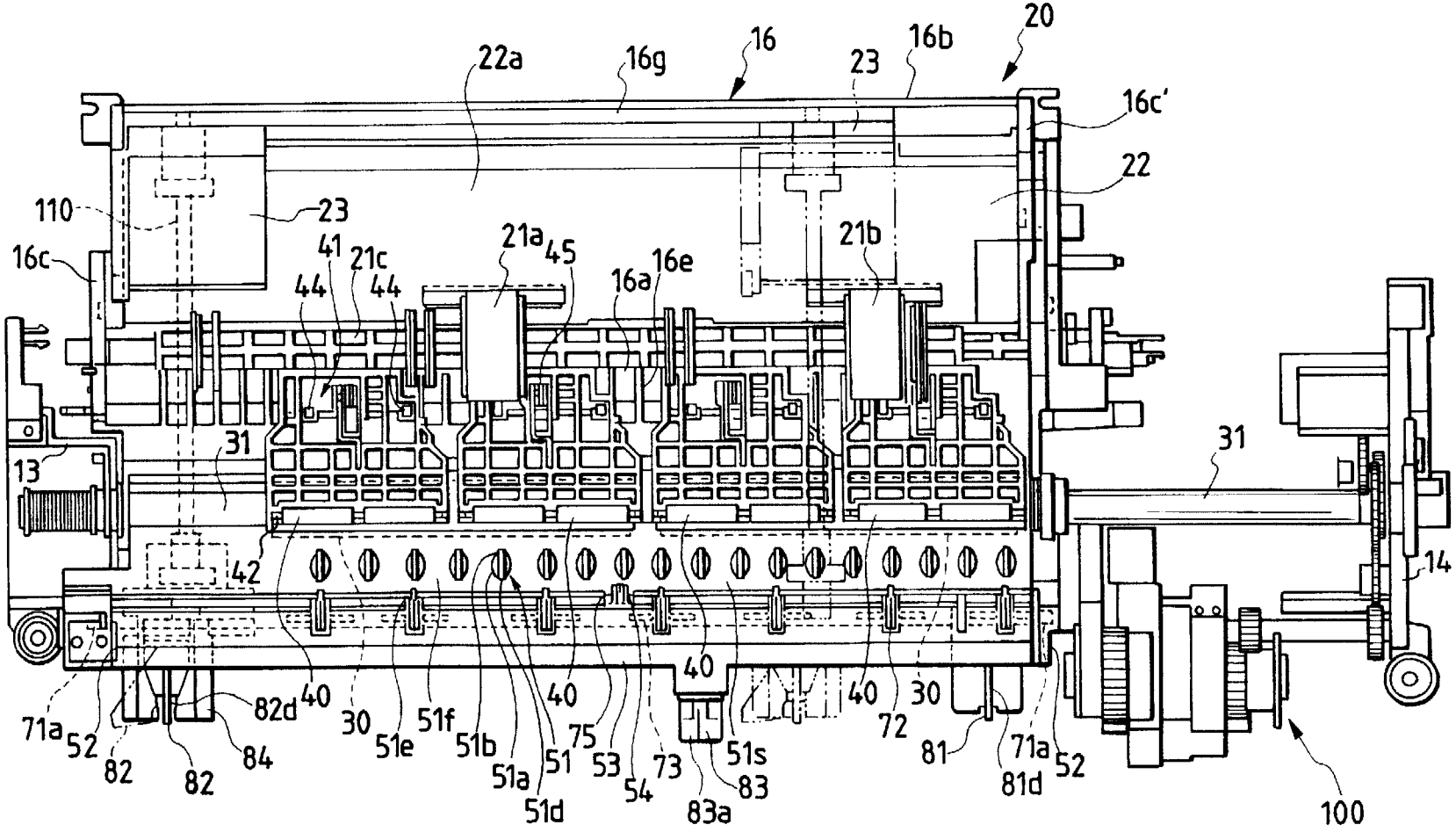
FIG. 2 is a partial top plan view of the ink jet printer of FIG. 1.

Reference is first made to FIGS. 1 and 2 which depict a printer body, generally indicated at 10, of a printer which may be an ink jet printer by way of example, constructed in accordance with a first embodiment of the present invention. Printer body 10 includes a printer case 11 within which an automatic paper feeder apparatus 20 is positioned. More particularly, automatic paper feeder apparatus 20 is positioned in the upper rear portion of printer body 10.

Generally speaking, body 10 includes two paper feed rollers 30 (only one is depicted as illustrative), a driven pinch roller 40 rotatably mounted in body 10 and in pressing contact with a paper feed roller 30 rotatably mounted in body 10. A regulating member 50 for guiding the bottom surface of a sheet of paper is mounted in print body 10, an ink jet head 60 for discharging ink onto a sheet of paper is mounted on a reciprocating carriage 61 in facing relationship across a gap with regulating member 50. A guide roller 75 for urging the paper through the discharge section, as explained below, is rotatably mounted in printer 10. At least one pair of discharge rollers 71 and 72 is rotatably mounted in printer 10. A discharge portion, generally indicated at 80 is mounted in print body 10 along the feed path for paper P (which is supplied from automatic paper feeder apparatus 20). Discharge portion 80 is positioned in the front lower portion of printer body 10. A discharge tray 90 for stacking paper discharged from discharge portion 80 is positioned 80 in body 10 and apart from and below discharge portion 80.

Printer body 10 also includes a lower portion frame 12 within case 11 preferably made of a metal plate and serving as a shield plate (not shown), a left side frame 13 and a right side frame 14 preferably made of plastic and positioned in lower frame 12. An intermediate frame 15 made of a metal plate is positioned within side frames 13 and 14. A sub frame, generally indicated at 16, is mounted within case 11 and is preferably made of plastic. Sub frame 16 fixes each of the above-mentioned frames in their proper position.

Still further, sub frame 16 includes a lower plate 16*a* forming a lower portion of paper feed path PP (FIG. 3), a back plate 16*b* integrally formed with lower plate 16*a* and side plates 16*c* and 16*c*' integrally formed with lower plate 16*a* and back plate 16*b* on opposed sides of print body 10 as shown in FIG. 2. A plurality of rib-shaped paper guides 16*e* extend from the top surface of lower plate 16*a*.

Automatic paper feeder apparatus 20 includes a grooved paper feed roller shaft 21 which is rotatably supported in side plates 16*c* and 16*c*' of sub frame 16, and at the time of paper feeding, is rotatably driven by a transmission mechanism (not shown) connected to a drive mechanism 100. Two paper feed rollers 21*a* and 21*b* are rotatably mounted on paper feed roller shaft 21. Paper feed rollers 21*a*, 21*b* are each preferably constructed as D-shaped rollers having an outer rubber surface layer. Automatic paper feed apparatus 20 also includes a hopper 22, an edge guide 23, and a paper feeder tray 24.

Hopper 22 includes a lower plate 22*a* for supporting a lower surface of a sheet of paper, side plates 22*b* integrally formed with lower plate 22*a* (only one side of which is shown by way of example in FIG. 1), triangular side plates 22*c* also integrally formed with lower plate 22*a* (only one side of which is shown by way of example in FIG. 1), and pins 22*d* integrally projected sideways from side plates 22*b* and 22*c* respectively. Pins 22*d* engage with elongated slots 16*d* formed in side plate 16*c* of sub frame 16, thereby permitting hopper 22 to move diagonally upwardly and downwardly relative to sub frame 16. Hopper springs 25 are provided between hopper 22 and lower plate 16*a* of sub frame 16, and urge hopper 22 in a diagonally upward direction relative to sub frame 16. Furthermore, hopper springs 25 may be positioned essentially below (See FIG. 1) paper feed rollers 21*a*, 21*b*. A cam mechanism (not shown) is operatively connected to drive mechanism 100 and positioned in side plates 16*c* and 16*c*' of sub frame 16 to push hopper 22 against the spring force of hopper springs 25. When paper is supplied, hopper 22 is pushed upwards by hopper springs 25, thereby pushing the paper towards paper feed rollers 21*a*, 21*b*. After the paper is fed to paper feed rollers 21*a*, 21*b*, hopper 22 is urged downward by the downward force provided by the cam mechanism and moves downwardly with respect to paper feed rollers 21*a*, 21*b*. In this way, paper is not fed to paper feed rollers 21*a*, 21*b*.

Edge guide 23 include lower plate 23*a*, bent portions 23*b* positioned in the leading edge portions of lower plates 23*a*, clip portions 23*c* provided in the lower surface and rear portion of edge guide 23, side plates 23*d* connected to lower plates 23*a*, and a connecting plate 26. Edge guide 23 is slidably fitted onto hopper 22 by the engagement of bent portions 23*b* and a groove 22*e* in lower plate 22*a*. Clip portions 23*c* wrap over the rear portion (the upper end portion) of hopper 22 and hold edge guide 23 in place. Side plate 23*d* of edge guide 23 aligns the left edge of a sheet of paper (not shown) set in the top of hopper 22. The right side of the paper is guided by the upper portion inside surface of side plate 16*c*' on the right side of sub frame 16.

As shown in FIG. 1, paper feeder tray 24 is detachably fitted to printer body 10 by an insertion piece 24*a* formed in the lower portion of paper feeder tray 24. Insertion piece 24*a* is inserted into insertion slots 11*a* provided in case 11 of printer body 10. With paper feeder tray 24 inserted into case 11, paper feeder tray 24 cooperates with hopper 22 to support the lower surface of a sheet of paper. With hopper 22 in a pushed-down state by the previously described cam mechanism, when the automatic paper feeder apparatus is not operating, the operation for setting paper in automatic paper feeder apparatus 20 requires the simple operation of inserting one or more sheets of paper from an upward direction into paper feeder tray 24.

With the paper set in paper feeder tray 24 and automatic paper feeder apparatus 20 operating, a pressure release by the cam mechanism causes hopper 22 to be urged upwardly by hopper springs 25. Then, only the uppermost sheet of paper in hopper 22 will abut paper feed rollers 21 and is conveyed to paper feed path PP.

As shown in FIG. 2, a paper feed roller shaft 31 is rotatably supported by side frames 13 and 14 and is rotatably driven by drive mechanism 100. Paper feed rollers 30 are preferably two comparatively long round rod-shaped rubber rollers and are rotatably mounted on paper feed roller shaft 31. Shaft 31 rotates causing paper feed rollers 30 to rotate to thus cause the paper to advance one line at a time. Further, there is cooperation between head 60 and drive mechanism 100 so that head 60 moves across the sheet of paper and is positioned for printing the next line of print.

Figure 3:
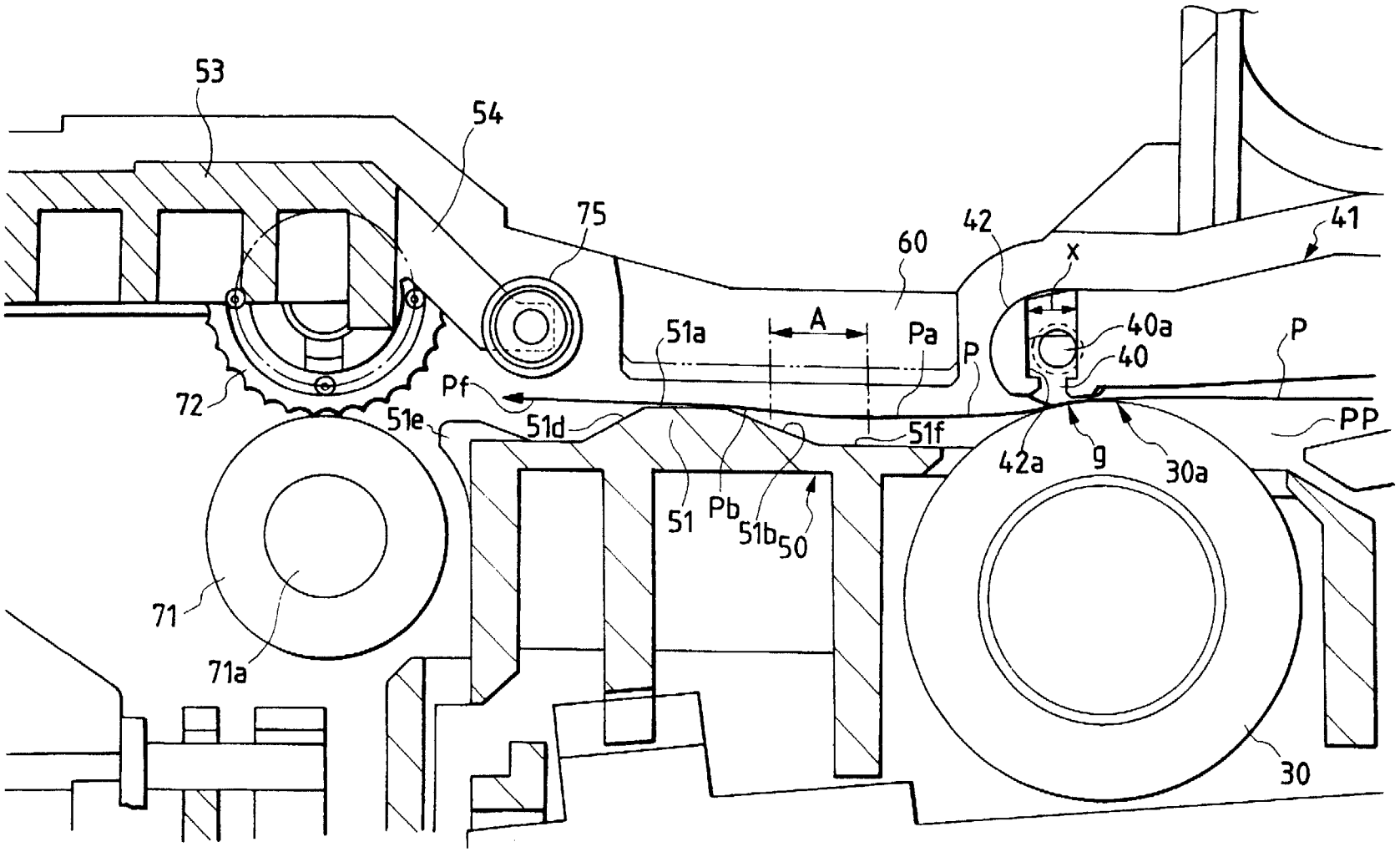
FIG. 3 is an enlarged sectional view of a portion of the ink jet printer of FIG. 1 illustrating a paper feeding operation.

As shown in FIG. 3 in greater detail, holders 41 which include integrally formed cam portions 42, are provided and function as paper guides and form the upper portion of paper feed path PP. As can be seen in FIGS. 1 and 2, a pair of hooks 44 are formed in the upper portion of holders 41 and support holders 41 in position on intermediate frame 15. Holders 41 are capable of oscillation. Rectangular holes 42*a* are formed in portions 42 of holders 41. A shaft 40a is rotatably supported and capable of shifting in the directions of double headed arrow x within rectangular holes 42*a*. Pinch rollers 40 are preferably round rod-shaped metal rollers and supported on shaft 40*a*. In a preferred embodiment, four pinch rollers are provided, and oppose paper feed rollers 30. Springs 45 are provided between holders 41 and intermediate frame 15, and, as shown in FIG. 3, pinch rollers 40 abut paper feed rollers 30 at a position g which is slightly downstream in the paper conveying direction from a position indicated as the top, 30*a*, of paper feed rollers 30. This slight forward alignment of pinch rollers 40 is caused by the urging force of springs 45. Pinch rollers 40 abut the self aligning paper feed rollers 30 and are rotatably driven by paper feed rollers 30.

Reference is now made to FIG. 3 which depicts regulating member 50, which is fixed in lower portion frame 12 and arranged on the bottom surface side of a paper P conveyed by paper feed rollers 30. Regulating member 50 includes a horizontal flat portion 51*f* positioned opposite print head 60 and a plurality of ribs 51 integrally projected in an upward direction from horizontal portion 51*f*. Ribs 51 extend perpendicular to the paper conveying direction. Ribs 51 have an inclined surface 51*b*, a top surface 51*a* connected to slanting surface 51*b*, and declined surface 51*d* connected to top surface 51*a*. When viewed from the side as shown in FIG. 3, these surfaces form a substantially trapezoidal profile and elongate in the paper conveying direction.

Inclined surface 51*b* guides the leading edge of a paper fed by paper feed roller 30 and top surface 51*a* abuts the bottom surface P*b* of the paper and regulates the gap between the paper P and ink jet head 60. Guide portions 51*e* are provided on the upstream side of discharge rollers 71 and 72 and positioned downstream of ribs 51. Guide portions 51*e* guide the leading edge P*f* of paper P towards discharge rollers 71 and 72. Guide portions 51*e* are preferably only provided on the upstream side of discharge rollers 71 and 72 and are not preferably arranged in other locations.

A guide shaft 62 and upper edge 15*a* of intermediate frame 15 support and guide carriage 61. Ink jet head 60 is mounted on carriage 61. Carriage 61 moves reciprocally in a direction perpendicular to the plane of FIG. 1 by a drive force from a carriage motor (not shown). A monochrome ink tank 63 and a color ink tank 64 may both be installed on carriage 61 next to each other in a direction perpendicular to the plane of FIG. 1 so that ink jet head 60 is capable of color printing.

Figure 13A:
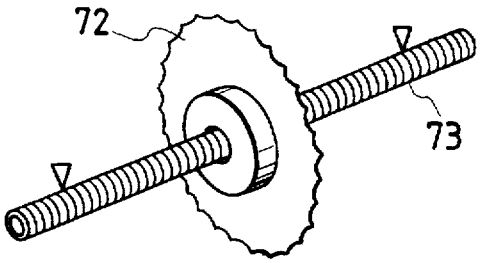
FIGS. 13A and 13B are perspective views of a serrated roller constructed in accordance with the present invention.
Figure 13B:
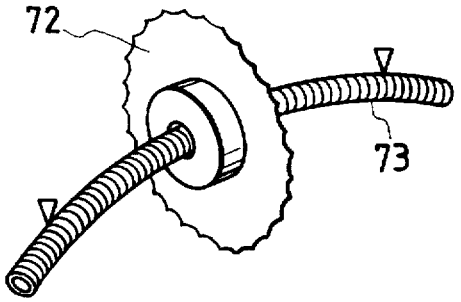

As shown in FIG. 2, a shaft 71*a* is rotatably supported in a side plate 52 of regulating member 50. A plurality of pairs of discharge rollers 71 and 72 (7 pairs are depicted in FIG. 2) are arranged along the width of the paper feed path. Rollers 71 are rotatably mounted on shaft 71*a*. Roller 71 of one end of the pairs of discharge rollers 71 and 72 is preferably constructed of a rubber roller and is rotatably driven by drive mechanism 100 by a transmission mechanism (not shown). Roller 72, which may be a thin plate-shaped star wheel, is preferably a rotatably driven serrated roller and contacts roller 71. As depicted in FIG. 13A, a star wheel 72 is rotatably supported on a round rod-shaped coil spring 73 (which acts as a shaft) and is supported by a support plate 53 mounted in the printer body. Serrated roller 72 contacts rubber roller 71 by the spring force of coil spring 73. In the case of thick paper such as envelopes, serrated roller 72 does not press hard against the paper, but rather, rises upwards as shown in FIG. 13B and does not degrade the paper conveyance operation. The rotational speed of the pairs of discharge rollers 71 and 72, which directly corresponds to the conveying speed of the paper, is set so that the linear speed of the paper through rollers 71 and 72 is faster than the linear speed of the paper through paper feed rollers 30. Due to this, after the leading edge of paper P reaches the pairs of discharge rollers, the paper is taut between paper feed rollers 30 and the pairs of discharge rollers 71 and 72.

Top surface 51*a* of ribs 51 of regulating member 50 is placed a little downstream of the ink jet head 60 when viewed in the paper conveying direction. This results in the paper P being urged towards the head 60. The front and rear portions of paper P, passing over regulating member 50, is conveyed while urged downwardly towards regulating member 50 by paper feed rollers 30, pinch rollers 40, and discharge rollers 71 and 72. The rear surface Pb of the paper reliably abuts the top surface 51*a* of the ribs 51.

Support plate 53 includes an arm 54 integrally formed and slanted downward therefrom. A guide roller 75 is rotatably mounted at the end of arm 54. Guide roller 75 is positioned between a printing section A and pairs of discharge rollers 71 and 72. In the less than desirable situation where paper P is warped, the paper will contact guide roller 75 and will be guided towards the pairs of discharge rollers 71 and 72. Furthermore, guide roller 75 has a preferably small diameter and may be located close to head 60 so as to be capable of guiding a warped sheet of paper more accurately. Guide roller 75 is preferably formed of a water-repellent plastic and, as shown in FIG. 2, may be positioned essentially in the middle of a thick paper, such as an envelope.

As shown in FIG. 2, discharge portion 80 includes a roller 83 for pushing the center of a paper downwards, a slider 84 which will be discussed below, and support portions 81 and 82 which support from below, respective side portions of a paper discharged by pairs of discharge rollers 71 and 72. Support portion 81 is preferably a fixed rib and integrally formed in regulating member 50. A support portion 82 is mounted on slider 84 and is slidable in a direction perpendicular (along the width) of the paper feed path, and is constructed to be rotatable in a first direction and a second direction in the opposite direction.

It is therefore clear that as paper P is supplied from automatic paper feeder apparatus 20 and passes through concavely curved paper feed path PP and reaches paper feed roller 30, the feeding angle is regulated by means of pinch roller 40, and it is fed through paper feed roller 30. The leading edge of paper P is guided by regulating member 50 which also functions as a guide member. By the rear surface Pb of paper P being guided while abutting the top surfaces of ribs 51*a* formed on the upper surface of regulating member 50, the gap between the surface of the paper P and head 60 is regulated, and ink is discharged from head 60 onto the top surface Pa of paper P, and printing is carried out. The printed paper P passes through the pair of discharge rollers 71 and 72 and discharge portion 80, and is discharged onto discharge tray 90.

Figure 5:
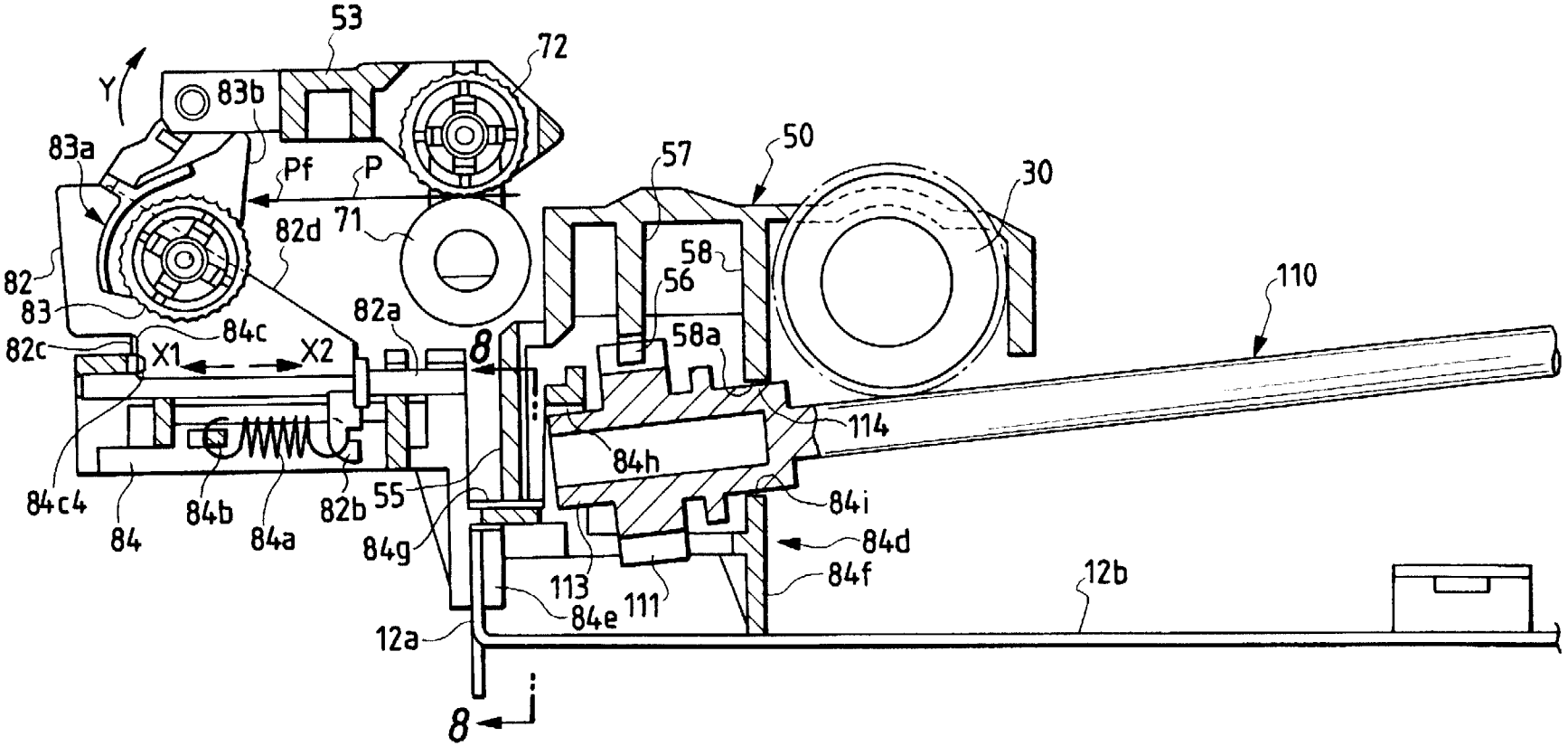
FIG. 5 is an enlarged fragmented sectional view of the printer depicted in FIG. 1.
Figure 6:
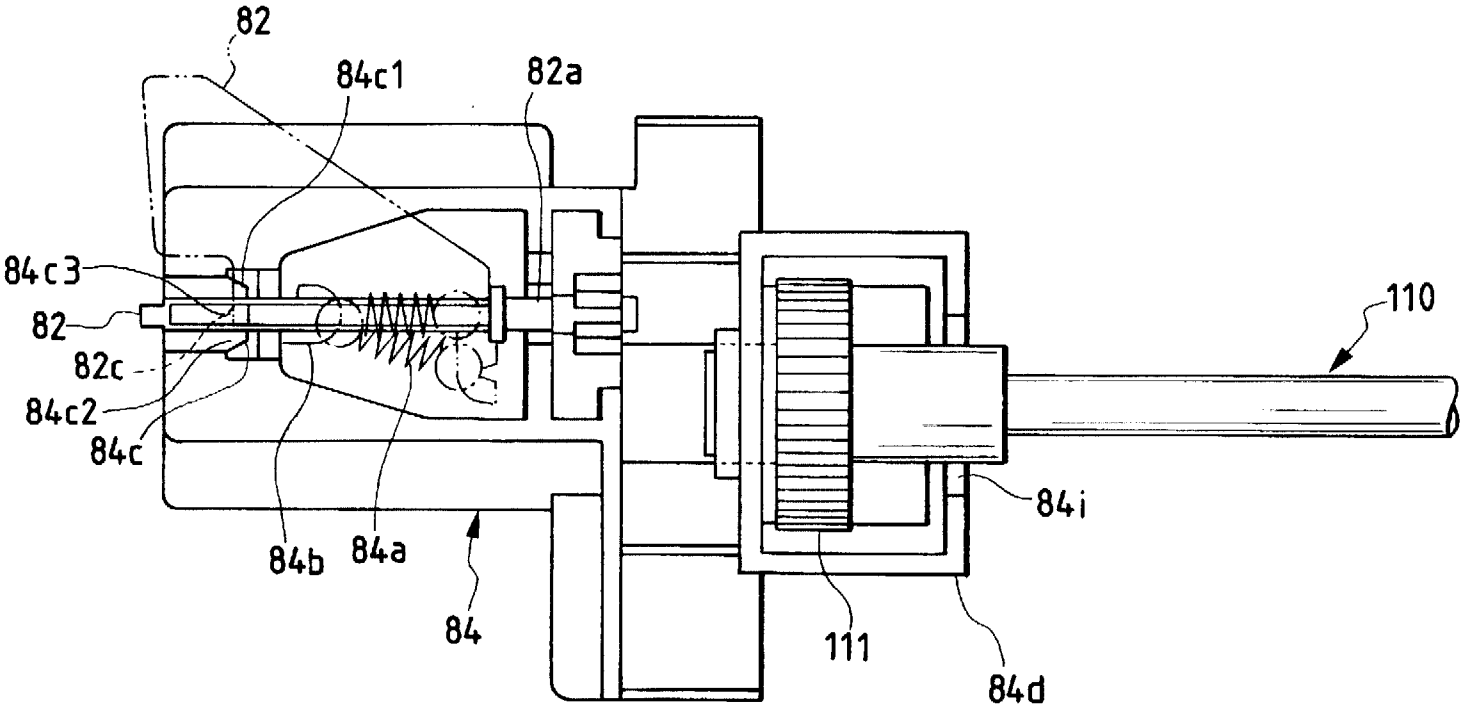
FIG. 6 is an enlarged plan view of a portion of the printer depicted in FIG. 5, particularly illustrating the supporting portion.
Figure 7:
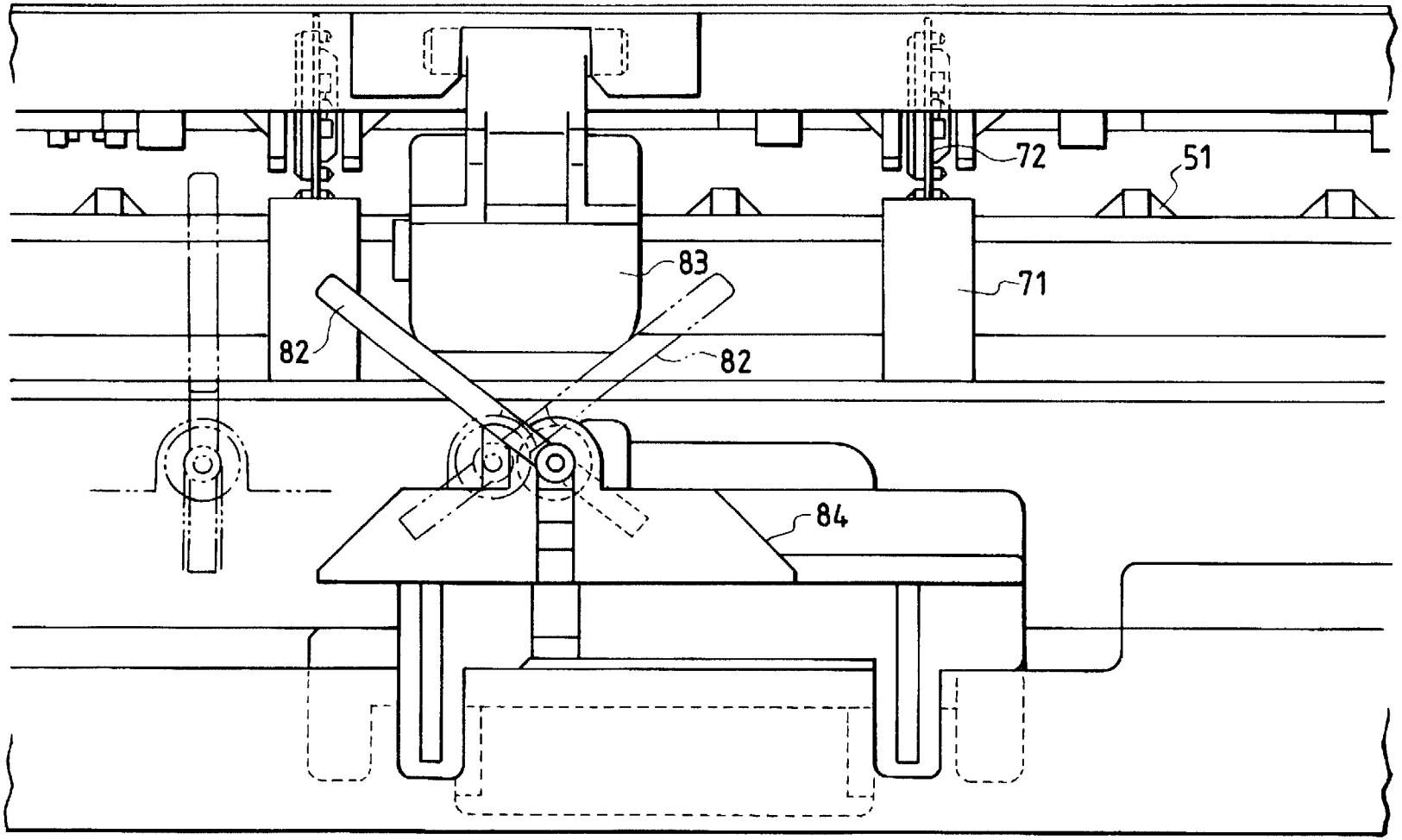
FIG. 7 is an enlarged elevational view of a portion of the printer of FIG. 1, showing movement of the supporting portion in phantom.

Reference is now made to FIGS. 5–7 which depict discharge portion 80 in greater detail. Shaft 82*a* is integrally formed with support portion 82, and is capable of both rotation and displacement in both the forward and backward direction (in the direction of arrows X1 and X2) in FIG. 5. A hook 82*b* is provided integrally in a lower portion of shaft 82*a* and a hook 84*b* is provided in slider 84. An energizing member constructed of a pull-spring 84*a* is provided between hook 82*b* and hook 84*b*. Pull-spring 84*a* forces support portion 82 in the direction of arrow X1 and also urges support portion 82 in an upright position as will be discussed below.

A detent or retaining portion 84*c* is formed in the front portion of slider 84, and a lower portion 82*c* of support portion 82 is removed from the detent by a clicking operation with respect to detent portion 84*c*.

As shown in FIG. 6, detent portion 84*c* has two protruding portions 84*c*1 and 84*c*2 and one recess portion, 84*c*3. When the lower portion 82*c* of support portion 82 engages with recess portion 84*c*3 of detent portion 84*c*, support portion 82 stands upright in the same way as support portion 81. When a threshold force is applied to the upper portion from either a right or a left direction, lower portion 82*c* is displaced from recess portion 84*c*3 of detent portion 84*c*, and at the same time, while moving in the direction of arrow X2 (FIG. 5), shaft 82*a* rotates either to the left or right. The condition where support portion 82 has fallen in a first direction, (to the left as viewed in FIG. 2) is indicated by the chain line in FIGS. 2 and 6. The condition where support portion 82 has fallen in the opposite direction is indicated by the chain lines in FIG. 7.

When support portion 82 falls beyond a constant angle, because the lower portion 82*c* abuts the lower surface 84*c*4 (see FIG. 5) of detent portion 84*c*, the prone condition of support portion 82 is maintained. That is, detent portion 84*c* also forms the retaining portion of support portion 82. When support portion 82 falls in the first direction, it is held by the lower surface of protruding portion 84*c*1, when it falls in the opposite direction, it is held by the lower surface of protruding portion 84*c*2.

Furthermore, if the prone support portion 82 is urged upright by a finger of a user, for example, support portion 82 will stand upright by the spring force of pull-spring 84*a*, and lower portion 82*c* will engage with portion 84*c*3 of detent portion 84*c*, so that the raised condition of support portion 82 is maintained. In the present embodiment, the condition where support portion 82 is raised is a supporting position where the side portions of a paper are supported from below. The prone condition is a non-supporting position where the side portions of a paper are not supported by support portion 82.

As depicted in FIG. 5, slider 84 is slidably mounted to lower portion frame 12. Slider 84 includes a base portion 84*d* in the rear portion thereof, fitting portions 84*e* which are slidably mounted onto bent portion 12*a* in the front portion of lower portion frame 12, and a leg portion 84*f* formed in base portion 84*b* and guided by the top surface 12*b* of lower portion frame 12. Slider 84 is slidably supported with respect to lower portion frame 12 by fitting portions 84*e* and leg portion 84*f*. An upper surface 84*g* of base portion 84*d* is slidably supported in the lower surface of a front plate 55 of regulating member 50.

Sliding support portion 82 is operatively linked to edge guide 23 of automatic paper feeder apparatus 20 by a linking mechanism. The linking mechanism includes a linkage rod 110, a first pinion 111 integrally formed at one end (support portion side) of linkage rod 110, a second pinion 112 integrally formed at a second end (edge guide side) of linkage rod 110. A first rack 56 is formed on a lower surface of hanging piece 57 of regulating member 50 for engagement with first pinion 111. A second rack 16*f* (FIG. 1) is formed in the rear portion lower surface of sub frame 16 and engages with second pinion 112.

Figure 8:
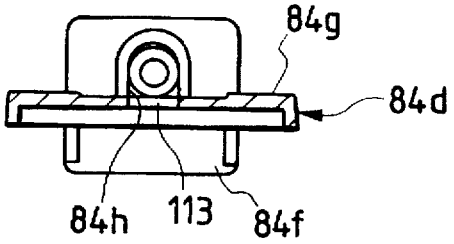
FIG. 8 is a sectional view taken along line 8—8 of FIG. 5.

As shown in FIGS. 5 and 8, a linkage rod leading end 113 which is the front portion of first pinion 111 is rotatably supported in a shaft reception hole 84*h* formed in base portion 84*d* of slider 84. That is, a rear portion 114 of first pinion 111 is rotatably supported by a rear portion upper surface 84*i* of base portion 84*d* and a lower surface 58*a* of hanging piece 58 of regulating member 50. The rear portion 114 of first pinion 111 is slidable with respect to lower surface 58*a* of hanging piece 58 of regulating member 50 in a direction perpendicular to FIG. 5.

Figure 9:
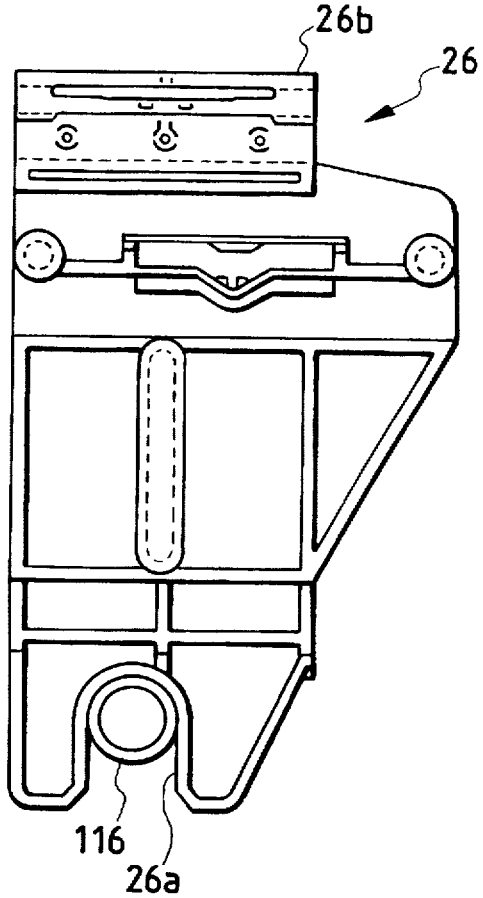
FIG. 9 is a rear elevational view of a connection plate constructed in accordance with the present invention.

As further shown in FIG. 1, a rear end 115 of linkage rod 110 is rollably supported by a lower portion of a bent portion 16*g* of sub frame 16 back plate 16*b*. Rear end 115 of linkage rod 110 is movable by the engaging force of second pinion 112 and second rack 16*f*. Next, as shown in detail in FIG. 9, a recess portion 26*a* is formed in a lower portion of connecting plate 26. A rear portion 116 of second pinion 112 is rotatably supported within recess portion 26*a*. In this way, the rear portion of linkage rod 110 is rotatably connected to edge guide 23.

Specifically, upper portion 26*b* of connecting plate 26 is coupled to edge guide 23 and moves together therewith. Therefore, when paper is set in automatic paper feeder apparatus 20, edge guide 23 being mounted on hopper 22, and by second rack 16*f* engaging with second pinion 112 of linkage rod 110 and linkage rod 110 moving, and at the same time first rack 56 engaging with first pinion 111, the leading end 113 of linkage rod 110 does not receive any influence from the bending of linkage rod 110. That is, leading end 113 moves essentially the same distance as rear end 115, and slider 84 and support portion 82 moves the same distance as edge guide 23. In this way, support portion 82 is linked to edge guide 23 and moves the same distance as edge guide 23 (shown in chain line in FIG. 2). Accordingly, when edge guide 23 is slid, support portion 82 is slid and therefore it can be seen how the movement of edge guide 23 causes the movement of support portion 82. Accordingly, only one operation is required yet both the edge guide 23 and the support portion 82 have been properly aligned.

Support portion 82 is formed in a substantially triangular shape, and in the raised condition shown in FIGS. 1 and 5, has a guide surface 82*d* upwardly slanted following the direction of paper discharge. Furthermore, support portion 81 is also formed in a substantially triangular shape, and has a guide surface 81*d* (see FIG. 2) upwardly slanted following the direction of paper discharge. A holder 83*a* rotatably mounted to support plate 53 is provided and a serrated roller 83 is rotatably supported in holder 83*a*. Holder 83*a* has a guide blade 83*b* which abuts the leading edge of a paper P discharged by discharge rollers 71 and 72. When the leading edge of a paper abuts guide blade 83*b*, holder 83*a* is lifted up by the paper and while rotating in the direction of arrow Y in FIG. 5, the leading edge of the paper is pushed down by guide blade 83*b* and guided by serrated roller 83.

An ink jet printer, constructed in accordance with this first embodiment of the present invention, has the following advantages. First, the setting of the paper can be achieved merely by placing the paper in hopper 22 and paper feed tray 24. If it is desired to change the paper size (for example, changing from A4 paper to B5 paper), side plate 23*d* of edge guide 23 can slide to abut the left side edge of the changed paper. As disclosed above; support portion 82 of discharge portion 80 also slides with the sliding of edge guide 23 and a proper discharge operation (described later) can be automatically and reliably obtained.

Secondly, when the printer is operating, automatic paper feeder apparatus 20 operates and paper is conveyed to paper feed path PP. Once the paper reaches paper feed rollers 30, the angle of conveyance is regulated by pinch rollers 40 and the paper is properly fed out from paper feed rollers 30. Because of the aforementioned self aligning function of pinch rollers 40 and contact paper feed rollers 30, paper skewing can be prevented.

Figure 4:
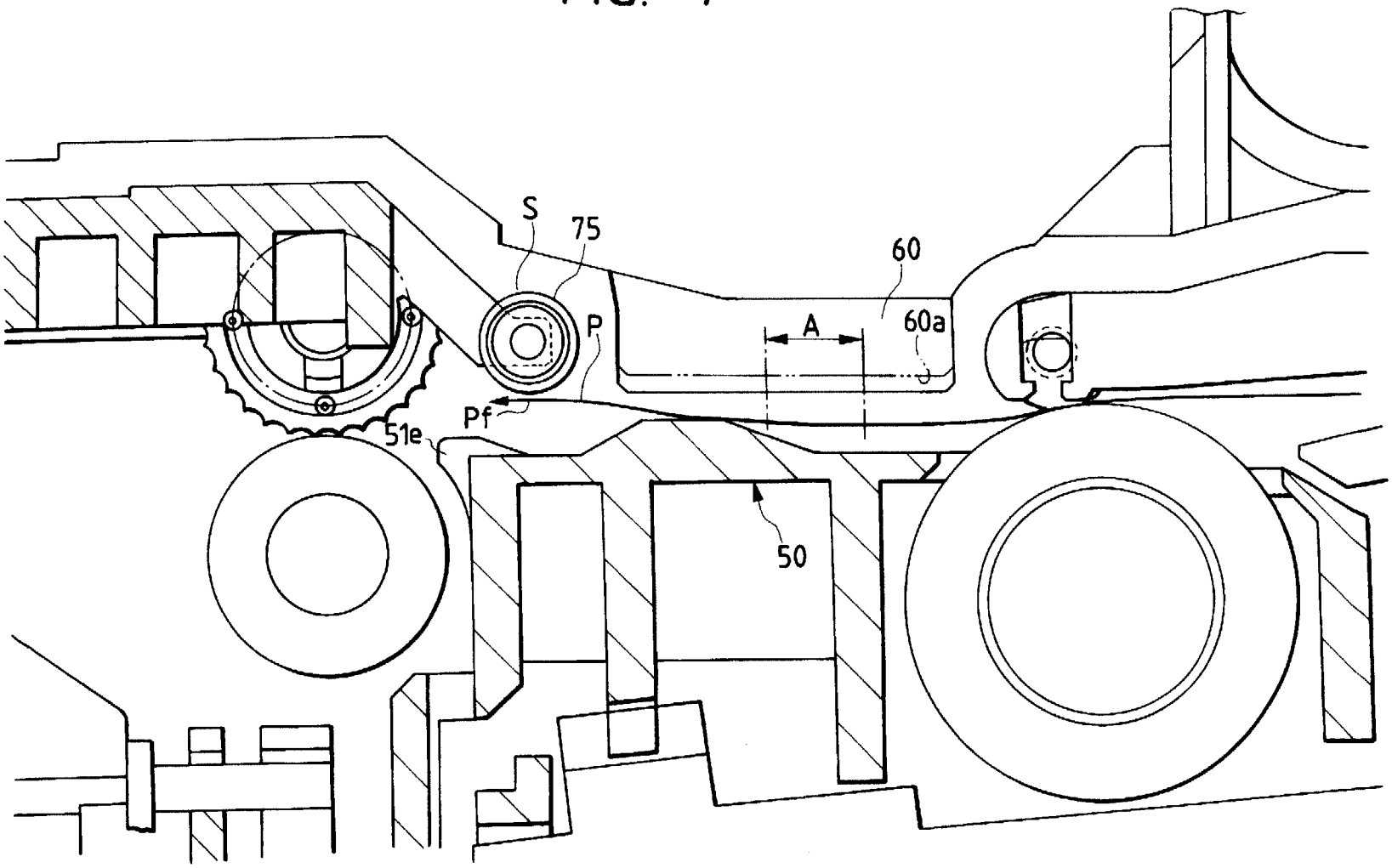
FIG. 4 is an enlarged sectional view of a portion of the ink jet printer of FIG. 1 illustrating a paper feeding operation.

Third, as shown in FIG. 3, the leading edge of paper P fed by paper feed roller 30 is guided and urged upwardly by slanting surface 51*b* of regulating member 50 while the gap between the surface of the paper and head 60 is regulated by the bottom surface Pb of paper P abutting the top surface 51*a* of rib 51. After the top front surface Pa of paper P is printed upon by ink being discharged from head 60, the leading edge Pf of paper P moves towards discharge rollers 71 and 72. As shown in FIG. 4, paper P may be badly warped, and because guide roller 75 is provided between head 60 and the pair of discharge rollers 71 and 72, paper P is more precisely re-directed towards pairs of discharge rollers 71 and 72. That is, even if paper P is warped, leading edge Pf of the paper is prevented from entering space S between head 60 and the pair of discharge rollers 71 and 72. Therefore, paper P does not contact head 60 and paper jamming does not occur.

Furthermore, when thick paper such as postcards or envelopes are to be printed upon, the position of head 60 is positioned upwardly as depicted by the chain line in FIG. 4. In this situation because the gap between the lower surface 60*a* (nozzle aperture surface, i.e. ink discharge surface) of head 60 and regulating member 50 becomes larger, their is a tendency that it becomes easier for the leading edge Pf of the paper to enter space S between head 60 and the pair of discharge rollers 71 and 72. However, the leading edge Pf of the paper is reliably prevented from entering space S between head 60 and the pair of discharge rollers 71 and 72 by guide roller 75.

Moreover, because paper feed path PP is a curved paper feed path, the size of the printer can be made smaller than a printer having a straight paper feed path. That is, by making paper feed path PP curved, the tendency for the leading edge Pf of the paper to easily enter space S between head 60 and the pair of discharge rollers 71 and 72 is encouraged, but in the printer described above, paper P is reliably directed towards the pair of discharge rollers 71 and 72 by guide roller 75.

Additionally, because the rear surface Pb of conveyed paper P abuts ribs 51 of regulating member 50, the gap between head 60 and paper P is regulated and printing is carried out without the possibility that paper jamming will occur.

In addition, since ribs 51 are elongated when viewed in the paper conveying direction, they do not disturb the conveyance of the paper. Because the plurality of ribs 51 are formed in a direction perpendicular to the direction of paper conveyance, even if high density ink dots are formed on paper P and the paper wrinkles due to the ink moisture content, ribs 51 accommodate the swelling of the paper into the spaces 51*s* between adjacent ribs 51 (see FIG. 10 C). Because of this construction, even if paper P wrinkles, the paper does not abut head 60 and ink smudging does not occur.

Figure 10A:
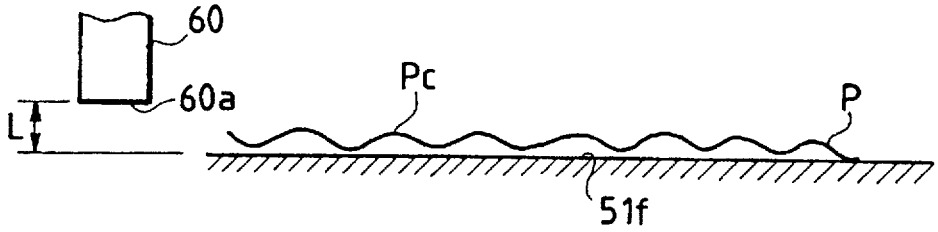
FIG. 10(a) PRIOR ART
FIGS. 10A and 10B are schematic views of warped paper passing beneath the printing section in accordance with the prior art.
Figure 10B:
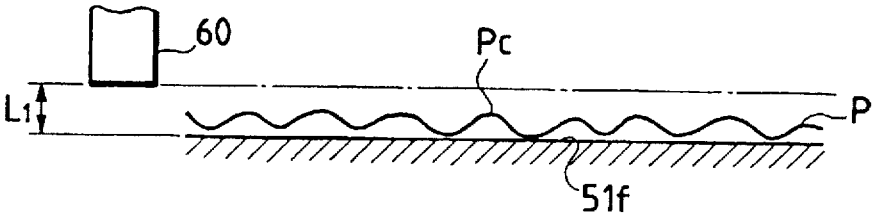
FIG. 10(b) PRIOR ART
Figure 10C:
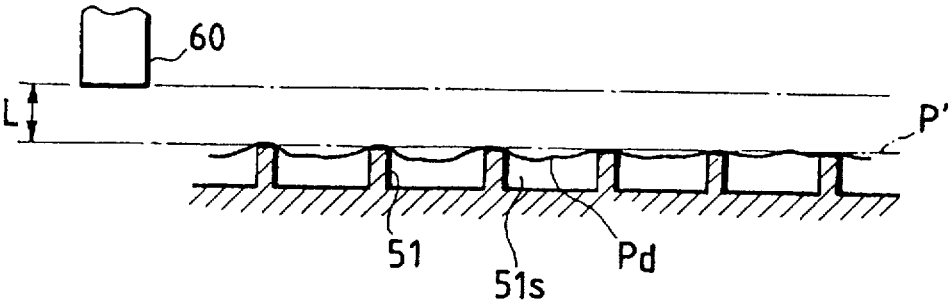
FIG. 10C is a schematic view of paper passing between the printing section and a regulating member constructed in accordance with the present invention.

More particularly, as depicted in FIGS 10A–10C, the distance L is the ideal gap distance between head 60 and a sheet of paper P that has not wrinkled. Paper P moves across flat surface 51*f* of regulating member 50. Where the gap between paper P and head 60 is the ideal gap L, when paper P wrinkles due to the ink moisture content thereon, the protruding portions Pc of wrinkled paper P and the ink discharge surface 60*a* of head 60 will contact each other.

One contemplated method to solve this problem, as shown in FIG. 10B is to provide, a gap L1 between flat surface 51*f* and head 60 that is larger than the aforementioned gap L. However, as gap L1 is made larger, if the paper is not wrinkled and is in a flat condition, the distance between the paper guided by flat surface 51*f* and the head 60 (that is, roughly the distance L1) is too large, and another problem occurs in that the ideal printing gap cannot be obtained. If the distance the ink drops discharged from head 60 must travel to strike the surface of the paper is too large, the margin for error between the ideal striking point and the actual striking point on the paper increases.

To overcome this problem, extending ribs 51 extend from surface 51F as depicted in FIG. 10C. In the situation where the ink density is comparatively small, that is, where the paper does not wrinkle, paper P' is in a flat condition and is guided by the upper surface of ribs 51 and the distance between the paper P' and head 60 can be set at the aforementioned ideal distance L. In the case where ink dots are formed on the paper at high density and the paper wrinkles due to the ink moisture content therein, the paper may swell causing trough portions Pd. These trough portions Pd are accommodated into the spaces 51*s* between adjacent ribs 51. Therefore, even if paper P' wrinkles, the protruding portions Pc (FIG. 10B) will not abut head 60 thereby reducing the possibility of ink smudging.

Figure 11A:
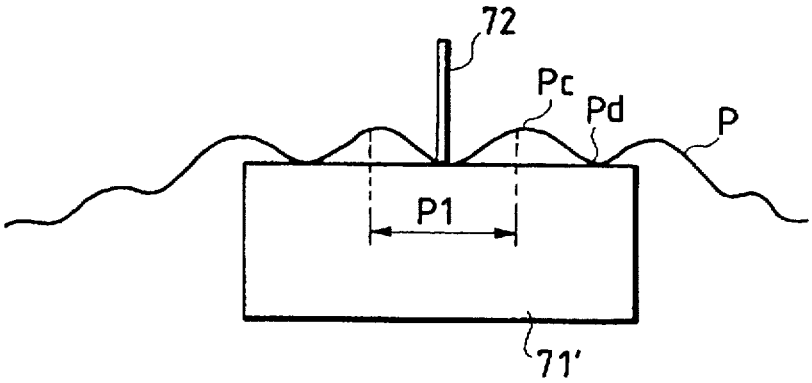
FIGS. 11A and 11B are schematic views showing operation of various paper discharge rollers.
Figure 11B:
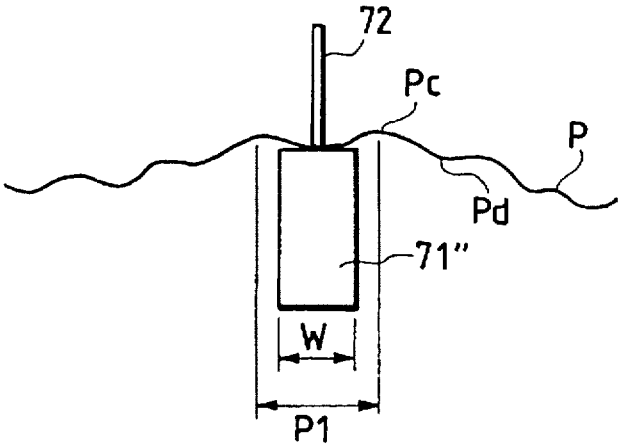

Reference is now made to FIGS. 11A and 11B. Among each roller 71 of the pair of rollers 71 and 72, it is preferable that downwardly extending rubber roller 71 is not a long round rod-shaped roller (such as roller 71'), but rather a plurality of narrow rollers arranged along the width of the paper path. If rollers 71 are narrow in width, even if there is wrinkling and swelling of a paper to create trough portions Pd from, for example, a high ink moisture content, the paper will feed much more effectively if the trough portions Pd can hang over the edges of rollers 71. For example and as illustrated in FIG. 11B, it is desirable that the width of rubber rollers 71 be set as small as possible within a range that still permits accurate and reliable paper conveyance. An example of a preferably narrow roller is depicted in FIG. 11B as roller 71". The width W of the rubber roller 71" is narrower than the wave pitch P1 of the wrinkled paper. In a preferred embodiment, the width of roller 71" is approximately 5 mm. With this construction, the trough portions Pd of wrinkled paper P can hang over the edges of roller 71 ". On the other hand, it is undesirable to have the roller construction depicted in FIG. 11A which illustrates a long roller 71'. In this situation, the trough portion Pd of the wrinkled paper P will rest on roller 71'. Therefore, even if serrated roller 72 attempts to urge paper P downward, protruding portion Pc will remain in a raised condition.

Another advantage of the present invention, is that when paper P contacts discharge rollers 71 and 72, paper P is placed in a taut condition between paper feed rollers 30 and the pairs of discharge rollers 71 and 72 because of the aforementioned rotational speed differential between rollers 71 and 72 and paper feed rollers 30. When high density ink dots are formed on paper P, even if the paper wrinkles due to the ink moisture content, the swelling of the paper is reduced due to the tension force within paper P and a more reliable printing operation is achieved. Yet further, as regulating member 50 urges paper P towards the ink jet head side and abuts the rear surface Pb of paper P, the swelling of paper P is positioned a sufficient distance away from head 60. Because of this, even if the paper has wrinkled, the paper does not contact head 60 and the likelihood of ink smearing is greatly reduced. Moreover, in the above-mentioned fashion, as the swelling of the paper is accommodated into the spaces 51*s* between adjacent ribs 51, the contacting of wrinkled paper and head 60 and subsequent ink smudging is more reliably prevented.

Figure 12A:
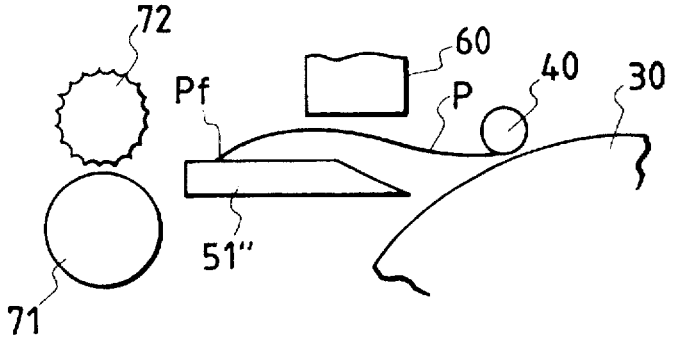
FIG. 12(a) PRIOR ART
FIG. 12A is a schematic view of a rib member constructed in accordance with the prior art.
Figure 12B:
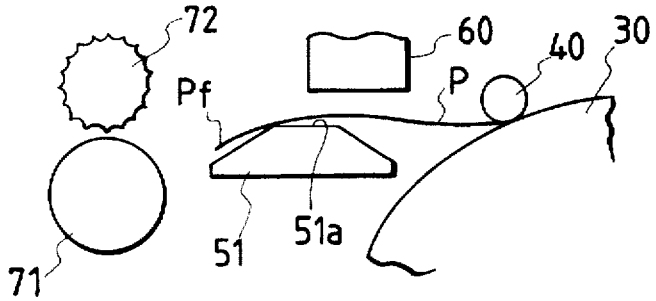
FIG. 12B is a schematic elevational view illustrating a rib member constructed in accordance with the present invention.

Reference is now made to FIGS. 12A, 12B in connection with the following disclosure to highlight the following beneficial operational effects obtained by the construction of ribs 51 in a substantially trapezoidal shape. First, in a serial printer that prints single lines upon sequentially receiving printing data for single lines, from a host computer for example, it is necessary to be able to feed paper in a reverse direction (that is, reverse feed), for example, when printing enlarged characters the printing region for these enlarged characters is larger than the region of the standard characters. Therefore, as the paper is fed in a reverse direction, the enlarged characters are printed by a method of divided printing with multiple passes, that is, by the head scanning and paper feeding the length of the printing region A shown in FIG. 3. In this situation, it is necessary to feed paper in a reverse direction to complete the printing of the enlarged characters. If ribs 51 did not have a trapezoidal shape when viewed from the side, but rather, for example, had a rectangular shape when viewed from the side (see FIG. 12 (A) rib 51"), if there was an obstruction during the reverse feeding operation on the rear surface of a paper (for example, an envelope flap), the edge of the paper P could become caught on the rib edge 51*a*" when reverse feeding, a pitch defect would develop, and an inaccurate printing operation would occur. That is, the necessary line distance of reverse feeding and the amount of paper fed immediately afterwards in a forward direction would be disrupted.

To overcome this problem, ribs 51 are preferably of a substantially trapezoidal shape when viewed from the side. Therefore, even if during a reverse feeding operation there is an obstruction such as a flap portion of an envelope, for example, the trapezoidal shape of the rib reduces any catching and consequently, pitch defects do not develop and a reliable paper feed operation is assured.

Secondly, when printing is carried out near leading edge Pf of paper P, the leading edge Pf may become curved. However, if ribs 51" are not trapezoidally shaped (as in FIG. 12A, rib 51") the leading edge Pf of the paper may rest upon the upper surface of ribs 51" leading up to the pairs of discharge rollers 71 and 72. The paper P will be raised in the area of head 60 and the possibility of ink smearing against head 60 increases.

To overcome this problem, because the ribs 51 in the present embodiment have a substantially trapezoidal shape when viewed from the side (as shown in FIG. 12B) the leading edge Pf of paper P soon moves away from the uppermost surface 51*a*, and as a consequence, the appearance of the paper floating is reduced and the possibility of ink smudging against head 60 is greatly reduced.

Moreover, regulating member 50 includes a guide portion 51*e* (FIG. 4) secured thereto for guiding the leading edge of paper P towards pairs of discharge rollers 71 and 72. Guide portion 51*e* is preferably positioned upstream of discharge rollers 71 and 72 and downstream of ribs 51 (relative to a forward paper conveying direction). Accordingly, even if ribs 51 were not formed with a substantially trapezoidal shape, the leading edge of paper P can be more reliably guided towards pairs of discharge rollers 71 and 72. Thus, providing guide portion 51*e* upstream of pairs of discharge rollers 71 and 72 in the paper conveyance direction and preferably not providing guide portion 51*e* in any other location, the leading edge of paper P is reliably guided towards pairs of discharge rollers 71 and 72 and abutting and smudging of paper P against head 60 is more reliably prevented.

Moreover, when a plurality of colors of ink is discharged from head 60 and color printing is performed, ink dots are formed on top of previously formed ink dots and the wrinkling in the paper may becomes particularly severe. However, because of the advantageous construction disclosed above, the possibility of abutting and ink smudging of the wrinkled paper P against head 60 is greatly reduced.

Reference is once again made to FIGS. 5, 14 and 15. Holder 83*a* is mounted and rotatably supported within discharge portion 80. Holder 83*a* includes guide blade 83*b* and serrated roller 83 rotatably mounted in holder 83*a*. Additionally, support portions 81 and 82 include respectively formed sloping faces 81*d* and 82*d* (see also FIG. 2). As paper P is discharged by pairs of discharge rollers 71 and 72, the leading edge Pf will abut guide blade 83*b*. The force of paper P against blade 83*b* will cause holder 83*a* to rotate in the direction indicated by arrow Y (FIG. 5). However, the leading edge P*f* of paper P is urged downwardly by guide blade 83*b* and is guided by serrated roller 83 through discharge portion 80.

At the same time, both side portions of the paper leading edge Pf are supported from below by sloping faces 81*d* and 82*d* of respective support portions 81 and 82. Therefore, the leading edge Pf is gradually guided upwards. Consequently, as paper P is gradually discharged, the leading edge Pf is urged into a hollow concave shape as shown in FIGS. 14 and 15.

Figure 14:
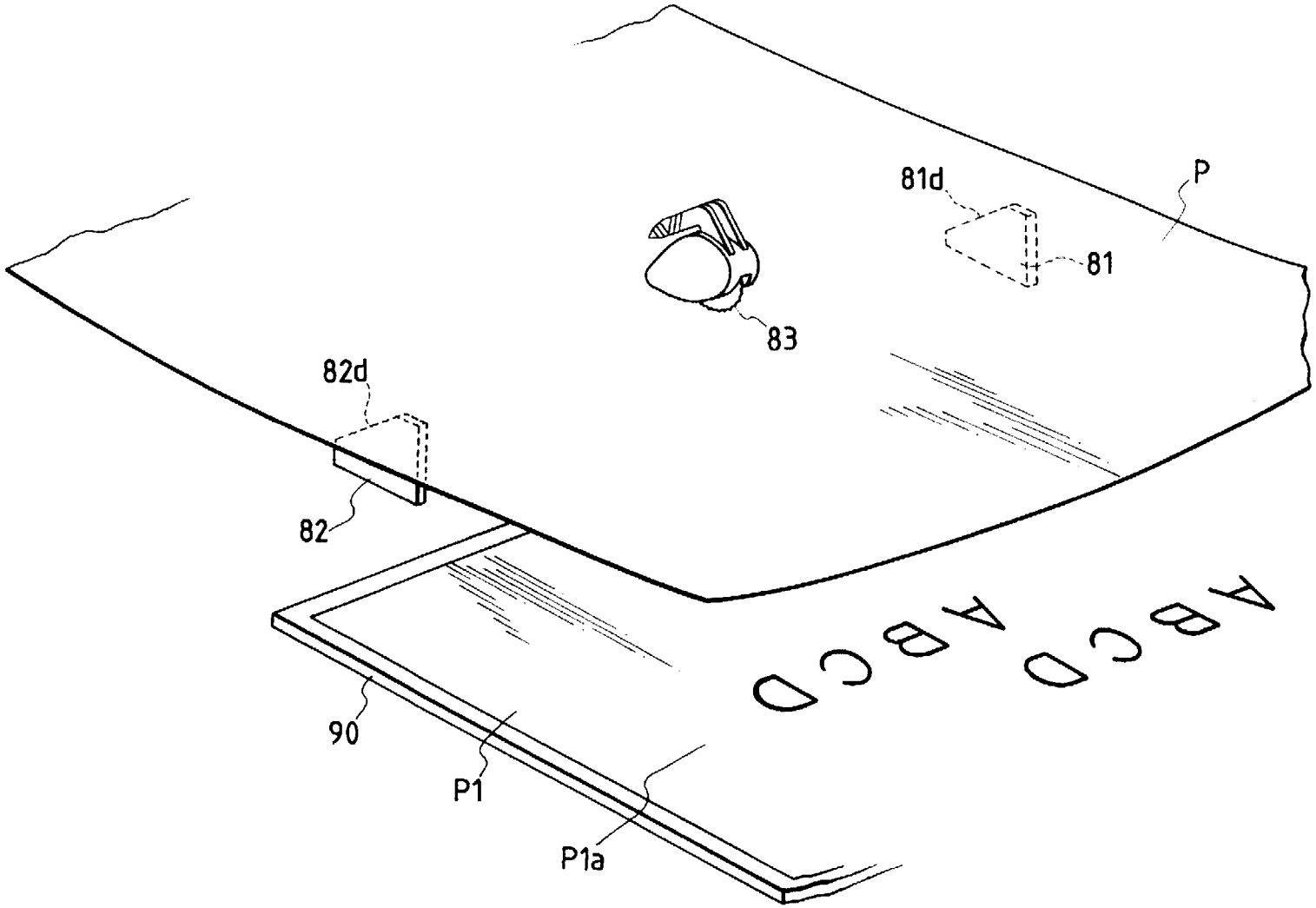
FIG. 14 is a perspective view of the paper discharge section in accordance with the present invention.

An example of paper P being discharged while it engages sloping faces 81*d* and 82*d* and serrated roller 83 is depicted in FIG. 14. When viewed in the discharging direction, as paper P is forcibly urged into a hollow concave shape, the paper becomes stiff, and it is fed in the discharging direction in what appears to be a floating state. Because of this, the time until discharged paper P slidably contacts a printed surface P1*a* of previously printed and discharged stacked paper P1 is delayed. This delay permits sufficient time for the ink of already printed paper P1 to dry.

As paper P is further transported in a discharging paper direction, its trailing edge passes pairs of discharge rollers 71 and 72. The paper P therefore loses its transporting force and the rear portion of the paper is maintained in its concave state by means of discharge portion 80 and, specifically, by support positions 81 and 82 and holder 83*a*.

Figure 15:
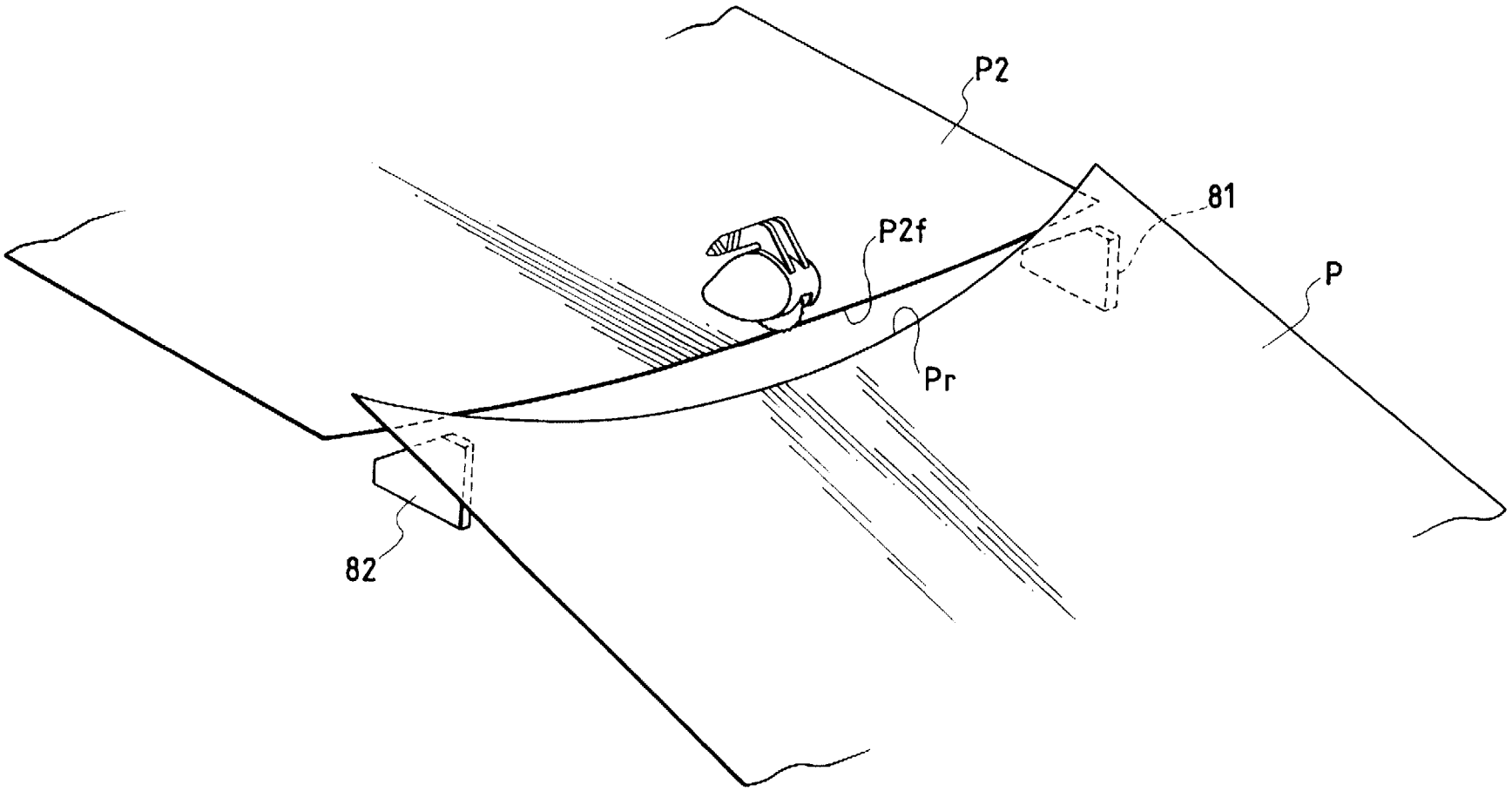
FIG. 15 is a perspective view of the paper discharge section during a paper discharge operation.

As shown in FIG. 15, as a subsequent sheet of paper P2 is printed upon and its leading edge P2f passes discharge rollers 71 and 72, by contacting the trailing edge P*r* of a previous sheet of paper P, the hold on the previous paper P by discharge portion 80 is released when it is pushed by following paper P2. As the hold on previous paper P by discharge portion 80 is released, it is stacked on top of a previous already printed paper (P1 in FIG. 14). However, by the advantageous construction of discharge portion 80, the time until paper P contracts paper P1 is further delayed and sufficient time has elapsed for the ink on paper P1 to dry. The concavity of paper P allows paper P2 to easily and reliably contact the rear edge Pr of paper P. If paper P did not have any concavity, it would be very difficult to ensure that front edge P2*f* could contact rear edge Pr of paper P.

After leading edge P2*f* of paper P2 contacts trailing edge Pr of paper P and the contact of paper P with support portions 81, 82 and serrated roller 83 is released, forward conveyance of paper P2 is momentarily stopped. This stopping operation can be performed by the counting of pulses of the motor (not shown) which drives pairs of discharge rollers 71 and 72. When the desired number of pulses has reached the predetermined number, the motor drive mechanism can be restarted and paper P2 can continue to be fed through discharge portion 80. By adopting a pushing-out method that includes momentarily stopping paper P2 from being further discharged as paper P is being stacked upon previous printed sheets of paper, and where leading edge P2*f* of paper P2 contacts trailing edge Pr of paper P when paper P is in a concave state, leading edge P2*f* of following paper P2 and trailing edge Pr of previous paper P can reliably engage each other and the paper stacking operation (dropping operation) of previous paper P on the previous already printed paper P1 (see FIG. 14) becomes very reliable. Without an operation where paper P2 is momentarily stopped, the stacking operation and reliability that the ink will be sufficiently dry may become less reliable.

Support portion 82 is constructed so that it is capable of rotation between a first non support condition and a second non support condition. In a preferred embodiment support portion 82 can rotate through at least 180°. Accordingly, when support portion 82 is slid, if there is an obstruction in the sliding direction which contacts support portion 82, the possibility of support portion 82 suffering damage is reduced. In particular, when holder 83*a* (which pushes the central portion of a paper downwards) is provided and support portion 82 is slid, support portion 82 may collide with holder 83*a*. However, neither support portion 82 nor holder 83*a* will suffer damage because contact will cause support portion 82 to rotate. Moreover, when the printer is not being used, for example, support portion 82 can assume a prone state because of the ability of support portion 82 to rotate.

Furthermore, as support portion 82 is always urged in an upright condition by pull spring 84*a*, even if an external force operates on the support portion 82 and it rotates, if it does not rotate beyond a certain angle so as to be restricted by retaining portion 84*c*, when the external force is released, support portion 82 will return to its upright condition. Consequently, at the same time as preventing damage to support portion 82, a raised state is automatically obtained when no external force is operating, and the above described discharge operation is reliably obtained.

In the aforementioned paper discharge operation, it is desirable to be able to vary the paper size (for example changing from A4 paper to B5 paper), in order to reliably guide both sides of the paper by support portions 81 and 82. Accordingly, it is necessary that support portion 82 be able to be adjusted to correspond to the paper size. Accordingly, when the desired paper is set in automatic paper feeder apparatus 20, side plate 23*d* of edge guide 23 slides to abut the left side edge of the changed paper, and support portion 82 of discharge portion 80 also slides in the manner disclosed above with respect to the linking mechanism. Consequently, the need to manually and separately slide both edge guide 23 and support portion 82 is eliminated, thus increasing the likelihood that a proper discharge operation can always be obtained since the support portions 81 and 82 will always be properly aligned.

Moreover, when setting paper in the paper feeder apparatus, the user performs a sliding operation while mainly watching the edge guide and the user may not notice the fact that the support portion 82 may collide with holder 83*a*. However, even if support portion 82 collides with holder 83*a*, because support portion 82 can rotate, no damage is suffered by either support portion 82 or holder 83*a* because holder 83*a* rotates support portion 82 into a prone position upon contact between the two.

For example, printing may be desired on small-size envelopes or postcards. As depicted in FIG. 2 edge guide 23 (as shown by the chain line) is shifted to a position close to side plate 16*c*' of sub frame 16 which forms the second and opposing edge guide. When edge guide 23 is slid from its position shown by the solid line in FIG. 2 to the position shown by the chain line, support portion 82 passes holder 83*a*. However, because support portion 82 has the previously described rotatable construction, when support portion 82 passes holder 83*a*, as shown in the solid line in FIG. 7, support portion 82 will rotate when it contacts therewith and if rotated beyond a desired angle will be held in place by detent portion 84*c*. Consequently support portion 82 does not suffer any damage and is maintained in the prone position if desired.

In particular, in a printer constructed in accordance with the present invention, paper feeder apparatus 20 is provided in the rear top surface of printer body 10 and discharge portion 80 is provided in the front lower surface. Therefore, edge guide 23 of paper feeder apparatus 20 and support portion 82 of discharge section 80 are positioned at a great distance from each other. When setting paper in the paper feeder apparatus 20, as the user performs a sliding operation while mainly watching the edge guide, they do not generally notice that support portion 82 may collide with the holder 83*a*. However, according to the present invention as described above, even if support portion 82 collides with holder 83*a*, because support portion 82 can rotate, no damage is suffered by either support portion 82 or holder 83*a*.

Figure 16:
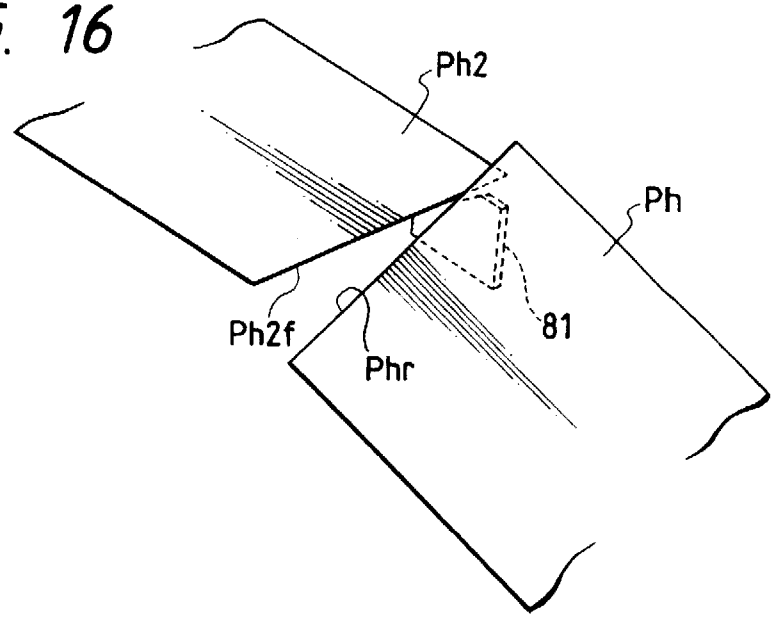
FIG. 16 is a perspective view of the paper discharge section during a paper feeding operation.

Reference is now also made to FIG. 16. In the printer of the present embodiment, when printing narrow paper Ph such as postcards, support portion 82 is in a prone condition. Therefore, in the discharge operation, paper Ph is discharged while being supported only by support portion 81. This is advantageous with paper having a narrow width, especially comparatively thick paper such as small-size envelopes and postcards. For example, and as shown in FIG. 15, if a sheet of thick paper (such as a postcard) was discharged while each side of the paper was supported by support portions 81 and 82, respectively, it would be difficult to obtain a curved condition of the paper, and a reliable pushing out effect of the preceding paper by a subsequent sheet of paper could not be reliably obtained since the edges of the paper would have to essentially align which practically is very difficult.

Accordingly, as is depicted in FIG. 16, paper such as postcards are supported only by support portion 81 on one side of the paper. With only one side being supported, the leading edge Ph2*f* of paper Ph reliably abuts the trailing edge Phr of a previous sheet of paper. Accordingly, as depicted in FIG. 2, when edge guide 23 is slid from a first position (shown by the solid line in FIG. 2) to a second position (shown by the chain line in FIG. 2) and support portion 82 passes pushing-down portion 83, as pushing-down portion 83 is automatically knocked down (as shown by the solid line in FIG. 7) the above described condition where only one side of a sheet of paper is supported by support portion 81 is reliably obtained automatically. Therefore, the possibility of damage to support portion 82 is greatly reduced and a proper discharge operation for paper such as postcards is automatically obtained. Furthermore, support portion 82 will be maintained in the prone position by retaining portion 84*c* which will prevent support portion 82 from inadvertently returning to an upright supporting position thereby negatively affecting the discharge operation.

Figure 17:
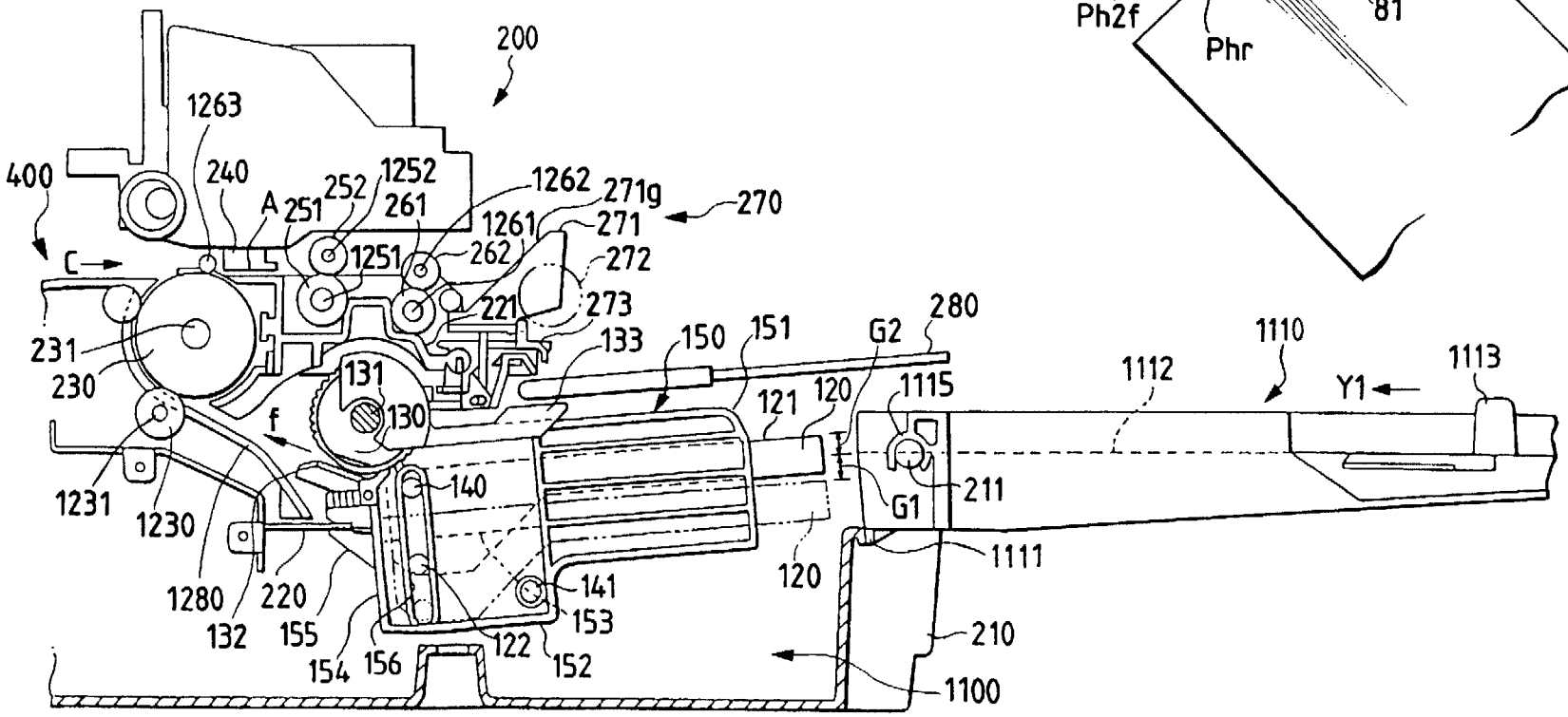
FIG. 17 is an elevational side view of an ink jet printer constructed in accordance with a second embodiment of the present invention.
Figure 18:
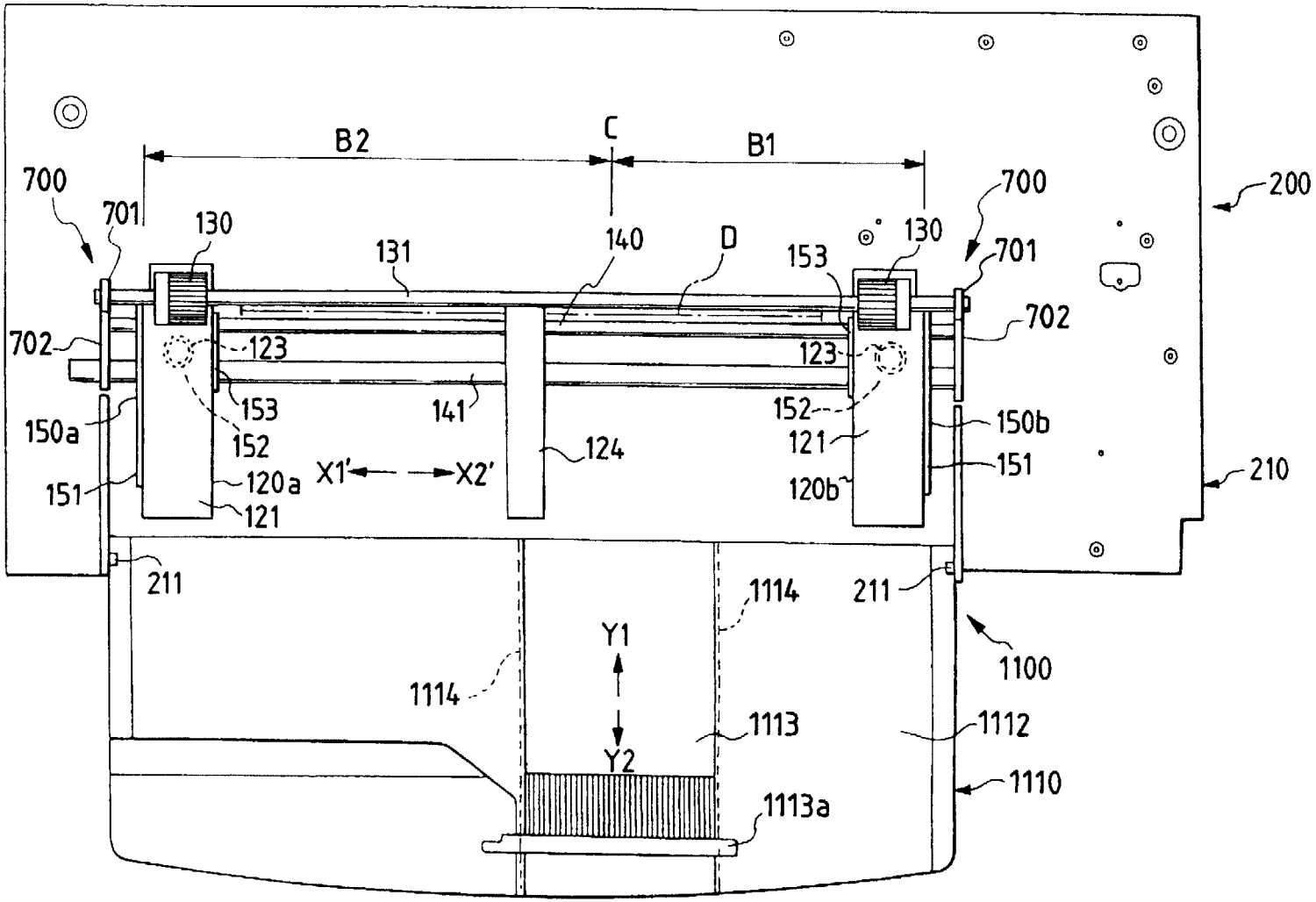
FIG. 18 is a top plan view of the ink jet printer depicted in FIG. 17.

Reference is now made to FIGS. 17 and 18 which depict a printer, which, for example, may be an ink jet printer, constructed in accordance with a second embodiment of the present invention. A paper feeder apparatus, generally indicated at 1100, is constructed in accordance with the present invention. Also depicted is a main body of a printer, generally indicated at 200, which includes a printer case 210, constructed in accordance with the present invention. As stated above, printer 200 can be an ink jet printer. However, the invention is applicable to any printing device requiring individual paper sheet feeding.

Paper feeder apparatus 1100, mounted in case 210, may include a sheet support, generally indicated at 1110, hoppers 120*a*, 120*b* and a pair of sheet feed rollers 130. Sheet support 1110 includes a top surface 1112 for supporting the bottom surface of a sheet of paper P mounted on sheet support 1110. A guide groove 1114 is provided on sheet support 1110 on which a retaining plate 1113 having a rear mounting paper retaining bar 1113*a* is slidably mounted. In this way, retaining plate 1113 can slide along top surface 1112 of sheet support 1110 in the directions indicated by arrows Y1, Y2 (FIG. 18). Retaining plate 1113 contacts and supports a rear edge of sheet P so that sheet P cannot slide any further backward than permitted by retaining plate 1113. A lock mechanism may be provided to prevent retaining plate 1113 from inadvertently or undesirably sliding along guide groove 1114 once retaining plate 1113 is placed in its desired position. The sliding resistance of retaining plate 1113 is preferably set so retaining plate 1113 cannot be displaced by an extending force acting on sheet P when sheet feeder assembly 1100 is operated as discussed below.

Sheet support 1110 may include a projecting portion (not shown) under retaining plate 1113. The area between guide grooves 1114 can deform elastically and have a function of a spring offering force to urge the projecting portion against the bottom of retaining plate 1113. Retaining plate 1113 slides over the projecting portion. The pressing of a portion of sheet support 1110 against the projection portion causes a friction brake to be produced.

Pins 211 are formed on printer case 210. Mounted on each side of sheet support 1110 is a C-shaped latch 1115 which receives a respective pin 211, so that sheet support 1110 is rotatably and detachably mounted on printer case 210. A rotation restraint 1111 is mounted on the bottom surface of sheet support 1110 for restricting the rotation of sheet support 1110 relative to printer case 210. With sheet support 1110 mounted on pins 211, rotation restraint 1111 of sheet support 1110 can contact and rest against an edge of printer case 210 so as to restrict the rotation of sheet support 1110 relative to printer case 210.

Main body 200 includes a frame 220, preferably made of metal. A support rod 141 is supported by a side frame (not shown) of main body 200.

As depicted in FIG. 17, a printing and feeding assembly 400 is mounted within printer main body 200 and includes a plurality of roller shafts and rollers for conveying a sheet of paper therethrough. Specifically, printing and feeding assembly 400 includes a sheet conveyance roller shaft 231 mounted in printer case 210 and a sheet conveyance roller 230 for conveying a sheet of paper in the direction indicated by arrow f to the printing section A rotatably mounted thereon. A roller shaft 1231 is mounted in printer case 210, and a roller 1230 for assisting the conveyance of the sheet of paper to the printing section is rotatably mounted thereon. A sheet guide plate 1280 is also provided within printer body 200 for guiding the sheet of paper to rollers 1230 and 220. The sheet of paper is fed between sheet conveyance roller 230 and roller 1230. A print section A is provided within printer main body 200. A printing head 240, which may be an ink jet head is mounted in printer case 210 and provides ink to the sheet of paper fed therethrough. Roller shafts 1251 and 1252 are mounted in printer case 210, and a pair of conveyance rollers 251, 252 are respectively rotatably mounted thereon downstream of print section A for conveying the sheet of paper as the step of printing thereon is being completed. A pair of sheet discharge roller shafts 1261, 1262 are mounted in printer case 210, and a pair of sheet discharge rollers 261, 262 are rotatably mounted thereon for discharging the sheet of paper through a discharge section 270 and onto a sheet discharge tray 280 which may be arranged in an upper portion of the below described hoppers.

A hopper support rod 140 is supported on a support member (not shown) of printer 200 so that hopper support rod 140 can be movable between at least two positions in a vertical direction as depicted in FIG.17. Sheet feed assembly 100 also includes two hoppers **120*a* and 120*b* which are provided within printer case 210. Each hopper 120*a* and 120*b* includes an elongated aperture 156 through which hopper support rod 140 is slidably inserted. Hoppers 120*a*, 120*b* are slidably mounted along rod 140**.

Reference will now be made to hopper **120*a* although it is to be understood that hopper 120*b* is a mirror construction of hopper 120*a* so that, for simplicity of description, like reference numerals used to describe features and structures associated with hopper 120*a* will be used to describe features and structures used in connection with hopper 120*b***.

Hopper **120*a* includes a top surface 121 for supporting a portion of the sheet of paper as it rests thereon or passes thereover. Hopper 120*a* includes an edge guide assembly, generally indicated at 150*a*. Edge guide assembly 150*a* includes an outer plate 151 for guiding the outer side edge of paper P, a bottom plate 152 which may be integrally formed with and laterally depending from outer plate 151, an inner plate 153 which may vertically extend from bottom plate 152 and a front plate 154 integrally formed and vertically extending from bottom plate 152. A beak-shaped support portion 155 is mounted on a front surface of front plate 154 and is slidably supported by frame 220. Outer plate 151 and inner plate 153 are slidably mounted on and supported by support rod 141. The inner surfaces of outer plate 151 and inner plate 153 may lightly engage the sides of hopper 120*a*. Each edge guide assembly 150*a*, 150*b* and hopper 120*a*, 120*b* can slide together in the transverse direction (arrows X1', X2') as illustrated in FIG. 18**.

In the preferred embodiment, a sheet feed roller shaft 131 is rotatably mounted in printer main body 200. Sheet feed roller shaft 131 is preferably rotatably supported by the side frame of main body 200 via a bearing and driven by a drive mechanism (not shown) provided in main body 200 during the sheet feeding operation. Sheet feed roller 130 is mounted on shaft 131 and rotates therewith. In a preferred embodiment, sheet feed roller 130 is a D-type roller having the grooved surface thereof covered with a layer of rubber-like material. A dividing pad 132 is provided at the front portion of edge guide assembly **150*a* and 150*b* and is urged towards sheet feed roller 130 by an urging spring 132'. A pushing mechanism 700 which is engageable with each hopper 120*a* and 120*b*, as discussed below, is mechanically coupled with the mechanism for driving sheet feed roller 130. Moreover, a paper feed roller cover 133 (as described in greater detail below), can engage edge guide assembly 150*a* and slide together with sheet feed rollers 130**.

An elongated aperture 156 is formed on outer plate 151 of edge guide assembly **150*a* and 150*b*. As stated above, support rod 140 is inserted into elongated aperture 156 to permit support rod 140 to slide in the vertical direction therein. A pin 122 extends outwardly from the sides of each hopper 120*a* and 120*b* and is disposed in elongated aperture 156 so that pin 122 can slide in the vertical direction therein. In this way, hopper 120*a* and 120*b* can slide in the vertical direction with respect to each respective edge guide assembly 150*a* and 150*b***.

As stated above, hopper **120*b* is similar to hopper 120*a* in that hopper 120*b* also includes a top surface 121 for supporting a portion of the sheet of paper as it rests thereon or passes thereover and an edge guide assembly 150*b* which is similar to edge guide assembly 150*a*. Edge guide assembly 150*b* also includes outer plate 151, bottom plate 152, inner plate 153 and front plate 154. A center support 124 is mounted on rod 140** and supports the center of paper sheet P.

As depicted in FIG. 18, a respective hopper spring 123, which is preferably a compression spring, is positioned between a lower surface of each hopper **120*a*, 120*b* and respective bottom plate 152 of edge guide assembly 150*a*, 150*b*. Each hopper 120*a* and 120*b* is urged upwardly by the respective hopper spring 123. Pushing mechanism 700 is provided at each end of support rod 140. Pushing mechanism 700, which, by way of example, may be a rubber-like cam mechanism, permits hopper 120*a* and 120*b* to be urged downwardly and positioned as illustrated by the dotted lines of FIGS. 17. As the pushing mechanism acts upon hoppers 120*a* and 120*b*, there is a resistance against the spring force of each hopper spring 123**.

Figure 28:
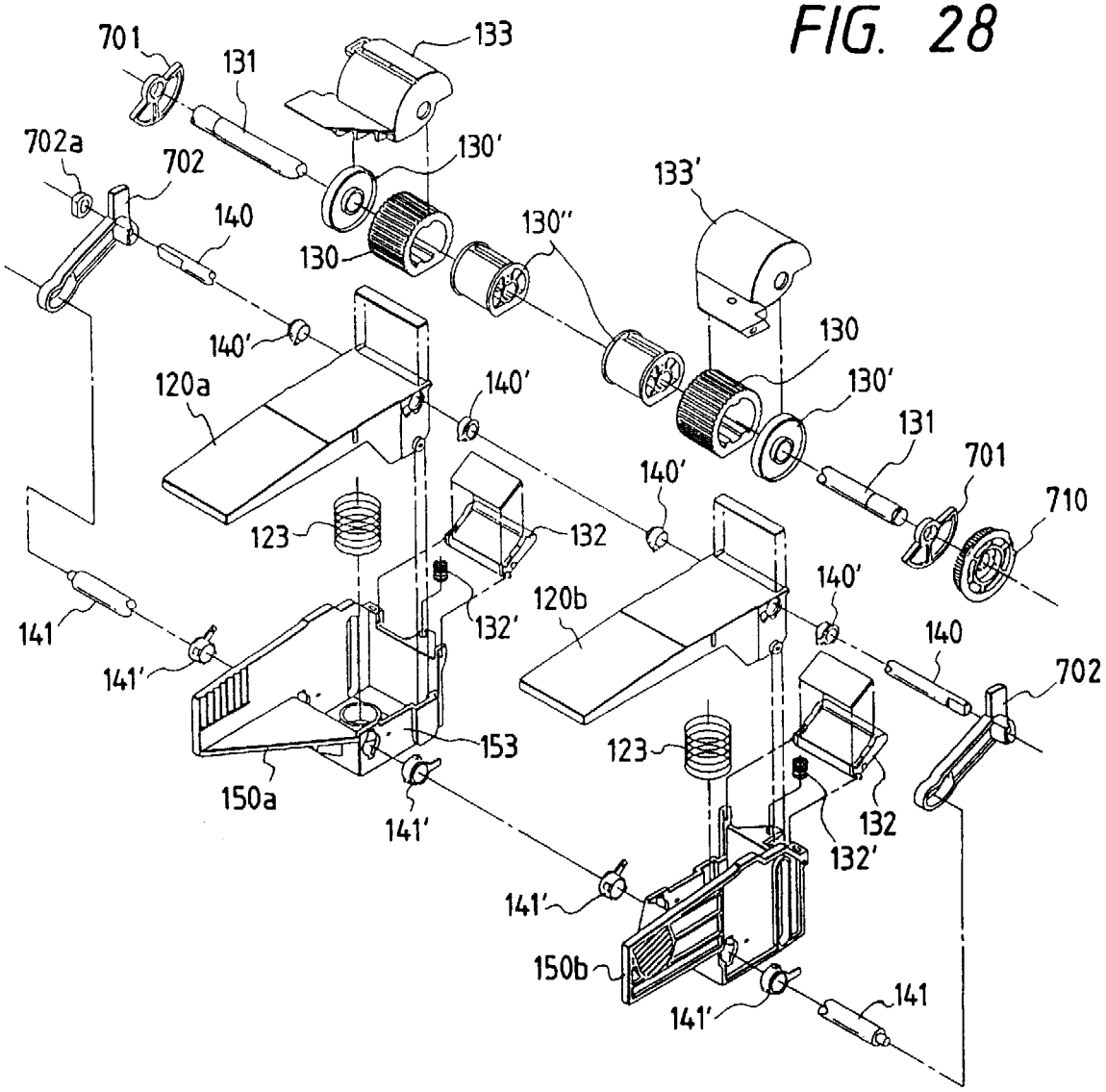
FIG. 28 is an exploded view showing the sheet hopper and the pushing mechanism.

Reference is now made to FIG. 28 which depicts an exploded view of the sheet hoppers **120*a* and 120*b* and pushing mechanism 700. A cam 701 is provided at both sides of sheet feed roller shaft 131, respectively. Also rotatably mounted on sheet feed roller shaft 131 are a plurality of bushings 130' and a plurality of bushings 130". A first paper feed roller cover 133 and a second paper feed roller cover 133' are respectively provided over each sheet feed roller 130 to maintain the integrity thereof. A cover plate 710 is also rotatably mounted on shaft 131. A lever 702 includes two apertures, one aperture to receive an end of hopper support rod 140 and another aperture to receive an end of support rod 141**.

A plurality of bushings 140' are positioned in respective apertures located on the outer surfaces of each hopper **120*a* and 120*b*. Bushings 140' assist in facilitating the movement of hoppers 120*a* and 120*b*. A bushing 702*a* is also mounted on shaft 140 adjacent each lever 702 to maintain the integrity of each lever 702 on shaft 140. Similarly, a plurality of bushings 141' are mounted on shaft 140 and assist in maintaining the integrity of edge guide assemblies 150*a* and 150*b*. Spring 132' is provided on each guide assembly 150*a* and 150*b* for assisting in pressing against each respective dividing pad 132 thereby causing dividing pad 132** to move upwardly.

Inner plate 153 corresponds to an inner side wall of each respective edge guide assembly **150*a*, 150*b*. The inner plate 153 enhances the rigidity of edge guide assembly 150*a*. As edge guide assembly 150*a* slides laterally, edge guide assembly 150*a* is supported by inner plate 153 and outer plate 151 so as to avoid a deformation thereof. Inner plate 153 also serves as a guide for hopper 120*a* when hopper 120*a*** is operated.

Figure 29:
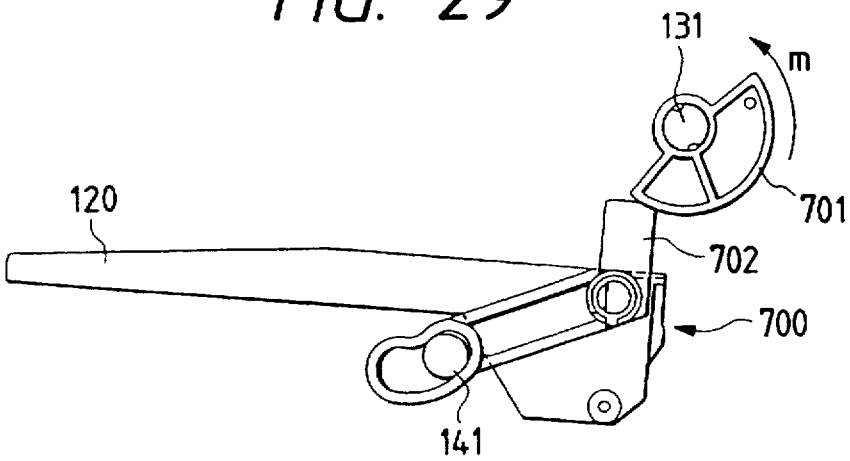
FIGS. 29 and 30 are enlarged side elevational views of the pushing mechanism.
Figure 30:
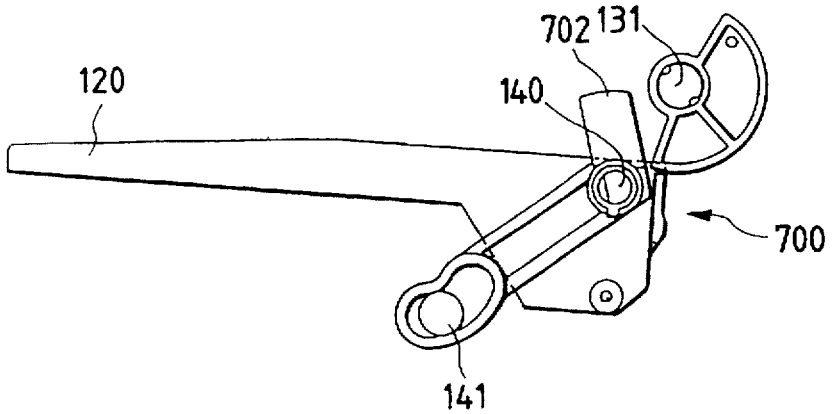
Figure 31:
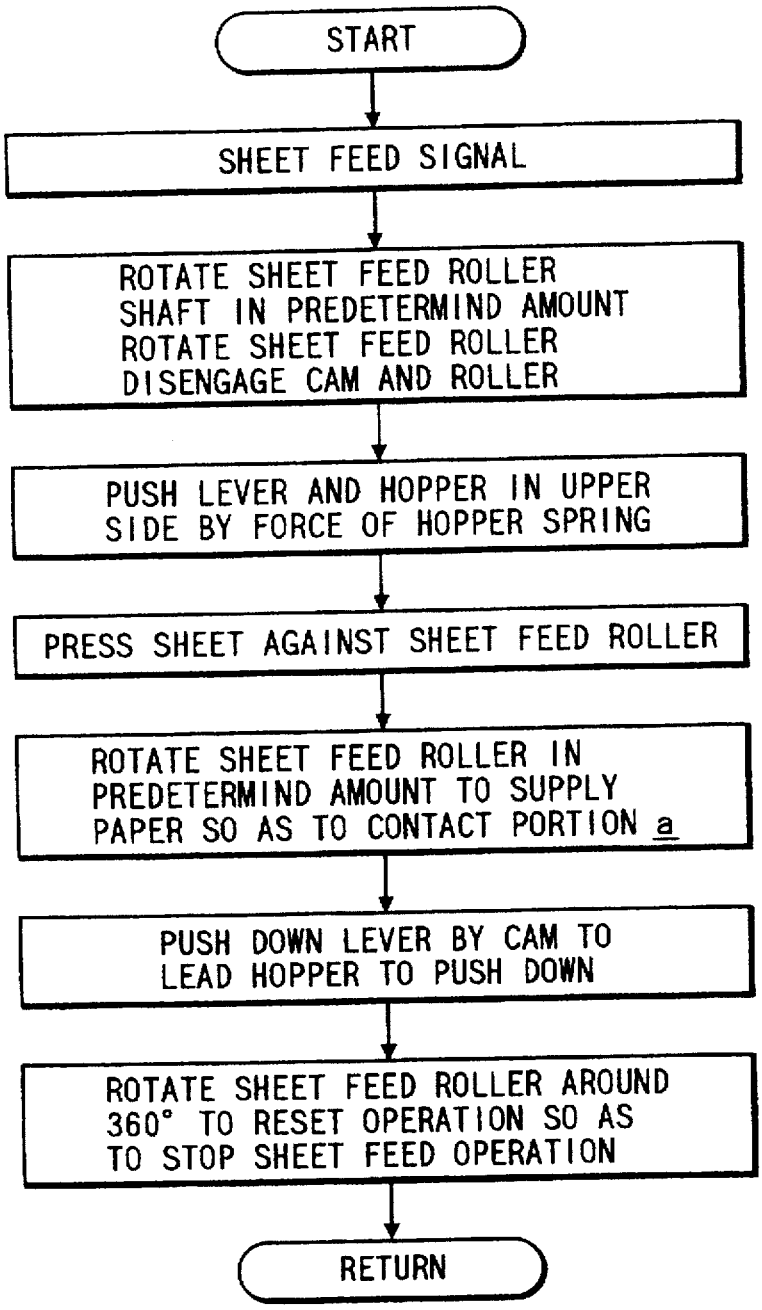
FIG. 31 is a flow chart of the sheet feed operation.

As shown in the flowchart of FIG. 31, a sheet feed operation includes the steps of: issuing a sheet feed signal (step 1). At this time, the sheet feed roller shaft 131 rotates in a counterclockwise direction m (as shown in FIG. 29) a predetermined amount causing sheet feed roller 130 to rotate therewith and cam 701 to rotate therewith. The rotation of sheet feed roller shaft 131 causes the disengagement of cam 701 and lever 702 as shown by comparing the state of cam 701 and lever 702 depicted in FIG. 29 and FIG. 30 (step 2). Lever 702 is pushed upwardly causing shaft 140 and hopper **120*a* to move upwardly by a force of the hopper spring 123 (step 3). The front edge of the sheet of paper is pressed and contacts against sheet feed roller 130 (step 4). Sheet feed roller shaft 131 further rotates in a counterclockwise direction a predetermined amount to obtain a sheet supplement and so as to bring cam 701 back into contact with lever 702 (step 5). Cam 701 depresses lever 702 downward to push hopper 120*a* (step 6). Sheet feed roller shaft 131 rotates to reset the operation and end the sheet feed operation. Although the aforementioned operation is described with respect to hopper 120*a*, the same operation applies to hopper 120*b***.

During a sheet feeding operation, each hopper **120*a* and 120*b* is urged upward by each respective hopper spring 123 so that a leading edge of the sheet of paper can be urged toward sheet feed roller 130. During a stand-by condition when a sheet of paper is not being fed into the printer, hoppers 120*a* and 120*b* are urged downward by the pushing mechanism 700 so that each hopper 120*a* and 120*b* is positioned a distance from sheet feed roller 130 as illustrated by the dotted lines in FIG. 17. In this way, the sheet of paper does not contact sheet feed roller 130**.

As depicted in FIG. 17, during a stand-by condition when paper is not being fed into the printer, hoppers **120*a* and 120*b* are positioned so that a relative height differential, or gap G1, exists between top surface 121 of hoppers 120*a*, 120*b* and top surface 1112 of sheet support 1110. During the sheet feeding operation, hopper springs 123 cause hoppers 120*a* and 120*b* to move upward so that a second relative height differential, or gap G2, exists between the top surface 121 of hoppers 120*a*, 120*b* and top surface 1112 of sheet support 1110**.

Figure 22:
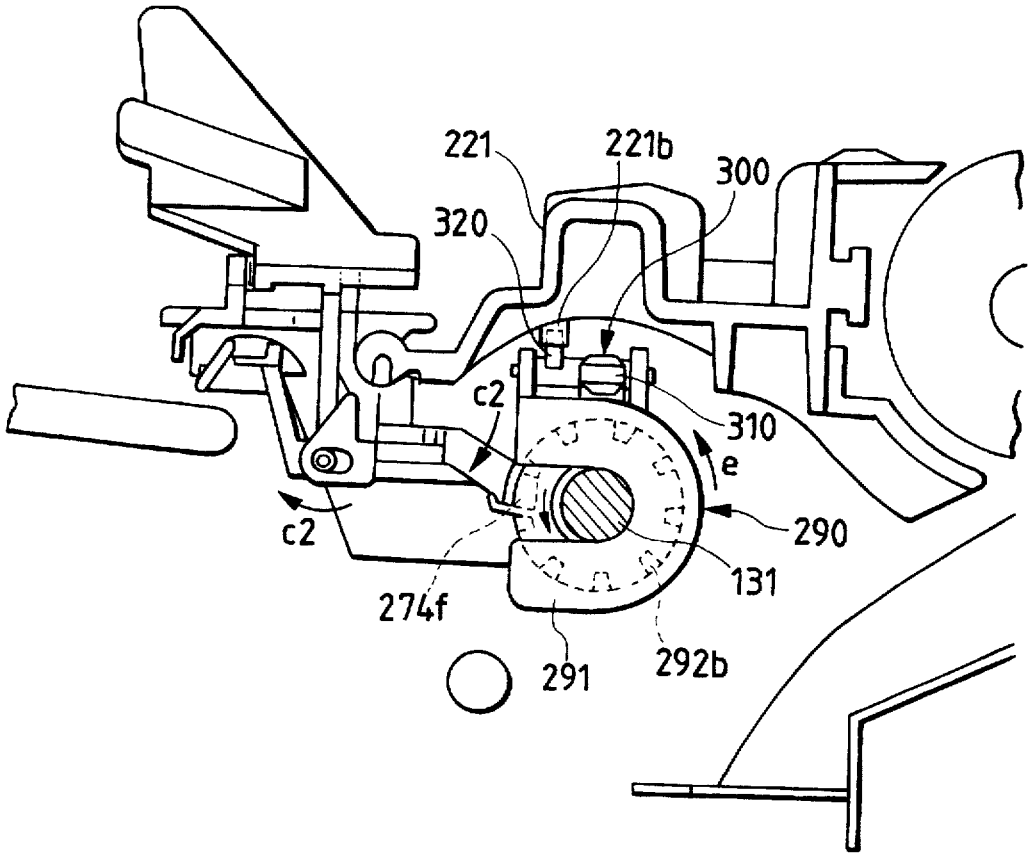
FIG. 22 is a sectional view taken along line 22—22 of FIG. 24.
Figure 23:
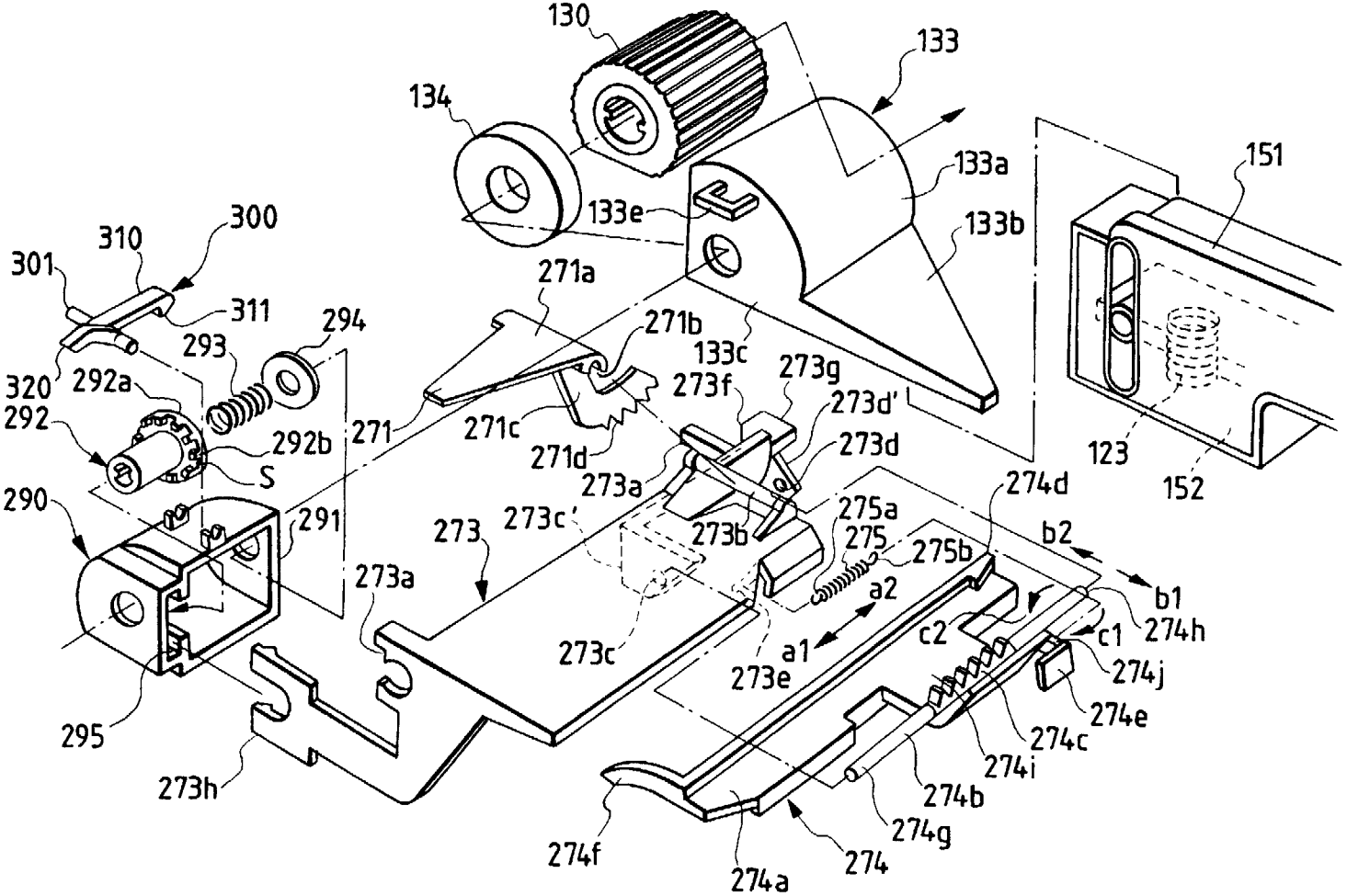
FIG. 23 is an exploded view of a section of the support portion of the printer constructed in accordance with the second embodiment of the present invention.
Figure 24:
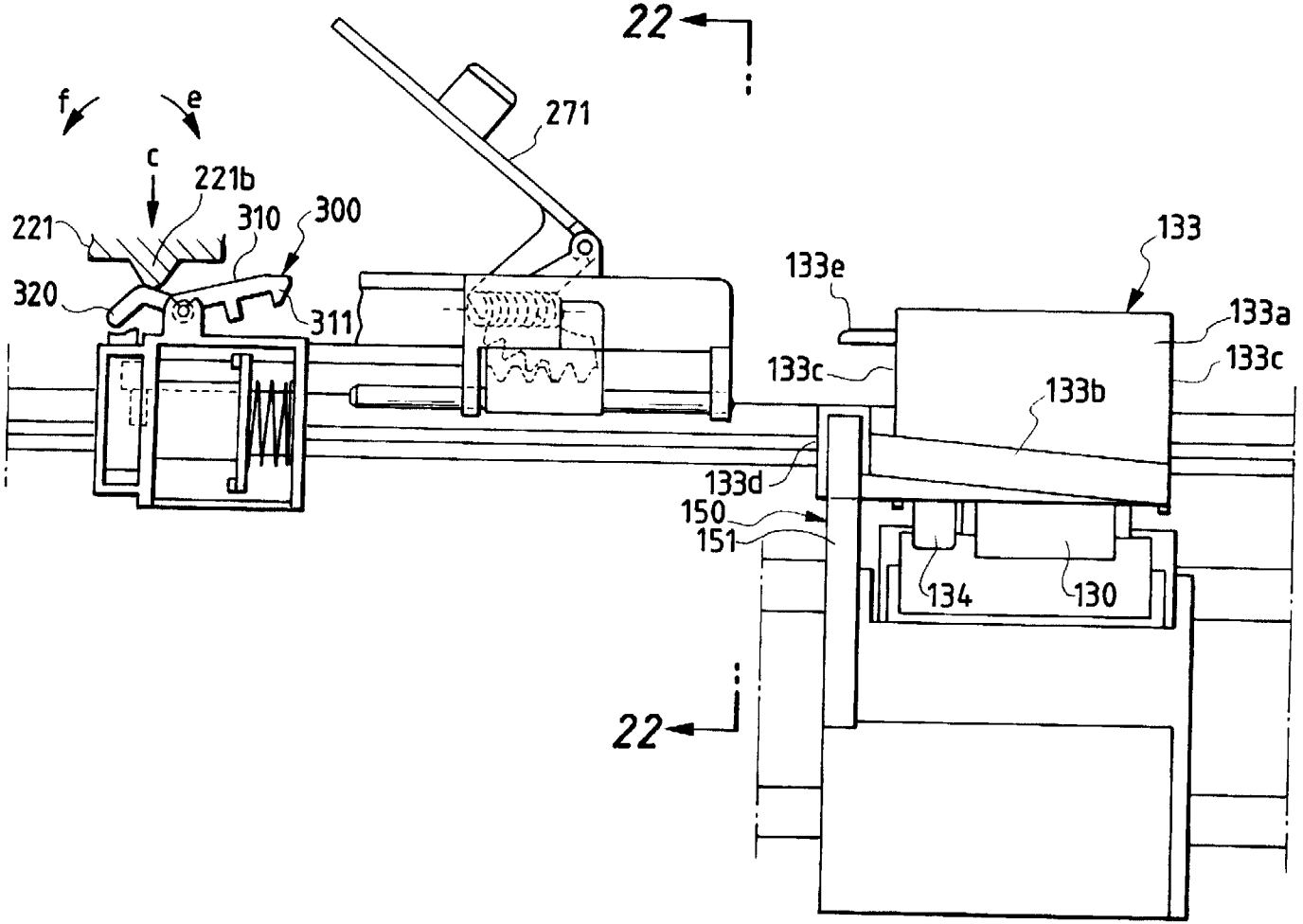
FIG. 24 is a side elevational view of a portion of the linking mechanism and edge guide assembly where the linkage of the edge guide assembly and a supporting portion are disengaged.

Reference is now made to FIGS. 21–25 which depict discharge section 270 with greater particularity. Reference is first made to paper feed roller cover 133. A similar paper feed roller cover is associated with the second sheet feed roller 130, but for ease of description, reference will only be made to the paper feed roller cover 133 depicted in the Figures, but it is understood that identical features are associated with the second roller cover 133' with the exception that second roller cover 133' (as depicted in FIG. 28) does not include an engaging portion **133*e* as further described below. Paper feed roller cover 133 includes an integrally formed roller cover portions 133*a*, integrally formed side plates 133*c* and paper comer cover portions 133*b*. Roller cover portions 133*a* cover the upper front portion near side of paper feed rollers 130. An auxiliary roller 134 is provided and mounted onto shaft 131. Roller cover portion 133*a* also covers auxiliary roller 134. Side plates 133*c* are capable of abutting paper feed rollers 130 or auxiliary rollers 134. Paper comer cover portions 133*b* are formed in abbreviated triangular shapes in plan view, and cover the leading edge angular portion of a paper set in paper feeder apparatus 1100. As shown in FIG. 24, the near sides of the outer side edges of paper comer cover portions 133*b* are formed in upside-down V-shapes and engage the outer side plates 151 of edge guides 150. An engaging portion 133*e*, substantially C-shaped in plan view, is formed on the left side surface of roller cover 133*a* of paper feed roller cover 133**.

Accordingly, when each edge guide assembly **150*a*, 150*b* is slid laterally as indicated by arrows X1', X2' (FIG. 18), paper feed roller covers 133 also slide thereby causing paper feed rollers 130 to also slide. In a standby condition of the paper feeding operation, when paper is set in paper feeder apparatus 1100, the front part of the paper is placed into the top of hoppers 120*a*, 120*b*** from the front of the printer. Because the paper can be inserted from the front of the printer, the paper loading operation is simple.

After the sheet of paper has been set in the hopper, retaining plate 1113 may be slidably displaced in the direction indicated by arrow Y1 (in FIG. 18) until retaining plate 1113 contacts the rear edge of sheet of paper P. The leading end of the sheet of paper is aligned by engagement with front plate 154 of edge guide 150.

On the other hand, once the retaining plate 1113 is set, the retaining plate 113 does not move except when the paper is loaded or the paper sheet size is changed.

Thereafter, the outer plate 151 of edge guide assembly **150*a* of hopper 120*a* is slidably displaced so that outer plate 151 of each hopper 120*a* and 120*b* contacts the side edges of the sheet of paper. By sliding outer plate 151 corresponding to hopper 120*a*, the outer plate 151 associated with hopper 120*b* is also aligned with the side edges of the sheet of paper. In addition, outer plate 151 associated with hopper 120*b* is only capable of being slidably displaced during the initial paper setting. With the sheet of paper aligned as described above, the rear edge of sheet P contacts retaining bar 1113*a* of retaining plate 1113, the bottom surface Pb of sheet P is supported by top surface 1112 of sheet support 1110 and the front portion of the sheet is supported by top surface 121 of hoppers 120*a* and 120*b* and by the front plate 154** of the edge guide assemblies.

Hoppers 120*a*, 120*b* are disposed at a position distant and spaced apart from sheet feed roller 130 during the condition that paper is not being fed into the printer and the sheet feed roller 130 is not rotating, so that a relatively large first step G1 is formed between the top surface 121 of the hoppers 120*a*, 120*b* and the top surface 1112 of the sheet support 1110. Accordingly, with the hoppers 120*a*, 120*b* spaced from sheet feed rollers 130, a sheet of paper being supported is curved substantially along step G1.

Hoppers 120*a*, 120*b* are then urged upwardly towards the sheet feed rollers 130 so that a leading edge of the sheet contacts sheet feed roller 130. During the process of sheet feeding and as hoppers 120*a*, 120*b* are urged upwardly towards sheet feed rollers 130, a second and smaller step G2 is formed between the top surface 121 of hoppers 120*a*, 120*b* and the top surface 112 of sheet support 1110. Accordingly, the length of the curved portion of the sheet of paper is reduced. By reducing the length of the curved portion of the sheet of paper P, a compressive force acts on the paper due to the compression of the sheet of paper P between sheet feed rollers 130 and retaining plate 113. Due to the reduction of the length of the curved portion of the sheet of paper, an extending force F1 is generated on the sheet of paper itself, so that the sheet of paper is pushed toward sheet feed roller 130.

By utilizing the above construction which includes at least one hopper and retaining plate as disclosed, an accurate and reliable sheet feeding operation is achieved even if the paper is supported in a horizontal condition because the sheet of paper can be urged toward the sheet feed roller by the extending force acting on the sheet of paper.

Furthermore, an accurate and reliable sheet feeding operation is achieved even if the sheet support is supporting a plurality of sheets of paper. As stated above, the hoppers are spaced apart from the sheet feed roller while in a stand-by mode and during which the sheet feed roller is not rotating, so that a relatively large step is formed between the top surface of the hoppers and the top surface of the sheet support. Accordingly, the sheets of paper supported thereon are greatly curved substantially along this large step G1.

During the sheet feeding operation, the hoppers are urged forward thereby eliminating the aforementioned large step G1 causing the paper to extend, eliminating the curved portion of the sheet of paper caused by the step portion described above and causing the leading edge of the paper to contact the sheet feed roller. By eliminating this curved portion, a compressive force acts on the sheet of paper by compression of the paper between the sheet feed roller and the retaining plate when the leading edge of the sheet of paper contacts the sheet feed roller and the trailing edge of the paper contacts the retaining plate. By utilizing a retaining plate that can be secured in position, any backward movement of the sheet of paper can be prevented. Due to the elimination of the curved portion of the sheet of paper, an extending force acting on the sheet of paper causes the sheet of paper to be accurately and releasably fed into the printer.

Moreover, only the uppermost sheet of paper contacts paper feed rollers 130 due to the separation of each sheet of paper from the remaining sheets by dividing pads 132. In this way each sheet of paper can be fed to printer body 200 in the direction of arrow b in FIG. 17. As previously described, the fed paper is fed to paper feed rollers 130 and transported to printing section A, and after being printed by ink jet head 240, is transported by transport rollers 251 and 252, received further by paper discharge rollers 261 and 262, passes through discharge portion 270 and is discharged into discharge tray 280 above hoppers 120.

Accordingly, even if a plurality of sheets are loaded onto the sheet support, the present invention can not only accommodate the plurality of sheets, but in addition, can accurately and reliably feed each sheet into the printer even when the plurality of sheets are horizontally supported.

Figure 21:
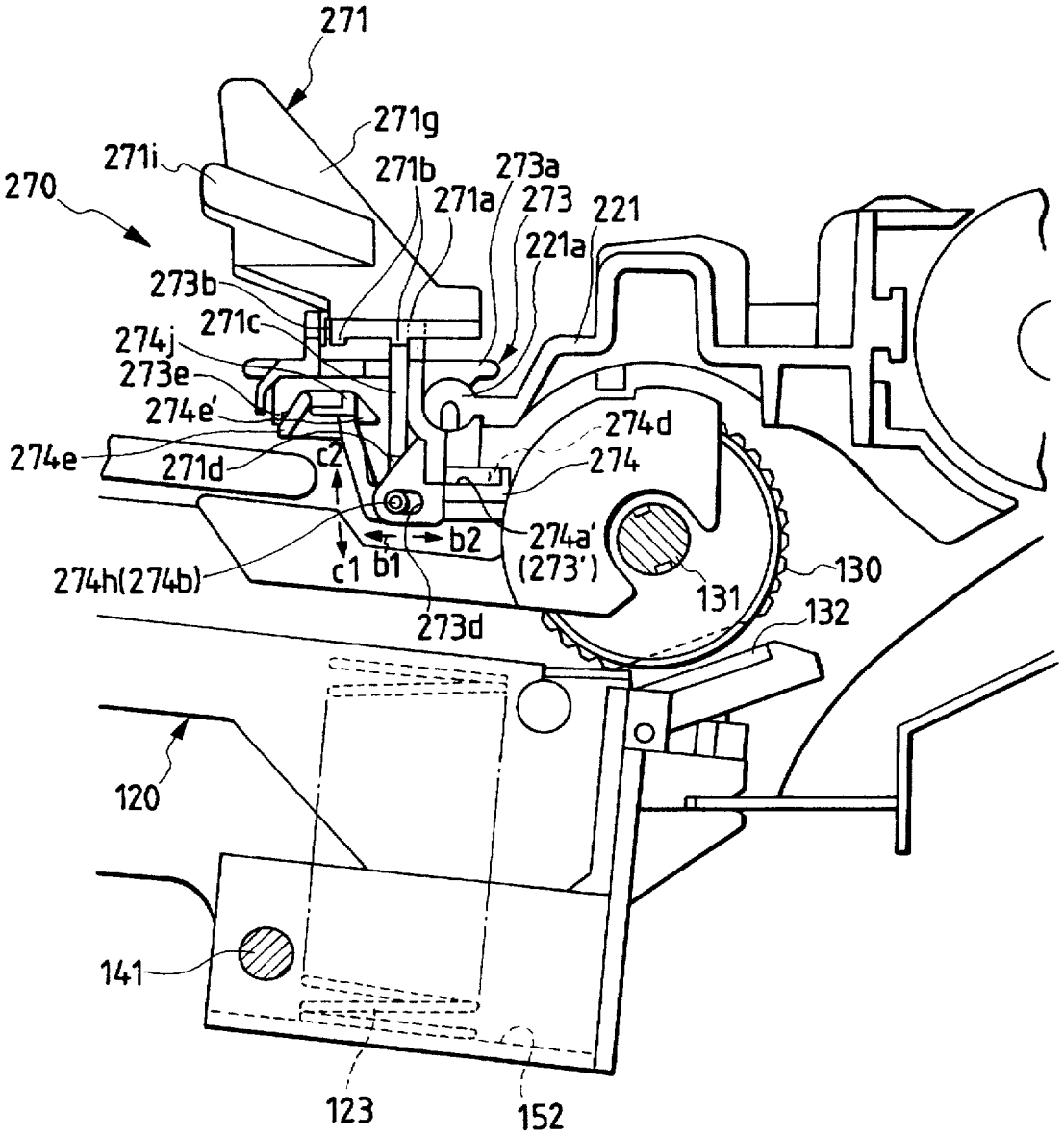
FIG. 21 is an enlarged side elevational view depicting the construction illustrated in FIG. 19.

Reference is now particularly made to FIGS. 21 and 23 which depict, in detail, discharge section 270, constructed in accordance with the present invention. A base member 273 includes a pair of C-shaped engaging portions 273*a* formed in a rear portion thereof. Engaging portions 273*a*, slidingly engage a substantially round rod-shaped guide rail 221*a* (FIG. 21) which itself is integrally formed in a front edge of sub frame 221. In this way, base member 273 is slidably mounted to sub frame 221. Base member 273 also includes an integrally formed arm plug 273*h* and protruding pieces 273*c*' and 273*d*' connected to base member 273 which themselves respectively include a hook shaped bearing portion 273*c* and a slot 273*d* formed therein. Base member 273 also includes a sloping blade 273*f* formed thereon. Sloping blade 273*f* includes a corner or catch portion 273*g*. A shaft 273*b* is provided integrally in the upper surface right end of base member 273.

A support portion 271 includes a base portion 271*a* and a pair of flexible claws 271*b* integrally formed with base portion 271*a*. Flexible claws 271*b* rotatably engage with shaft 273*b*. In this way, support portion 271 is rotatably mounted with respect to base member 273. An L-shaped arm 271*c* is downwardly formed from base portion 271*a* and a gear portion 271*d* is formed in a lower end of arm 271*c*.

A slider 274 is provided and includes a base plate 274*a* with a base surface 274*i*, a shaft 274*b* connected to base plate 274*a*, having a left end 274*g* and a right end 274*h*, a toothed rack 274*c* connected to shaft 274*b*, a claw 274*d* connected to base plate 274*a*, a pushing-up arm 274*e* connected to base plate 274*a* which forms a hook portion 274*j* therebetween, and a pushing-down arm 274*f* connected to base plate 274*a*. In the preferred embodiment, these parts are all integrally connected.

The left end 274*h* of shaft 274*b* fits slidably into hook-shaped bearing portion 273*c* and right end 274*h* of shaft 274*b* fits slidably into slot 273*d*. In this way, slider 274 is slidably mounted to base member 273 in the lateral direction indicated by arrows a1 and a2 in FIG. 23. In this way, slider 274 is also slidable in the direction indicated by arrows b1 and b2 and rotatable in the directions indicated by arrows c1 and c2. Fitted in this way, rack 274*c* can engage with gear 271*d* of support portion 271. The sliding range of slider 274 in the direction of arrows a1 and a2 is limited by base surface 274*i* in the neighborhood of shaft 274*b* abutting protruding pieces 273*c* ' and 273*d* '. The oscillation range of slider 274 in the direction of arrows b1 and b2 is limited by the range of movement of shaft right end 274*h* within slot 273*d*. The range of rotation of slider 274 in the direction of arrows c1 and c2 is limited by the abutment of base plate 274*a* against lower surface 273'(FIG. 21) of base member 273 , and the rear end 274*e*' of pushing-up arm 274*e* abutting base member 273. Slider 274 is constructed within this range so that rack 274*c* and gear 271*d* of support portion engages and does not separate.

A left end 275*a* of a pull-spring 275 is fastened to a hook portion 273*e* formed in base member 273, and a right end 275*b* of pull spring 275 is fastened to hook portion 274*j*. As depicted in FIG. 21, hook portion 274*j* is positioned to the right of hook portion 273*e*. Moreover, relative to shaft 274*b*, hook portion 274*j* is positioned above hook portion 273*e*. Consequently, the effect of pull spring 275 causes slider 274 to always be urged in the directions indicated by arrows a1, b1, and c1.

Figure 19:
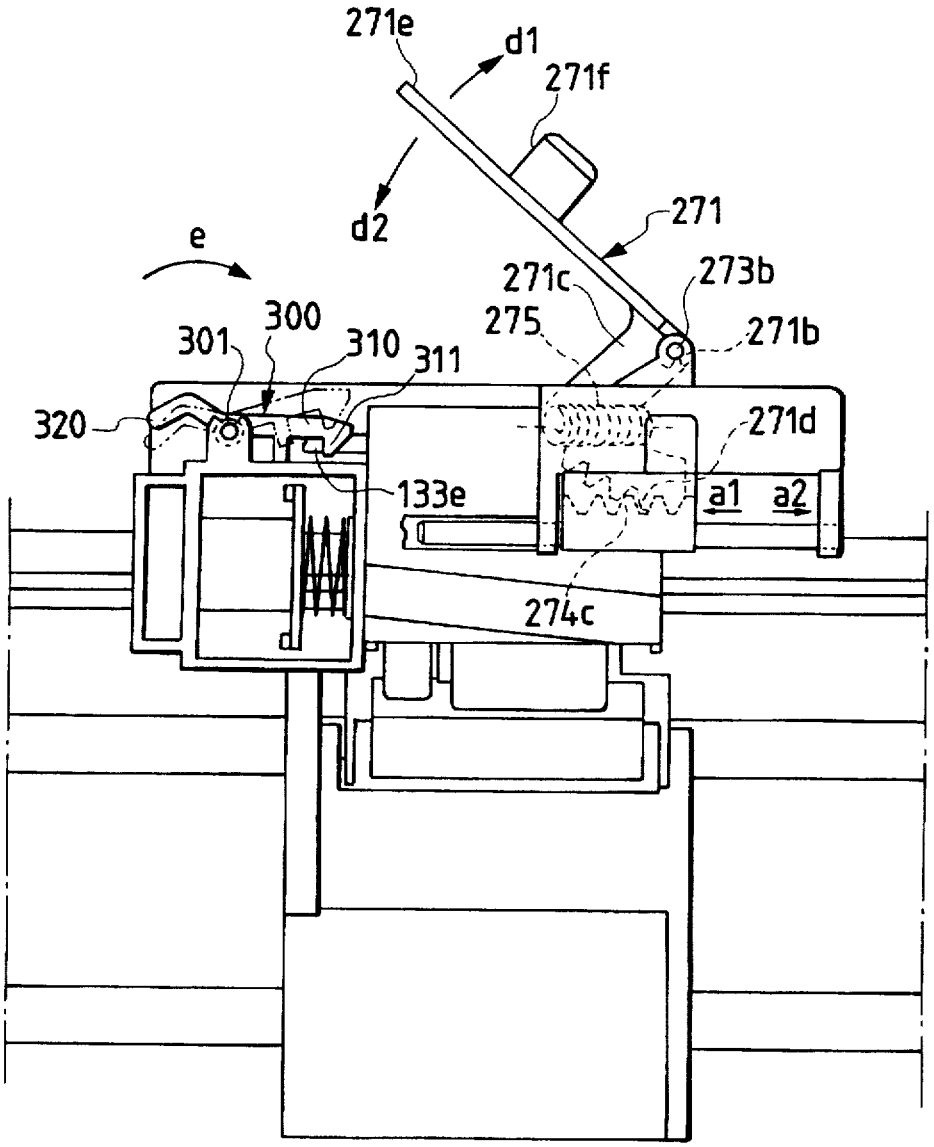
FIG. 19 is an enlarged elevational view illustrating the rotational nature of the supporting portion and linking mechanism constructed in accordance with the present invention.
Figure 25:
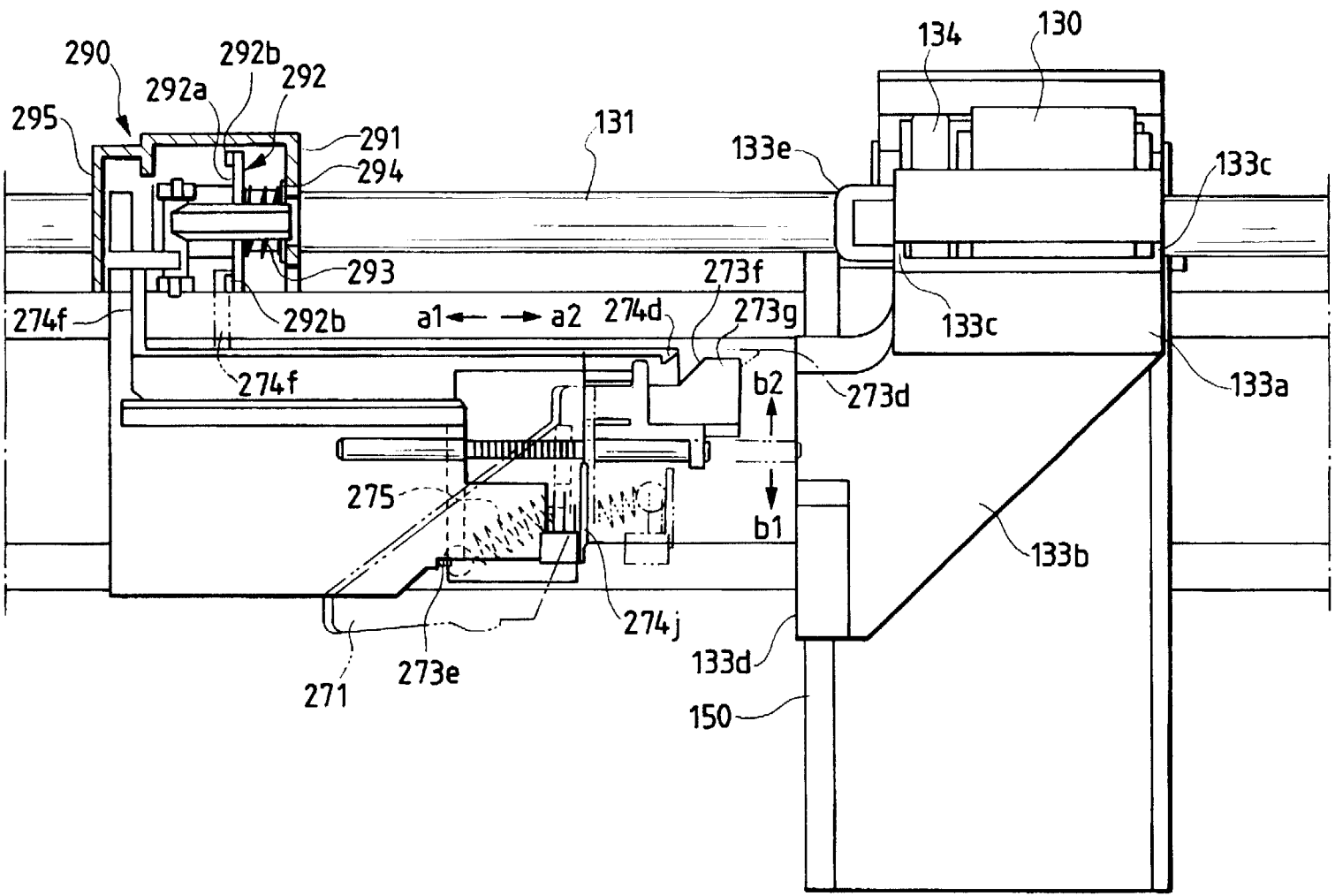
FIG. 25 is a bottom plan view of the portion of the linking mechanism and edge guide assembly illustrated in FIG. 24.

Due to the engaging of gear 271*d* and rack 274*c*, when slider 274 moves in the direction of arrow a1, support portion 271 is in a raised state as shown in FIGS. 21 and 19. When support portion 271 falls in the direction of arrow d2 (FIG. 19), slider 274 moves in the direction of arrow a2 and pull spring 275 is extended. As shown in FIG. 25, when slider 274 moves in the direction of arrow a2, claw 274*d* approaches and abuts sloping blade 273*f*. Slider 274 oscillates in the direction of arrow b2 due to claw 274*d* being guided by sloping blade 273*f*. Claw 274*d* can slide over sloping blade 273*f* by the resiliency of claw 274*d*. At the point where claw 274*d* engages comer portion 273*g*, slider 274 moves back in the direction of arrow b1 by the spring force of pull-spring 275. When claw 274*d* engages comer portion 273*g*, support portion 271 is maintained in a prone state.

Referring once again to FIGS. 21 and 23, to raise support portion 271, pushing-up arm 274*e* is rotated in the direction of arrow c2. In doing so, slider 274 rotates in the same c2 direction, and claw 274*d* rotates downwards to disengage with the comer portion 273*g* of base 273. When the engagement of claw 274*d* and comer portion 273*g* is released, slider 274 moves in the direction of arrow a1 by the spring force of pull-spring 275 and support portion 271 rotates and moves to an upright position indicated by direction arrow d1 (FIG. 19) since rack 274*c* and gear 271*d* are still engaged. The same returning operation can also be obtained by pushing-down arm 274*f* being pushed down in the direction of arrow c2, the operation of which being described below.

Reference is now particularly made to FIGS. 23 and 25 which depicts in detail automatic return mechanism 290. Automatic return mechanism 290 is slidably mounted to paper feed roller shaft 131. Automatic return mechanism 290 includes a case 291 having an open front and a lugged wheel 292, having a round plate portion 292*a*, slidably mounted on paper feed roller shaft 131 and housed within case 291. Lugged wheel 292 rotates with feed roller shaft 131. In the left side surface of round plate portion 292*a* of lugged wheel 292, a plurality of protrusions 292*b* are provided having gaps s therebetween so that the leading edge of pushing-down arm 274*f* is capable of being received therein. A compression spring 293 is provided between lugged wheel 292 and the inside wall of case 291. Also included is a bushing 294 which may be mounted against the inside wall of case 291 and receives spring 293. A socket portion 295 is formed in the left side of case 291. The leading edge of arm plug 273*h* is received by socket portion 295. The leading edge of pushing-down arm 274*f* of slider 274 is inserted into case 291 and abuts the left side surface of round plate portion 292*a* of lugged wheel 292. Consequently, automatic return mechanism 290 slides together with base 273.

As depicted in FIG. 25, when support portion 271 is in a raised state, slider 274 is in a position towards direction arrow a1, and pushing-up arm 274*f* (as shown by the solid line) is on the left side of case 291 and does not abut round plate portion 292*a* of lugged wheel 292. When support portion 271 rotates to its prone position, slider 274 moves in the direction indicated by arrow a2 due to the engagement of rack 274*c* and gear 271*d*, claw 274*d* of slider 274 engages with corner portion 273*g* of base member 273, and support portion 271 is maintained in a prone state. However, due to the lateral movement of slider 274 in the direction of arrow a2, pushing down arm 274*f* also moves in the direction of arrow a2 as depicted in the chain line in FIG. 25. Pushing-down arm 274*f* will now abut round plate portion 292*a* of lugged wheel 292. Lugged wheel 292, while resisting the spring force of compression spring 293, causes pushing-down arm 274*f* to enter between adjacent protrusions 292*b* (FIG. 22).

As depicted in FIG. 22, when paper feeder apparatus 1100 operates and paper feed roller shaft 131 rotates in the counterclockwise direction indicated by arrow e, lugged wheel 292 also rotates in the counterclockwise direction indicated by arrow e, and the protrusions 292*b* force pushing-down arm 274*f* down in the rotational direction indicated by arrow c2. In this way, slider 274 rotates in direction of arrow c2, and by the aforementioned operation slider 274 moves in the direction indicated by arrow a1, and support portion 271 moves to its upright condition. Moreover, the space s between adjacent protrusions 292*b* is large enough to accommodate the leading edge of pushing-down arm 274*f* and the clearance between protrusions 292*b* does not disturb the rotation of pushing-down arm 274*f* as it escapes from between protrusions 292*b*.

Figure 20:
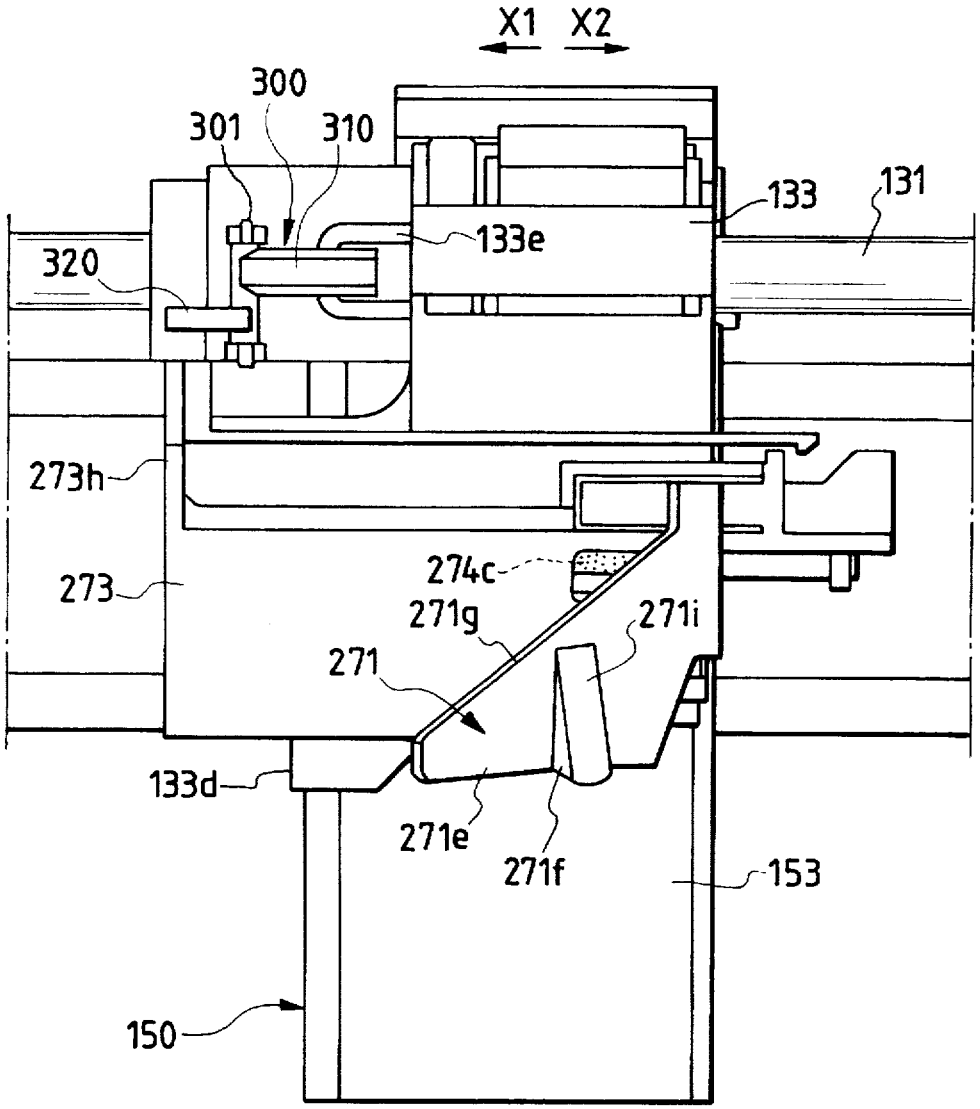
FIG. 20 is an enlarged top plan view illustrating the construction of the linking mechanism and supporting portions constructed in accordance with the second embodiment of the present invention.

Reference is also now made to FIG. 20 which depicts, in addition to FIGS. 19 and 23, the linkage mechanism which links the sliding of support portions 271 and edge guide assemblies 150*a*. The linkage mechanism, constructed in accordance with the present invention, includes a connecting mechanism that connects edge guide assembly 150*a* and support portions 271 and a release mechanism for releasing the connection between edge guide assembly 150*a* and support portions 271. Edge guide assembly 150*b* and base member 273 are preferably always engaged.

The linkage mechanism includes a lever, generally indicated at 300. Lever 300 includes a first arm 310 and a second arm 320. A shaft 301 is integrally formed therebetween. A hook portion 311 is formed in the leading end of first arm 310. Second arm 320 is formed in a shallow inverted elongated 'V' shape when viewed from the front (FIG. 24).

Paper feed roller cover 133 and case 291 slide on shaft 131. When paper feed roller cover 133 slides in the direction of arrow X1' (FIG. 20) and abuts case 291 of automatic return means 290, case 291 also slides in the direction of arrow X1' (FIG. 20) and the connection of lever 300 with engaging portion 133*e* does not directly cause the movement of case 291.

Due to its own weight and asymmetrical shape, lever 300 is urged in a clockwise direction e (FIG. 19). Initially, hook 311 of first arm 310 may be disengaged from engaging portion 133*e*. As paper feed roller cover 133 engages outer side plate 151 of edge guide 150 by the front near side 133*d* (FIG. 25) of paper comer cover portion 133*b*, paper feed roller cover 133 slides together with edge guide 150. Case 291 of automatic return mechanism 290 is connected to base member 273 by arm plug 273*h*, and case 291 is slid together with base member 273 which itself has support portion 271 mounted thereon. In the condition where paper feed roller cover 133 and case 291 of automatic return mechanism 290 are connected by lever 300 and engaging portion 133*e*, the sliding of edge guide 150 and support portion 271 is linked because lever 300 is linked to engaging portion 133*e*.

Reference is now made to FIGS. 22 and 24 which depict the release mechanism constructed in accordance with the present invention. The release mechanism includes a protrusion 221*b* formed in sub frame 221. Protrusion 221*b* is positioned centrally in the trajectory of movement of second arm 320 of lever 300 (see the chain line in FIG. 19), and furthermore is positioned at boundary position C between the region B2 (FIG. 18) where support of both sides of a paper by support portions 271 is required, and the region B1 (FIG. 18) where support of both side portions of a paper by support portions 271 is not required.

Figure 26:
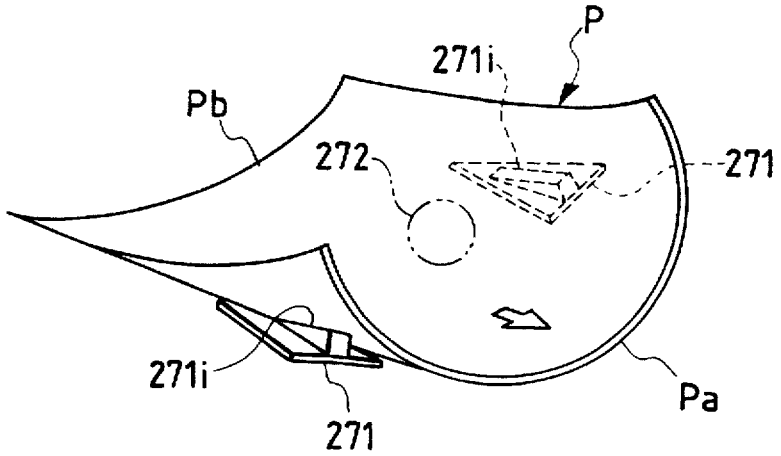
FIG. 26 is a perspective schematic view of a paper discharge operation using the construction of the supporting portions constructed in accordance with the second embodiment of the present invention.
Figure 32:
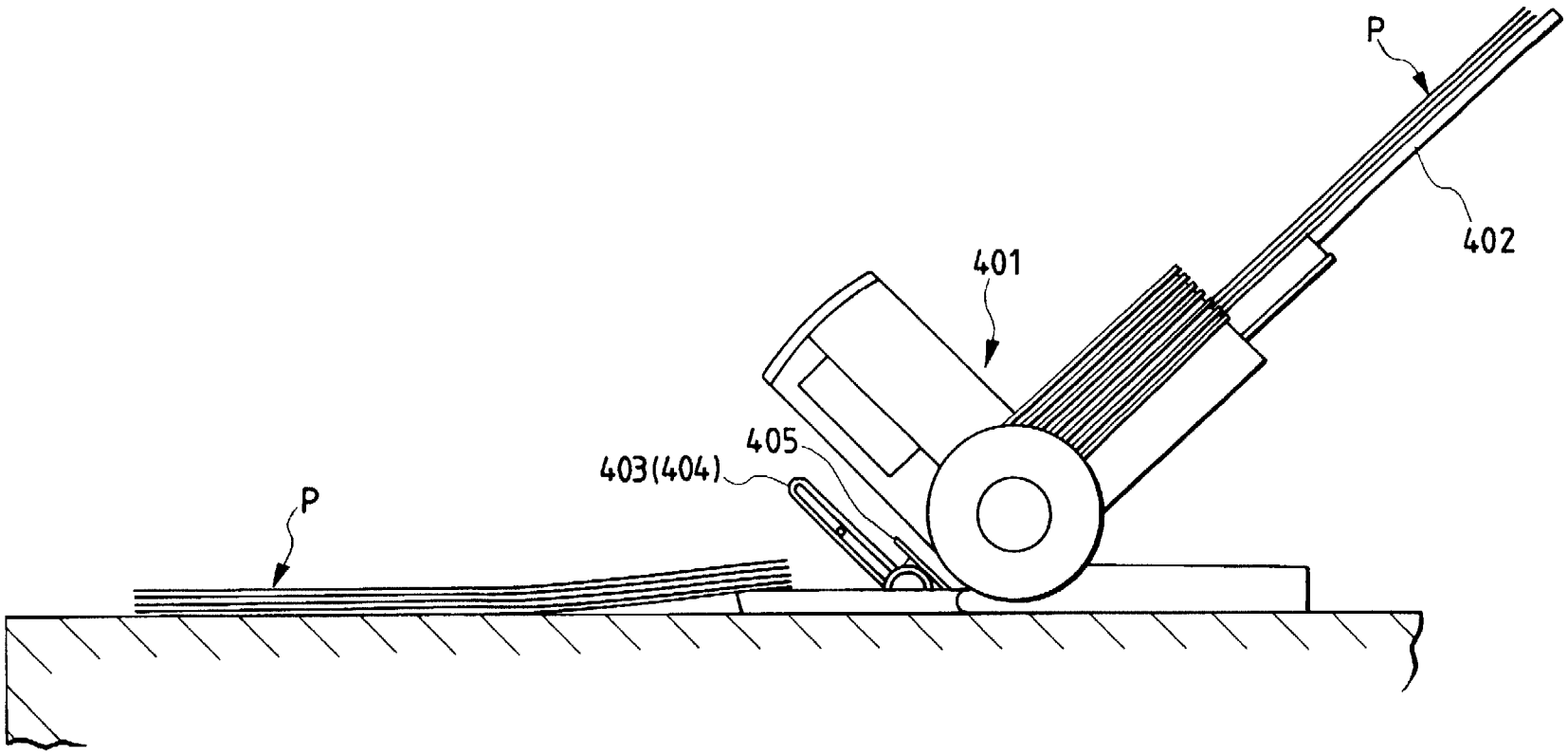
FIG. 32 PRIOR ART
FIGS. 32, 33, 34, 35, 36, 37, 38, 39 and 40 depict printers constructed in accordance with the prior art.
Figure 33:
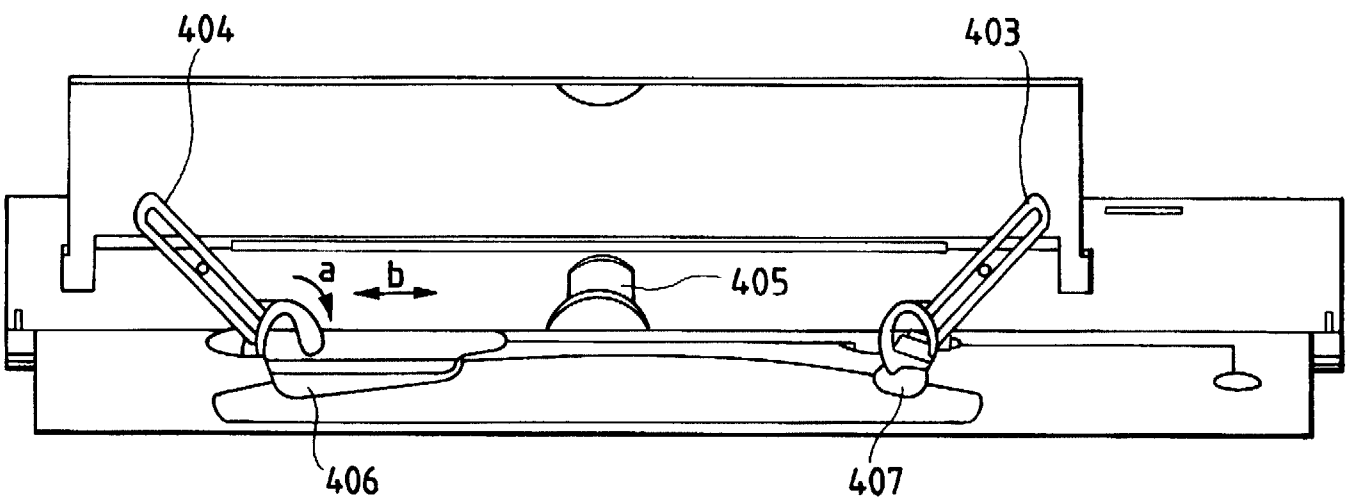
FIG. 33 PRIOR ART
Figure 34:
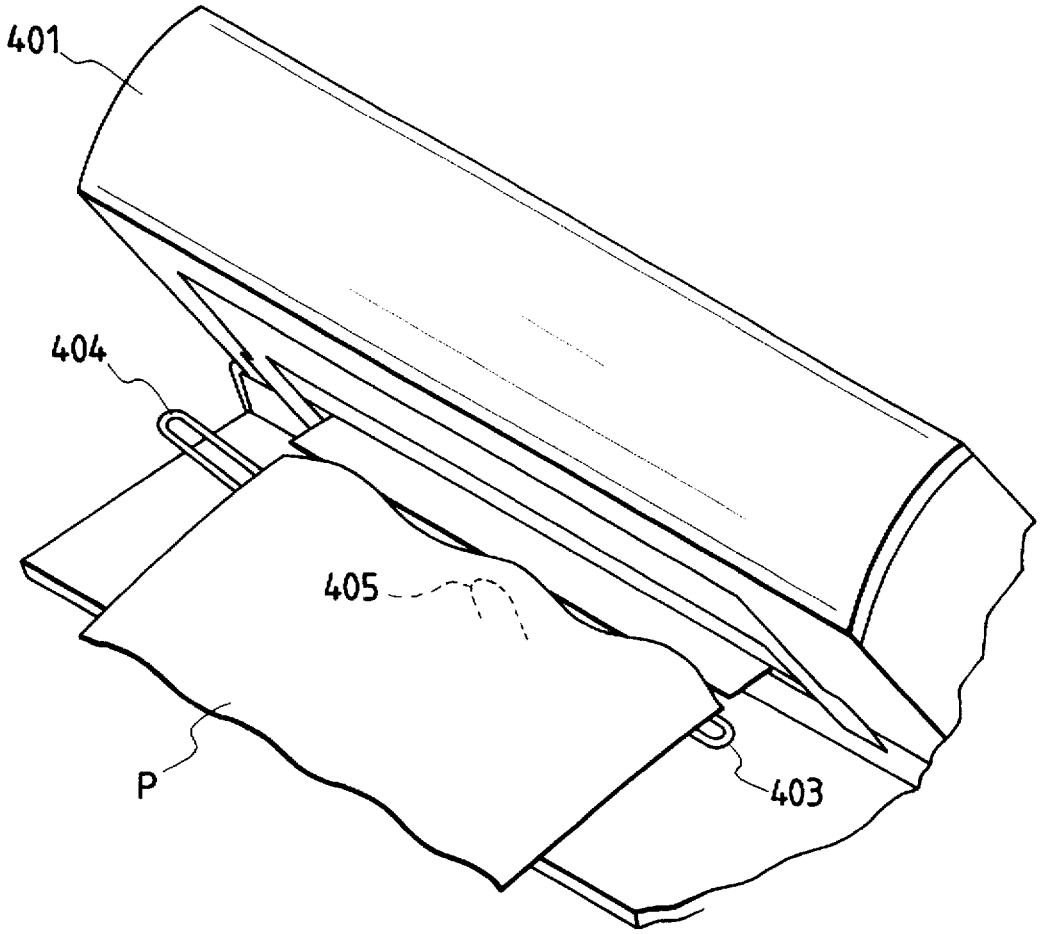
FIG. 34 PRIOR ART
Figure 35:
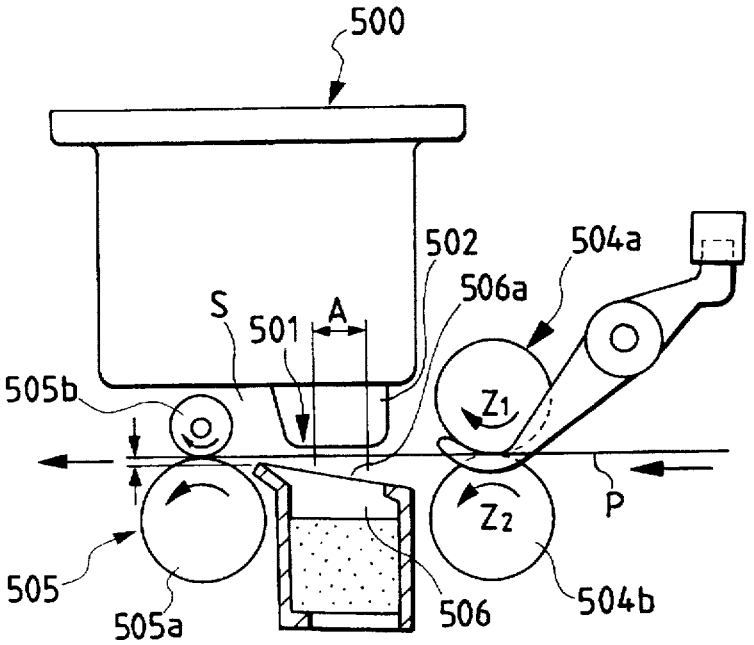
FIG. 35 PRIOR ART

By edge guide assembly 150*a* being moved to the right (in the direction of arrow X2' in FIG. 18), when support portion 271 enters region B1 (where support of both sides of a paper by support portions 271 is not required) from region B2 (where support of both sides of a paper by support portions 271 is required), protrusion 221*b* contacts second arm 320 of lever 300 and rotates lever 300 in a counter-clockwise direction (arrow f, FIG. 24), thereby releasing the connection between first arm hook portion 311 and engaging portion 133*e* of paper roller cover 133. In the opposite case, in the process where edge guide 150 enters region B2 (where support of both sides of a paper by support portions 271 is required) from region B1 (where support of both sides of a paper by support portions 271 is not required) the rotation of lever 300 is not restricted by protrusion 221*b* and by its own weight and asymmetrical shape, lever 300 rotates in a clockwise direction (arrow e, FIG. 24) and engages engaging portion 133*e*. Moreover, as described above, as only edge guide assembly 150*b* (FIG. 18) is capable of sliding during the initial positioning of the paper (initial setting), it does not usually slide during the paper feed operation. Consequently, lever 300 is only provided in the left hand case 291 (left hand implying the left hand side of the invention as viewed in FIG. 18, the right hand side is the right side of the invention as viewed in FIG. 18) of automatic return mechanism 290 and is not provided in the corresponding right hand case 291 of automatic return mechanism 290. The right hand case 291 of automatic return means 290 is integrally formed in the right hand paper feed roller cover 133 (not shown in the figure). As shown in FIGS. 19–21, support portion 271 includes triangular piece 271*e* and triangular portion 271*f* formed integrally in the top surface of triangular piece 271*e*. A slanting blade 271*g* of triangular piece 271*e* and slanting surface 271*i* of triangular portion 271*f* form guide portions for a discharged sheet of paper. This can also be seen in FIG. 26, which depicts a pair of support portions 271 which are included in discharge portion 270 and which support from below both side portions of a paper after being discharged from printing section A. A pushing-down portion 272 is also depicted and pushes downwardly a central portion of the discharging papers. Thus, slanting surface 271*i* of triangular portion 271*f* is not parallel to the direction of a discharged sheet of paper, but rather it is directed inwards and slanted in an upwards direction. Therefore, as shown in FIG. 26, a discharged paper P is discharged while the trailing edge Pb is in a less gradual concave shape than that of leading edge Pa. As also depicted in FIG. 26, support portions 271 are constructed symmetrically. Pushing-down portion 272 may be constructed in the same way as a conventional serrated roller (see FIG. 32), and is rotatably supported in an arm 272' which may be rotatably mounted to sub frame 221.

Additionally, the printer of the present embodiment is provided with a tractor for fan sheet paper (not shown in the figure). This tractor fan sheet paper can be fed towards printing section A by being supplied to an opening indicated by arrow c (FIG. 17). The printed fan sheet paper is discharged from discharge portion 270 as described above. When the tractor is operating, paper feed roller shaft 131 and paper feed rollers 130 do not rotate. The mode of operation to feed in fan sheet paper is accomplished by activating a lever to change the pressure exerted by a pinch roller 1263. That is, the pressure exerted by the pinch roller is greater for single sheet paper than the pressure exerted on a fan sheet of paper by pinch roller 1263. By detecting the lever position, the printer can detect what type of paper is being used. If fan paper is being used, the driving force of the rollers that feed in paper from hoppers 120*a*, 120*b* can be switched to the pin tractors that feed in the fan sheet paper so that the fan sheet paper is fed to the printing section. The method of use and beneficial effects of an ink jet printer constructed in accordance with this embodiment are as follows.

First, normal size paper such as A3, A4, B4 or B5 require support on both side portions thereof. This is accomplished by support portions 271. Accordingly, these types of paper are fed while support portions 271 are in an upright state. When the paper is set in paper feeder apparatus 1100, left hand edge guide assembly 150*a* is slid and, within region B2 (where support of both side portions of a paper is required), as the sliding of edge guide assembly 150*a* and support portion 271 is linked by lever 300, support portion 271 automatically also slides.

Consequently, the need to separately slide edge guide assembly 150*a* and support portion 271 is eliminated and a proper discharge operation can easily be obtained. While the discharge operation disclosed herein is similar as the discharge operation of the aforementioned conventional printer, paper P can still be discharged while trailing edge Pb is forced into a gentler concave shape than leading edge Pa due to the shape of support portions 271 as shown in FIG. 26. When the paper is discharged in this configuration, it is difficult for a trailing edge Pb to abut the leading edge of a subsequent sheet of paper and it becomes difficult for the paper to be pushed out of paper discharge tray 280 by a subsequent sheet of paper because the concave shape of trailing edge Pb of paper P after it is discharged is gentle or close to being flat. However curving the discharged paper as discussed above allows the leading edge of the trailing paper to push the previous sheet.

Figure 27:
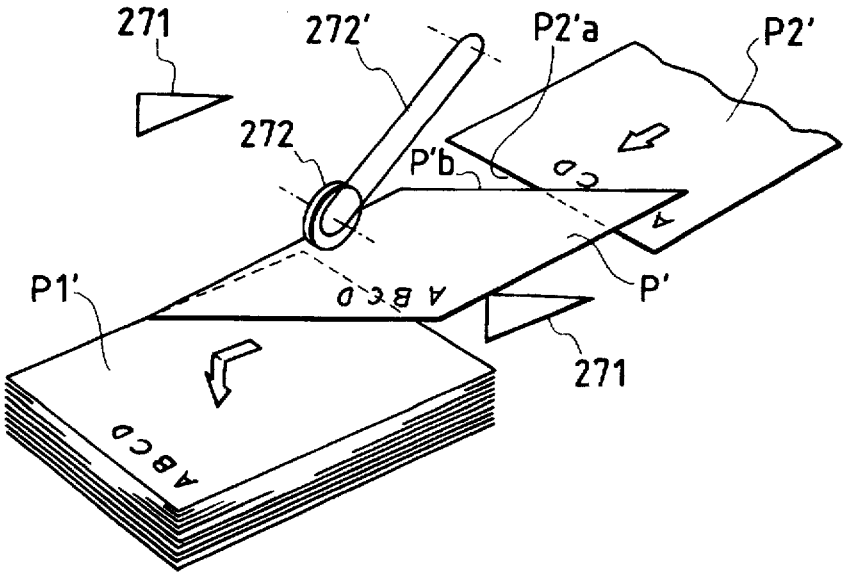
FIG. 27 is a perspective schematic view of a paper discharge operation constructed in accordance with the present invention.
Figure 36:
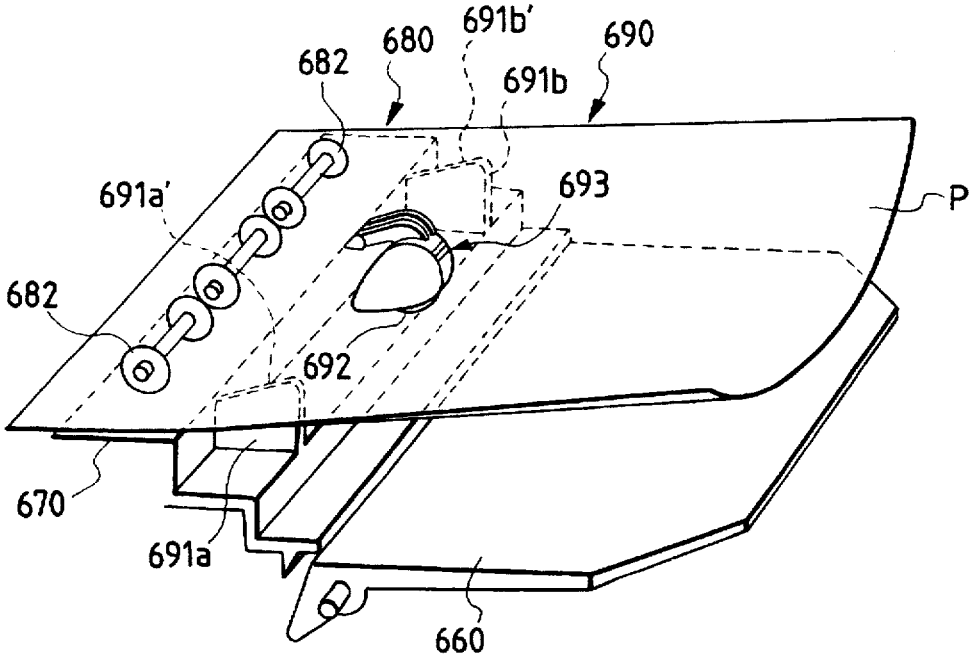
FIG. 36 PRIOR ART
Figure 37:
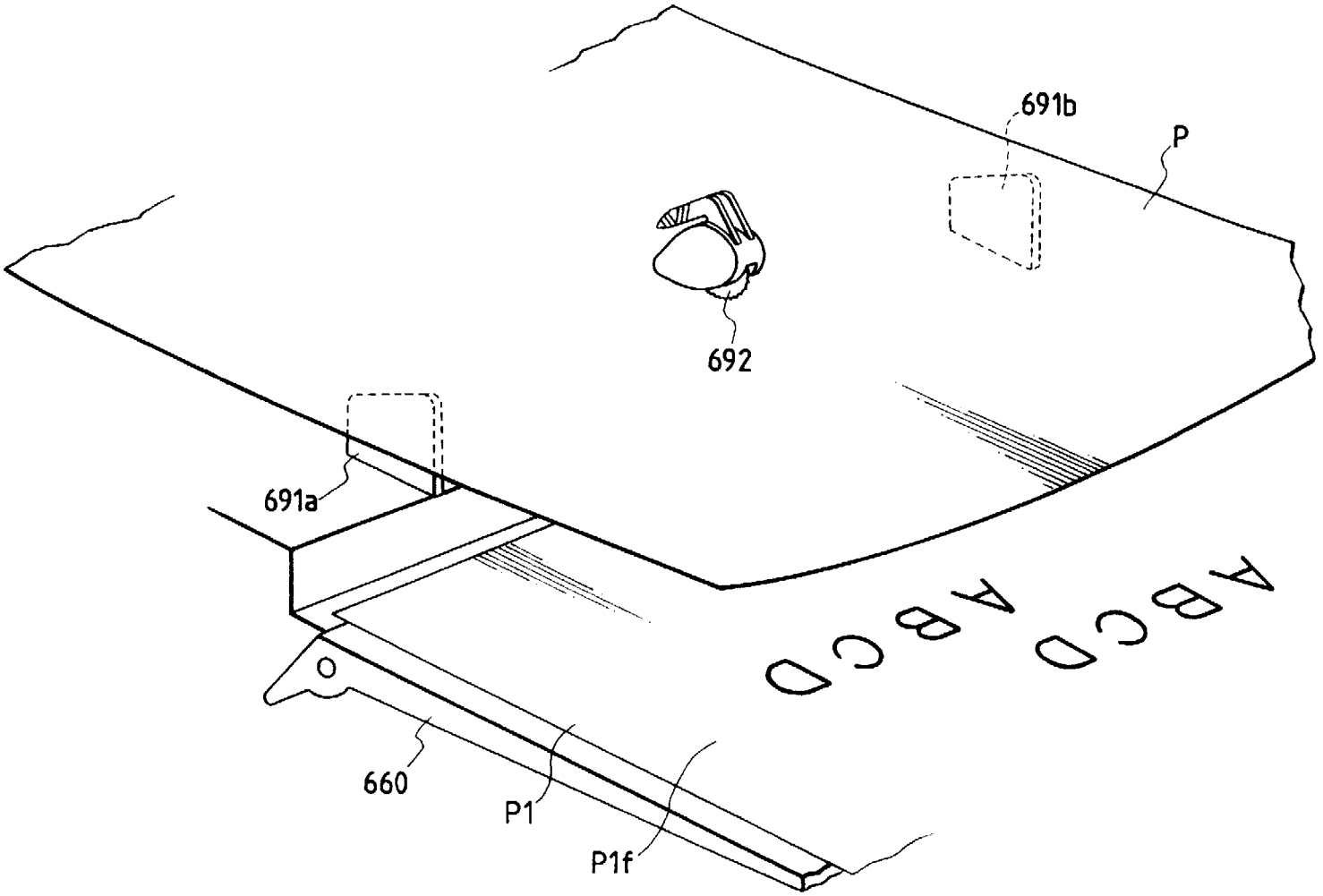
FIG. 37 PRIOR ART
Figure 38:
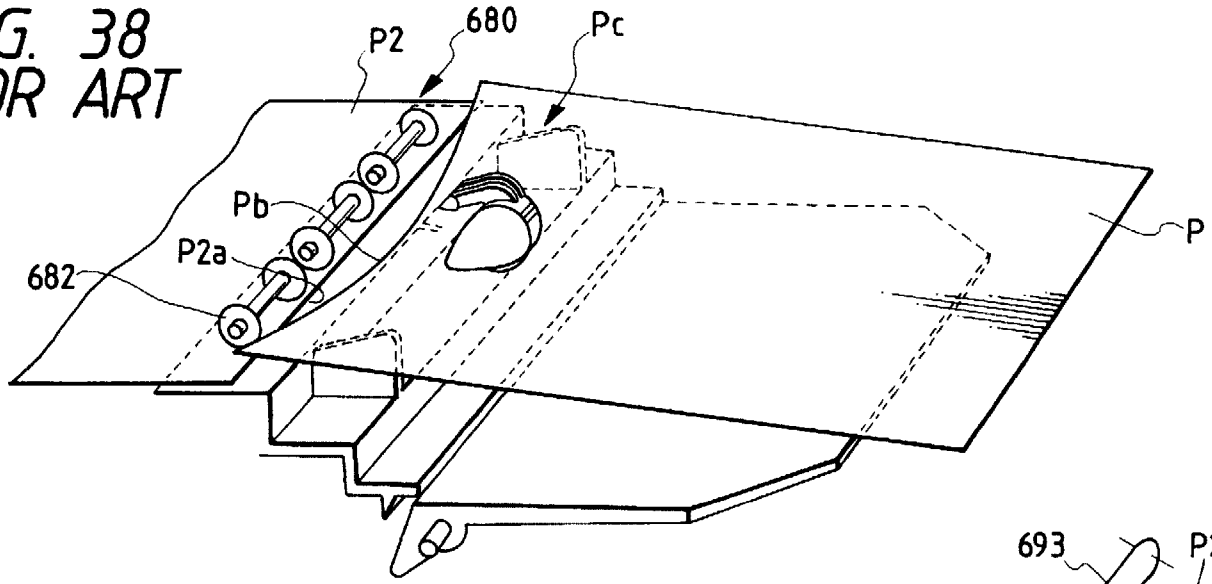
FIG. 38 PRIOR ART
Figure 40:
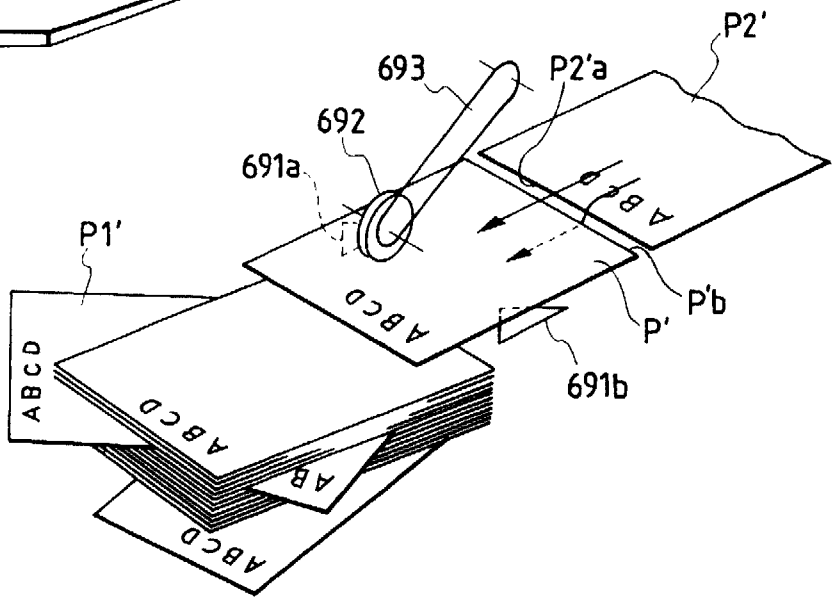
FIG. 40 PRIOR ART
Figure 39:
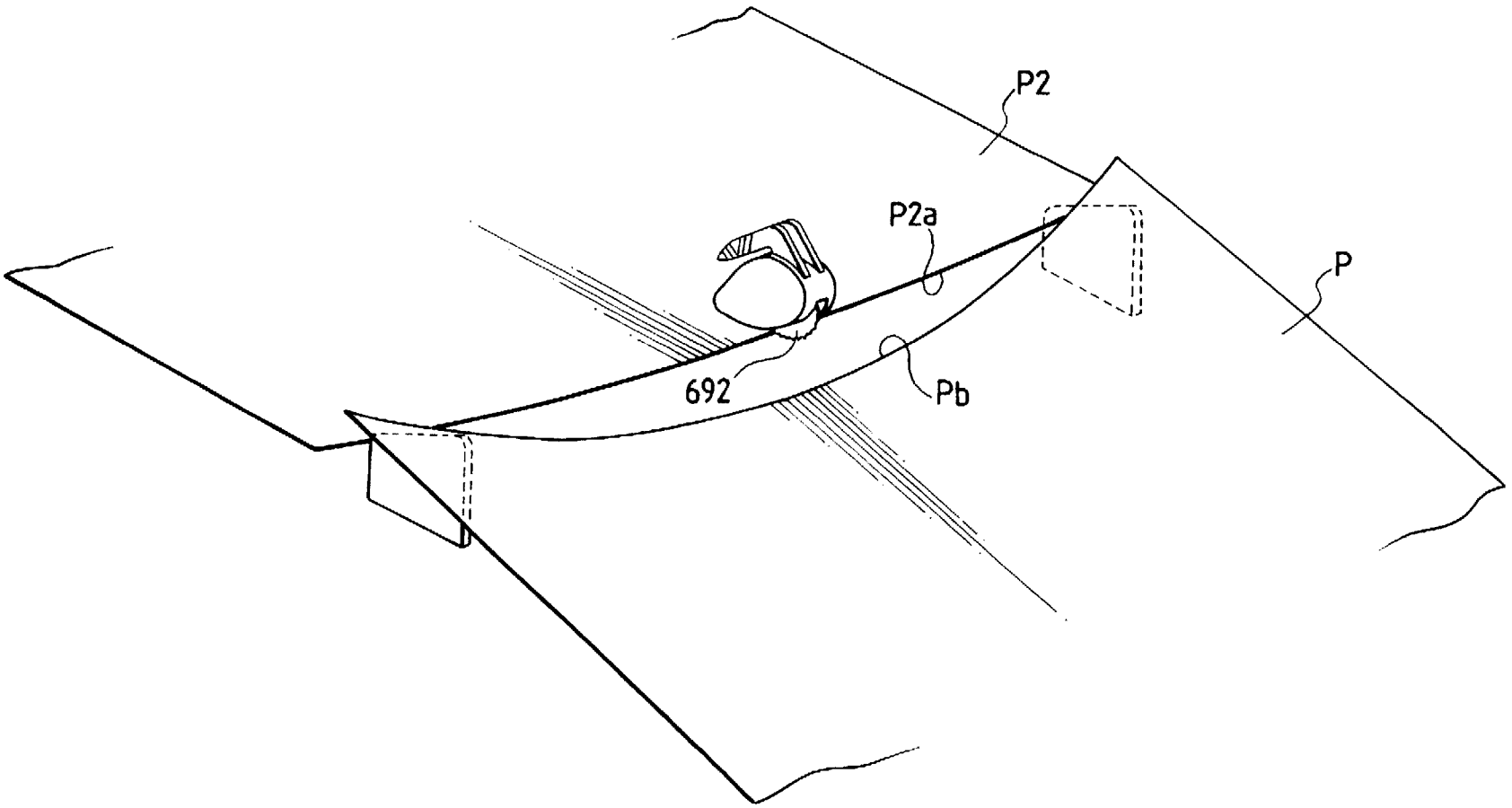
FIG. 39 PRIOR ART

Secondly, if paper which does not require the support of both sides is being used, for example, postcards or small-size envelopes, when these types of paper are set in paper feeder apparatus 1100, left hand edge guide assembly 150*a* is slid in the direction of arrow X2' (FIGS. 18 and 20). In conjunction with this sliding, when the left hand support portion 271 enters region B1 (where support of both side portions of a paper is not required) from region B2 (where support of both side portions of a paper is required), protrusion 221*b* contacts second arm 320 of lever 300 and rotates lever 300 in a counter-clockwise direction (as discussed above), thereby releasing the connection between first arm hook portion 311 and engaging portion 133*e* of paper roller cover 133. Therefore, support portion 271 connected to case 291 is separated from edge guide assembly 150*a*, and only edge guide assembly 150*a* slides in the direction of arrow X2'. That is, support portion 271 is left behind, and as a result, as shown in FIG. 27, paper P' such as a postcard is automatically discharged where it is supported by only the right side support portion 271. Accordingly, the leading edge P'2*a* of a subsequent sheet of paper P2' reliably abuts the trailing edge P'*b* of a previous paper P', and previous paper P' is reliably stacked on top of previously printed paper P1'. Consequently, the problem discussed with prior art devices (FIG. 36) where there was disordering of the stacking of papers when the paper was supported on both sides thereof, and the mixing up of the stacking order is more reliably and automatically prevented. When it is desired to return to using a larger sized paper such as A4 or B5, left hand edge guide assembly 150*a* is slid to the left (in the direction of arrow X1, FIG. 20), and when edge guide assembly 150*a* enters region B2 (where support of both sides of a paper is required) from region B1 (where support of both sides of a paper is not required) paper feed roller cover 133 abuts case 291 and moves it to the left. In conjunction with the moving of case 291 to the left, the restriction of lever 300 caused by protrusions 221b does not exist thereby permitting lever 300 to rotates in a clockwise direction (arrow e, FIG. 19) and again hook portion 311 engages with engaging portion 133e of paper feed roller cover 133 and the linked condition described above is assured.

Therefore, a printer, such as an ink jet printer, constructed in accordance with the invention, reduces the need to individually and separately slide each support portion 271 and more reliably achieves a proper discharge operation corresponding to the type and size of paper supplied.

Additionally, in the case of printing on fan sheet paper, each support portion 271 is in an upright state and the concave deformation of the paper gives rise to fears of a detrimental influence on the printing condition at printing section A. Consequently, in this case it is desired that both the left and right support portions 271 be in the prone condition.

However, without the use of the invention disclosed herein, when the above described types of paper other than fan sheet paper are used again, the user must individually operate pushing-up arms 274e and raise support portions 271, and there is a problem if both of these steps are not performed. However, in accordance with the present invention, when printing paper other than fan sheet paper, paper feed roller shaft 131, paper feed roller shaft 131 and paper feed rollers 130 of the operating paper feeder apparatus 1100 rotate. As support portions 271 are automatically placed in an upright condition by the previously described automatic return means 290, the proper discharge operation can be more reliably obtained.

The above is an explanation of the embodiments of this invention, but the present invention is not limited to the embodiments described above. That is, variations are also possible while remaining within the scope of the invention. For example, in the first embodiment, only one guide roller 75 is provided in a position corresponding to the flap portion of an envelope (thick portion), but as there are cases in which the entire paper bends, bulges or is warped. Accordingly, a plurality of guide rollers may also be provided to take this situation into account. Furthermore, guide roller 75 is preferably formed of a water repellent plastic. However, a serrated roller may also be used. A serrated roller is advantageous because the serrated nature of the roller is effective in preventing the ink from smearing or the paper from staining.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer comprising:

a printer body including a print section therein;

a paper supply apparatus operatively mounted to said printer body and adapted to receive at least one sheet of paper on a surface thereof, said paper supply apparatus having a first edge guide for guiding a first side edge of a sheet of paper and a second edge guide spaced from said first edge guide for guiding a second side edge of a sheet of paper, at least one of said first and second edge guides being a slidable edge guide slidable in at least one of a first direction towards the other edge guide and a second direction away from the other edge guide to accommodate a width of a sheet of paper received in said paper supply apparatus;

a paper discharge section, said discharge section comprising a first support portion mounted on said printer body and a second support portion mounted on said printer body and spaced apart from said first support portion, said first support portion supporting a respective first bottom side portion of a sheet of paper discharged from said print body and said second support portion supporting a respective second bottom side portion of a sheet of paper, at least said first support portion being a slidable support portion slidable in a first direction towards said second support portion and a second direction away from said second support portion said paper supply and said discharge section being seperately provided; and a linkage mechanism linking said slidable edge guide to at least said first support portion, said linkage mechanism sliding at least said slidable edge guide and at least said first support portion in unison.

2. The printer as claimed in claim 1, wherein said linkage mechanism includes a linkage rod having a first end and a second end and being rotatably mounted in said printer body, said linkage rod having a first pinion formed on said first end and a second pinion formed on said second end; a first rack coupled to said slidable support portion and engaging with said first pinion; and a second rack coupled to said slidable edge guide and engaging with said second pinion, whereby said first support portion can slidably engage with said slidable edge guide.

3. The printer as claimed in claim 1, wherein said first support portion is adapted to rotate between a first position for supporting a first bottom side portion of a sheet of paper and at least a second position in which said support portion does not support a first bottom side portion of a sheet of paper.

4. The printer as claimed in claim 3, further including at least one retaining portion formed on said printer body, operatively coupled to said support portion and releasably securing said first support portion in said second position where said first support surface does not support a first bottom side portion of a sheet of paper.

5. The printer as claimed in claim 4, and including a releasing member for releasing said first support portion from said second position so that said first support portion can rotate to said first position to support a bottom side portion of a sheet of paper.

6. The printer as claimed in claim 3, wherein said discharge section further includes a pushing down portion mounted on the printer body and positioned intermediate said first support portion and said second support portion, said pushing down portion pushing down a central portion of a sheet of paper which has exited from said print section;

said first support portion slidable along a path towards said second support portion a distance so that said first support portion is positioned intermediate said pushing down portion and said second support portion, said pushing down portion being disposed along said slide path, said first support portion being further adapted to rotate in said second direction when said first support portion contacts said pushing-down portion.

7. The printer as claimed in claim 1, wherein said linkage mechanism includes a lever operatively engageable with said sliding edge guide and said first support portion to cause said slidable edge guide and said first support portion to slide in unison.

8. The printer as claimed in claim 7, and including a release mechanism including a protrusion extending from said printer body; said protrusion being engageable with said lever when said first support portion slides towards said second support portion so that when said protrusion engages said lever said lever operatively disengages said sliding edge guide from said first support portion.

9. A printer having a print body, said printer comprising:

a first support portion mounted on said print body and a second support portion mounted on said print body and spaced apart from said first support portion, said first support portion supporting a respective first bottom side portion of a sheet of paper discharged from said print body and said second support portion supporting a respective second bottom side portion of a sheet of paper, at least said first support portion being a slidable support portion slidable in a first direction towards said second support portion and a second direction away from said second support portion;

a first edge guide assembly for guiding a first side edge of a sheet of paper and a second edge guide assembly spaced from said first edge guide assembly for guiding a second side edge of a sheet of paper, at least one of said first and second edge guide assemblies being a slidable edge guide assembly slidable in at least one of a first direction towards the other edge guide assembly and a second direction away from the other edge guide assembly to accommodate a width of a sheet of paper; and a linkage mechanism for linking said slidable edge guide assembly to at least said first support portion, said linkage mechanism sliding at least said slidable edge guide assembly and at least said first support portion to slide in unison, said slidable edge guide assembly being linked to the first support portion when said first support portion is disposed within a region of the printer where a sheet of paper is supported on a respective first bottom side portion by said first support portion and supported on a second bottom side portion by the second support portion.

10. The printer as claimed in claim 9, wherein said linkage mechanism includes a lever operatively engageable with said sliding edge guide assembly and said first support portion to cause said slidable edge guide assembly and said first support portion to slide in unison.

11. The printer as claimed in claim 10, and including a release mechanism including a protrusion extending from said printer body; said protrusion being engageable with said lever when said first support portion slides towards said second support portion so that when said protrusion engages said lever, said lever operatively disengages said sliding edge guide from said first support portion.

12. The printer as claimed in claim 11, wherein said release mechanism releases the engagement of said slidable edge guide assembly and said first support portion when said first support portion slides towards a region of the printer where a sheet of paper does not require support on both respective bottom side portions.

13. A printer having a printer body, said printer comprising:

a paper feed roller shaft rotatably mounted on the printer body and rotatable in a paper conveying direction;

a first support portion mounted in said printer body and a second support portion mounted in said printer body and spaced apart from said first support portion, said first support portion supporting a respective first bottom side portion of a sheet of paper discharged from said print body and said second support portion supporting a respective second bottom side portion of a sheet of paper, at least said first support portion being a slidable support portion slidable in a first direction towards said second support portion and a second direction away from said second support portion; and said first support portion rotating between a first position for supporting a first bottom side portion of a sheet of paper and at least a second position in which said support portion does not support a first bottom side portion of a sheet of paper;

an automatic return mechanism mounted to said paper feed roller shaft and operatively coupled to said first support portion, said automatic return mechanism causing said first support portion to rotate from said second position to said first position.

14. The printer as claimed in claim 13, wherein said automatic return mechanism further includes a wheel rotatably mounted on said paper feed roller shaft, and further including a slider operatively coupled to said first support portion and displaceable between at least a first slider position at which said first support portion is at said first position and a second slider position at which said first support portion is at said second position, said slider including an arm connected to said slider, said arm operatively engageable with said wheel so that when said paper feed roller shaft rotates in said paper conveying direction said wheel rotates causing said slider to be displaced to said first slider position so that said first support portion rotates from said second position to said first position.

15. The printer as claimed in claim 14, and including an energizing member for urging said slider towards said first slider position.

16. The printer as claimed in claim 15, and including a base member operatively connected to said automatic return mechanism, said energizing member connected between said slider and said base member, said base member including a catch connected thereto, said slider including a claw member operatively engageable with said catch so that when said claw is engaged with said catch said slider is at said second slider position so that said first support portion is at said second position, and wherein the rotation of said paper feed roller shaft in said paper conveying direction causes said claw to disengage with said catch thereby causing said slider to be urged towards said first slider position by the urging of said energizing member.

17. The printer as claimed in claim 13, and including a first edge guide for guiding a first side edge of a sheet of paper and a second edge guide spaced from said first edge guide for guiding a second side edge of a sheet of paper, at least one of said first and second edge guides being a slidable edge guide slidable in at least one of a first direction towards the other edge guide and a second direction away from the other edge guide to accommodate a width of a sheet of paper received in said paper supply apparatus; and a linkage mechanism for linking said slidable edge guide to at least said first support portion so as to cause at least said slidable edge guide and at least said first support portion to slide together.

18. The printer as claimed in claim 17, wherein said linkage mechanism includes a lever operatively engageable with said sliding edge guide and said first support portion to cause said slidable edge guide and said first support portion to slide together.

19. The printer as claimed in claim 18, and including a release mechanism including a protrusion extending from said printer body; said protrusion being engageable with said lever when said first support portion slides towards said second support portion so that when said protrusion engages said lever said lever operatively disengages said sliding edge guide from said first support portion.

20. The printer as claimed in claim 18, and including a paper feed roller cover disposed over said paper feed roller shaft, said paper feed roller cover including an engaging portion connected thereto, said lever being selectively engageable with said engaging portion so as to cause said first support portion and said sliding edge guide to slide together when said lever is engaging said engaging portion.

* * * * *